US008333467B2

(12) United States Patent
Yoshida

(10) Patent No.: US 8,333,467 B2
(45) Date of Patent: Dec. 18, 2012

(54) IMAGE-FORMING DEVICE

(75) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/212,416

(22) Filed: Aug. 18, 2011

(65) Prior Publication Data

US 2011/0298860 A1 Dec. 8, 2011

Related U.S. Application Data

(62) Division of application No. 11/699,416, filed on Jan. 30, 2007, now Pat. No. 8,020,985.

(30) Foreign Application Priority Data

Jan. 30, 2006 (JP) ..... 2006-020615

(51) Int. Cl.
*B41J 2/01* (2006.01)

(52) U.S. Cl. ..... 347/104; 347/5; 347/16; 347/19

(58) Field of Classification Search ..... 347/5, 14, 347/16, 19, 101, 104; 271/3.14, 3.15, 3.16
See application file for complete search history.

(56) References Cited

U.S. PATENT DOCUMENTS

| | | | | |
|---|---|---|---|---|
| 6,092,893 | A | 7/2000 | Yokoi et al. | |
| 2004/0183846 | A1 * | 9/2004 | Kunihiro | 347/14 |
| 2004/0252176 | A1 | 12/2004 | Sugiura | |
| 2005/0088472 | A1 | 4/2005 | Nunokawa | |
| 2006/0221165 | A1 | 10/2006 | Kato | |

FOREIGN PATENT DOCUMENTS

| | | | |
|---|---|---|---|
| JP | H05-038853 | A | 2/1993 |
| JP | 2002-283543 | A | 10/2002 |
| JP | 2002-321412 | A | 11/2002 |
| JP | 2004-160797 | A | 6/2004 |
| JP | 2005-075519 | A | 3/2005 |
| JP | 2005-081780 | A | 3/2005 |
| JP | 2005-288361 | A | 10/2005 |

OTHER PUBLICATIONS

Japan Patent Office, Office Action for Japanese Patent Application No. 2006-020615 (counterpart to co-pending U.S. Appl. No. 11/699,416), mailed Jan. 25, 2011.

* cited by examiner

*Primary Examiner* — Matthew Luu
*Assistant Examiner* — Rut Patel
(74) *Attorney, Agent, or Firm* — Baker Botts L.L.P.

(57) ABSTRACT

An image forming device includes a recording head, a first pair of conveying rollers, a second pair of conveying rollers, and a conveyance controller. The conveyance controller controls the first and second pairs of conveying rollers to halt a conveying operation of the recording medium when a trailing edge of the recording medium has moved to or exceeded a position downstream from the nip position of the first pair of conveying rollers by a first prescribed distance during a first prescribed period of time running from a time instant when the trailing edge of the recording medium has passed through the nip position of the first pair of the conveying rollers.

6 Claims, 21 Drawing Sheets

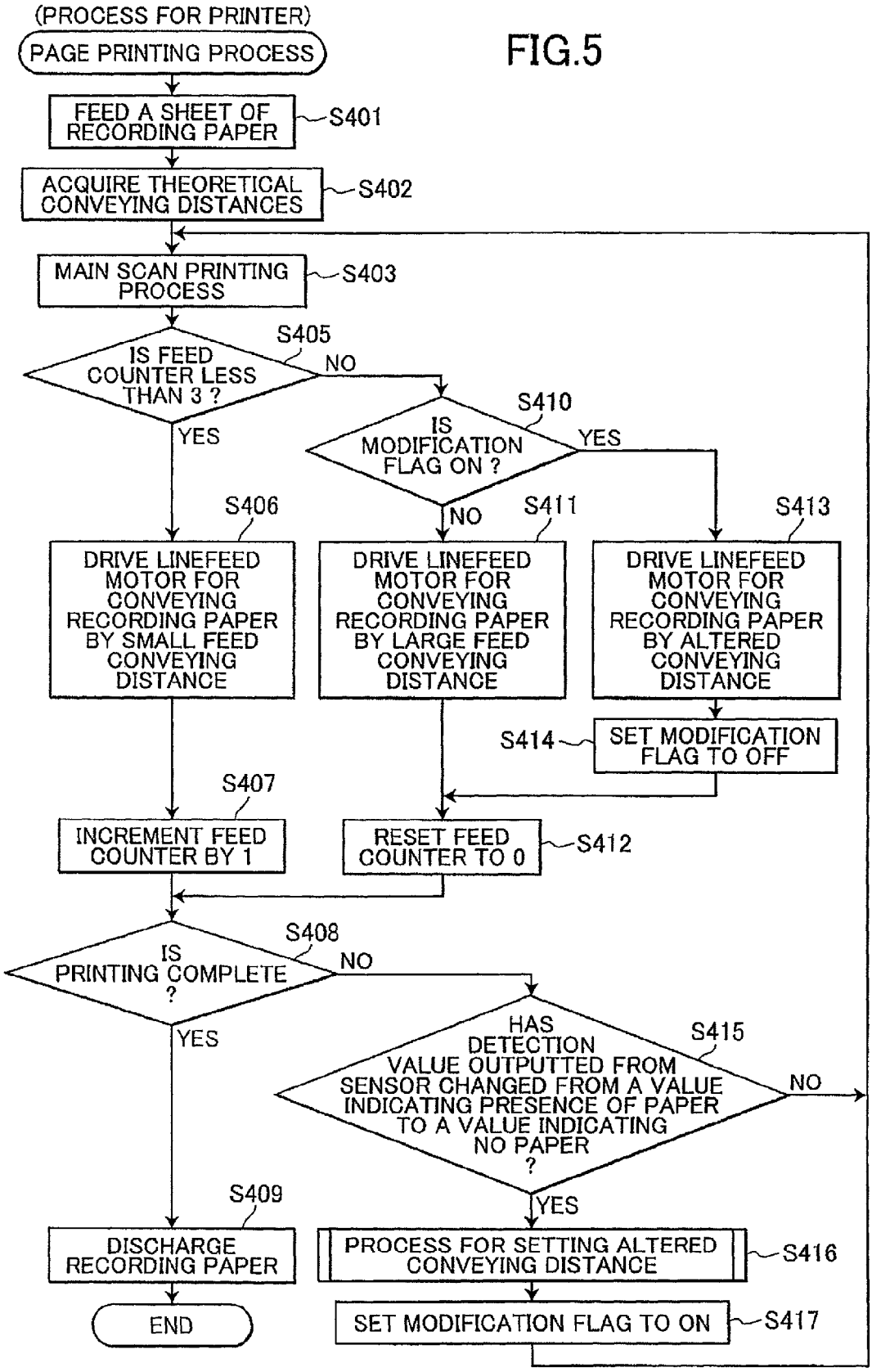
(PROCESS FOR PRINTER)
PAGE PRINTING PROCESS
FIG.5
FEED A SHEET OF RECORDING PAPER
S401
ACQUIRE THEORETICAL CONVEYING DISTANCES
S402
MAIN SCAN PRINTING PROCESS
S403
S405
IS FEED COUNTER LESS THAN 3 ?
NO
YES
S410
IS MODIFICATION FLAG ON ?
YES
NO
S406
DRIVE LINEFEED MOTOR FOR CONVEYING RECORDING PAPER BY SMALL FEED CONVEYING DISTANCE
S411
DRIVE LINEFEED MOTOR FOR CONVEYING RECORDING PAPER BY LARGE FEED CONVEYING DISTANCE
S413
DRIVE LINEFEED MOTOR FOR CONVEYING RECORDING PAPER BY ALTERED CONVEYING DISTANCE
S414
SET MODIFICATION FLAG TO OFF
S407
INCREMENT FEED COUNTER BY 1
RESET FEED COUNTER TO 0
S412
S408
IS PRINTING COMPLETE ?
NO
YES
S415
HAS DETECTION VALUE OUTPUTTED FROM SENSOR CHANGED FROM A VALUE INDICATING PRESENCE OF PAPER TO A VALUE INDICATING NO PAPER ?
NO
YES
S409
DISCHARGE RECORDING PAPER
PROCESS FOR SETTING ALTERED CONVEYING DISTANCE
S416
END
SET MODIFICATION FLAG TO ON
S417

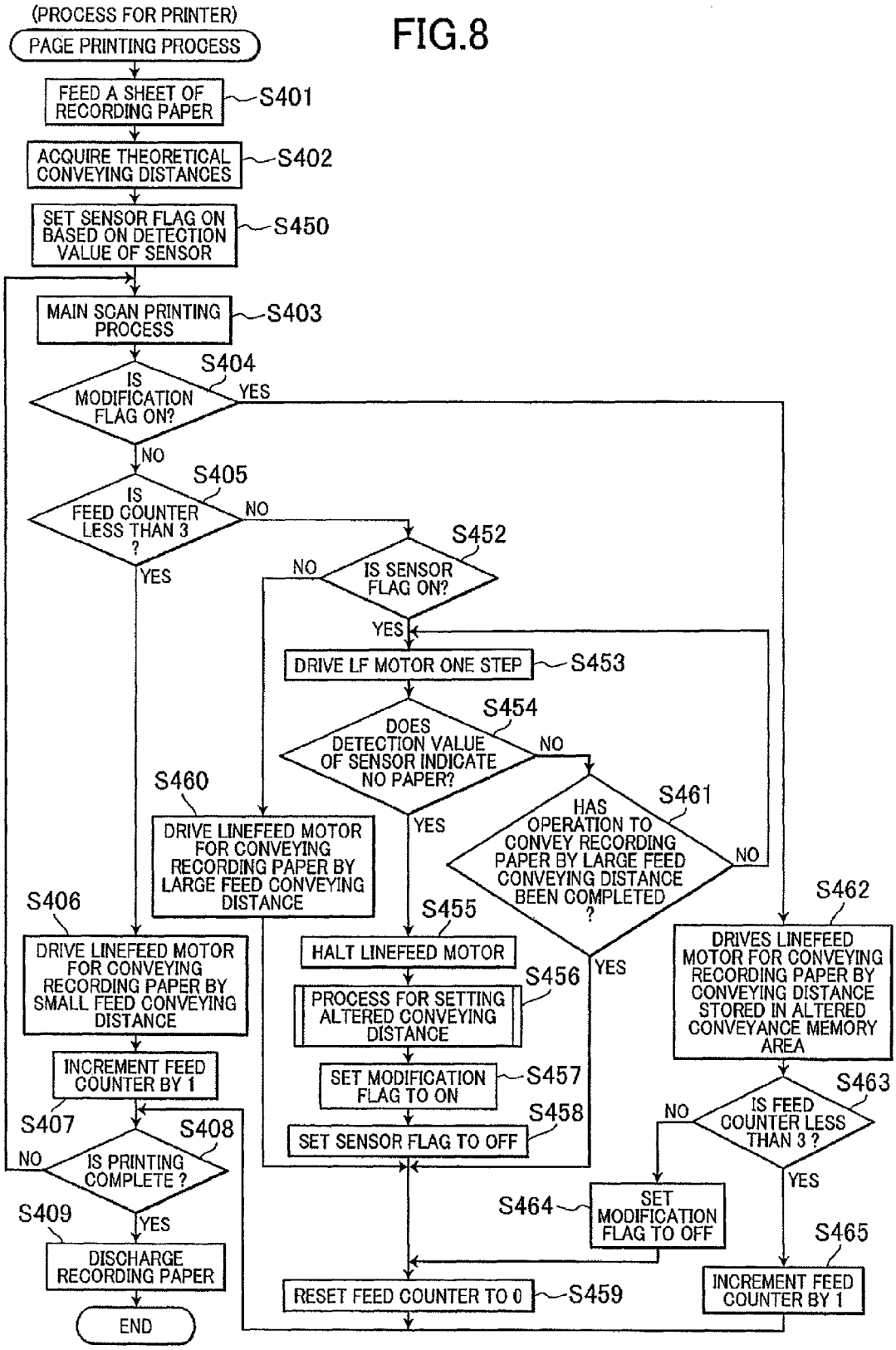
FIG.8
(PROCESS FOR PRINTER)
PAGE PRINTING PROCESS
FEED A SHEET OF RECORDING PAPER
S401
ACQUIRE THEORETICAL CONVEYING DISTANCES
S402
SET SENSOR FLAG ON BASED ON DETECTION VALUE OF SENSOR
S450
MAIN SCAN PRINTING PROCESS
S403
S404
IS MODIFICATION FLAG ON?
YES
NO
S405
IS FEED COUNTER LESS THAN 3 ?
NO
YES
S452
IS SENSOR FLAG ON?
NO
YES
DRIVE LF MOTOR ONE STEP
S453
S454
DOES DETECTION VALUE OF SENSOR INDICATE NO PAPER?
NO
YES
S460
DRIVE LINEFEED MOTOR FOR CONVEYING RECORDING PAPER BY LARGE FEED CONVEYING DISTANCE
S461
HAS OPERATION TO CONVEY RECORDING PAPER BY LARGE FEED CONVEYING DISTANCE BEEN COMPLETED ?
NO
YES
S406
DRIVE LINEFEED MOTOR FOR CONVEYING RECORDING PAPER BY SMALL FEED CONVEYING DISTANCE
S455
HALT LINEFEED MOTOR
S456
PROCESS FOR SETTING ALTERED CONVEYING DISTANCE
SET MODIFICATION FLAG TO ON
S457
S458
SET SENSOR FLAG TO OFF
S462
DRIVES LINEFEED MOTOR FOR CONVEYING RECORDING PAPER BY CONVEYING DISTANCE STORED IN ALTERED CONVEYANCE MEMORY AREA
S463
IS FEED COUNTER LESS THAN 3 ?
NO
YES
S464
SET MODIFICATION FLAG TO OFF
S465
INCREMENT FEED COUNTER BY 1
INCREMENT FEED COUNTER BY 1
S407
S408
IS PRINTING COMPLETE ?
NO
YES
S409
DISCHARGE RECORDING PAPER
END
RESET FEED COUNTER TO 0
S459

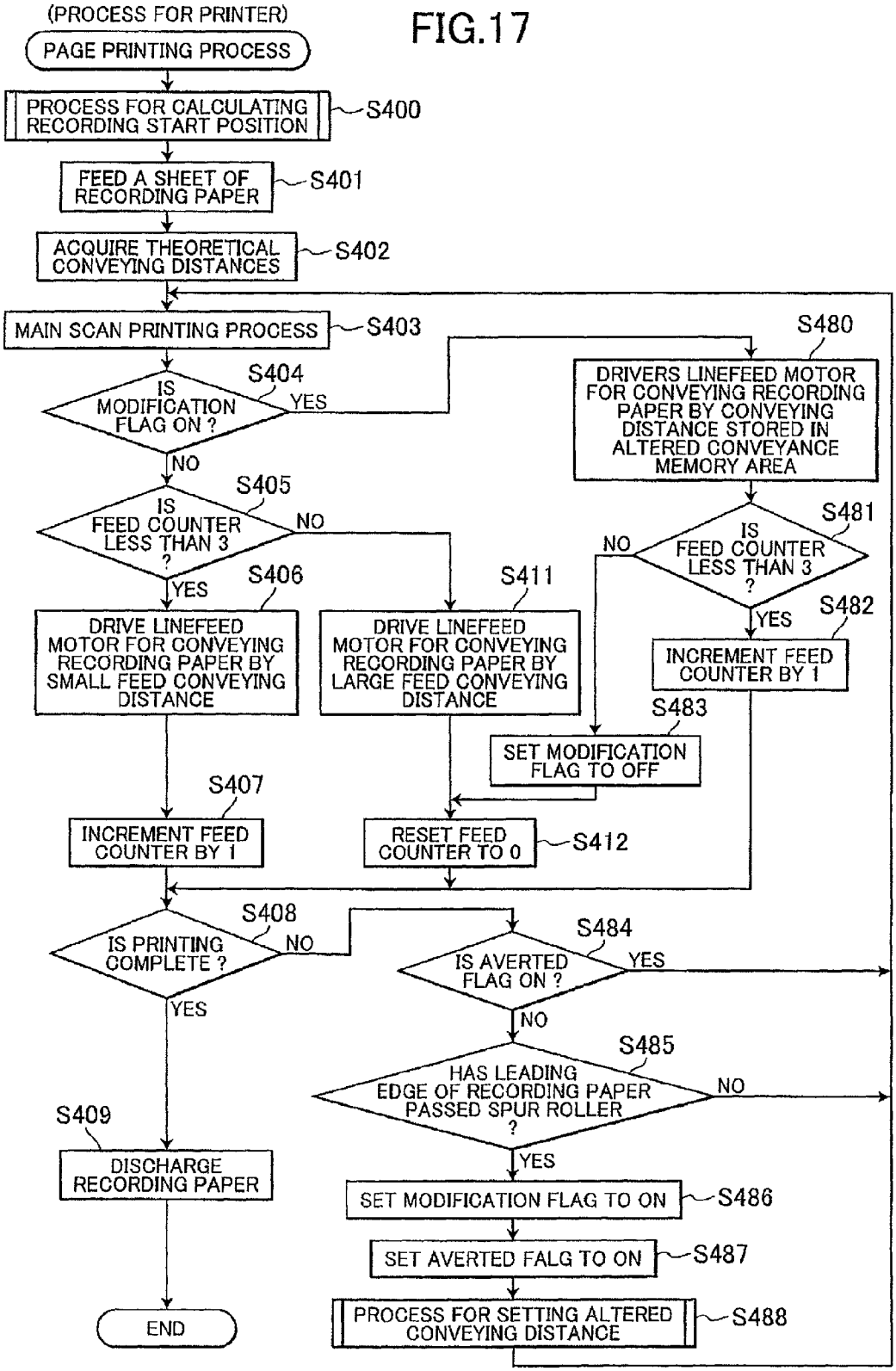
(PROCESS FOR PRINTER)
FIG.17
PAGE PRINTING PROCESS
PROCESS FOR CALCULATING RECORDING START POSITION
S400
FEED A SHEET OF RECORDING PAPER
S401
ACQUIRE THEORETICAL CONVEYING DISTANCES
S402
MAIN SCAN PRINTING PROCESS
S403
S404
IS MODIFICATION FLAG ON ?
YES
NO
S480
DRIVERS LINEFEED MOTOR FOR CONVEYING RECORDING PAPER BY CONVEYING DISTANCE STORED IN ALTERED CONVEYANCE MEMORY AREA
S405
IS FEED COUNTER LESS THAN 3 ?
NO
YES
S481
IS FEED COUNTER LESS THAN 3 ?
NO
YES
S406
DRIVE LINEFEED MOTOR FOR CONVEYING RECORDING PAPER BY SMALL FEED CONVEYING DISTANCE
S411
DRIVE LINEFEED MOTOR FOR CONVEYING RECORDING PAPER BY LARGE FEED CONVEYING DISTANCE
S482
INCREMENT FEED COUNTER BY 1
S483
SET MODIFICATION FLAG TO OFF
S407
INCREMENT FEED COUNTER BY 1
RESET FEED COUNTER TO 0
S412
S408
IS PRINTING COMPLETE ?
NO
YES
S484
IS AVERTED FLAG ON ?
YES
NO
S485
HAS LEADING EDGE OF RECORDING PAPER PASSED SPUR ROLLER ?
NO
YES
S409
DISCHARGE RECORDING PAPER
SET MODIFICATION FLAG TO ON
S486
SET AVERTED FALG TO ON
S487
PROCESS FOR SETTING ALTERED CONVEYING DISTANCE
S488
END HS1a
1P
2P
3P
4P
P HS2a
1P
2P
3P
4P HS1b
1P
2P
3P
4P HS2b
1P
2P
3P
4P HS1
HS2
HS
1P
2P
3P
4P
LF
SF
AREA THAT DISCHARGE ROLLERS PASS THROUGH
AREA THAT CONVEYING ROLLER PASS THROUGH
G
H
D
C
T

FIG.20(c')

IMAGE-FORMING DEVICE

CROSS REFERENCE TO RELATED APPLICATIONS

This application is a divisional application of U.S. patent application Ser. No. 11/699,416, filed Jan. 30, 2007, which claims the benefit of Patent Application No. 2006-020615 filed Jan. 30, 2006, the disclosures of which are incorporated herein by reference in their entirety.

TECHNICAL FIELD

The disclosure relates to an image-forming device and a method of controlling the image-forming device. The image-forming device are capable of improving image quality by conveying a recording medium with high precision.

BACKGROUND

One type of inkjet printer well known in the art forms images on a recording medium by repeatedly and alternately executing a recording operation for reciprocating a print head in a main scanning direction while the print head ejects ink onto the recording medium, and a conveying operation for conveying the recording medium in a subscanning direction.

In order to suppress the occurrence of banding (streaks of ink), one inkjet printer disclosed in Japanese unexamined patent application publication No. 2002-283543 (paragraphs 13 and 52) performs a nonuniform conveying operation for conveying the recording medium nonuniformly.

SUMMARY

This nonuniform conveying operation will be described with reference to FIGS. 20(*a*), 20(*b*), 20(*c*), and 20(*c*'). FIG. 20(*a*) shows an example of conveying a recording medium uniformly, while FIGS. 20(*b*) and 20(*c*) show an example of conveying the recording medium nonuniformly.

In FIG. 20(*a*)-20(*c*), an arrow A indicates the main scanning direction in which the print head reciprocates, while an arrow B indicates the subscanning direction in which the recording medium is conveyed. Further, the length of the print head in the subscanning direction B is set at one inch. The head has nozzles arranged linearly in the subscanning direction B for forming dots at intervals of 150 dpi. A recording density of 600 dpi has been requested for the print region I indicated by a rectangle. Hence, if one pass refers to a single operation executed by the recording head in the main scanning direction, then the recording head must perform four passes to satisfy the requested recording density. In this example, printing begins from the bottom of FIG. 20(*a*), 20(*b*), where 1P indicates an image formed on the recording medium during the first pass of the print head, 2P an image formed in the second pass, 3P an image formed in the third pass, and 4P an image formed in the fourth pass.

With these settings, uniform conveyance is a method shown in FIG. 20(*a*) for conveying the recording medium at a constant conveying distance L (¼ inch) for each pass of the print head. FIG. 20(*b*) shows a nonuniform conveying method for conveying the recording medium by a distance SF1 after the first pass, a distance SF2 after the second pass, a distance SF3 after the third pass, and a distance LF after the fourth pass. Specifically, conveyance in this method is performed by repeating three small feeds followed by one large feed.

FIG. 20(*c*) is an enlarged view of FIG. 20(*b*) showing the dots formed on the recording medium as the medium is conveyed. In FIG. 20(*c*), 600 dpi resolution is achieved using 148 nozzles having nozzles numbers 0-147. By performing four passes with 148 usable nozzles, it is possible to form 592 dots in a width of 592/600×1 inch. For 600 dpi, therefore, the dot interval (pitch) is 1/600×1 inch.

More specifically, as shown in the partial enlarged view (c') of FIG. 20(*c*), conveying distances SF1, SF2, and SF3 for three small feeds performed after printing the first pass are each set to a pitch of 3. By printing in four passes, three dots can be inserted between dot intervals formed at 150 dpi in the first pass to achieve 600 dpi. Since a total of 592 dots are formed in four passes with 148 nozzles, after completing the four passes it is necessary to convey the recording medium a distance equivalent to 592 pitches from the head dot position in the first pass. Therefore, a single large feed conveying operation is performed at a conveying distance LF for a distance equivalent to 583 pitches, which is calculated by subtracting the total conveying distance of 9 pitches for the three small feeds from 592 pitches, thereby achieving 600 dpi resolution through nonuniform conveyance.

To implement this type of conveying operation, the inkjet printer is provided with roller members for conveying the recording medium, and a motor for driving the roller members.

The print head for ejecting ink onto the recording medium is positioned between a pair of conveying rollers on the upstream side and a pair of discharge rollers on the downstream side. The conveying rollers and discharge rollers convey the recording medium fed into the printer. More specifically, when a sheet of a recording medium is fed into the printing device, first the pair of conveying rollers disposed on the upstream side in the conveying direction pinch and convey the recording medium. Next, both the conveying rollers and the discharge rollers pinch and convey the recording medium. Finally, only the discharge rollers convey the recording medium and discharge the medium from the printing device. In inkjet printers such as that disclosed in Japanese unexamined patent application publication No. HEI-5-38853, the discharge roller that contacts the recorded surface of the recording medium is commonly formed of a spur roller.

In order to improve image quality, it is important that the conveying mechanism described above convey the recording medium with precision. However, the nip force between the conveying rollers is commonly set greater than that between the discharge rollers so that the recording medium is conveyed according to the rotation of the conveying rollers. The discharge rollers are also commonly configured to rotate at a speed slightly faster than that of the conveying rollers in order to prevent slack in the recording medium. When the conveying state in this type of inkjet printer switches from conveyance by the pair of conveying rollers to conveyance by the pair of discharge rollers, the recording medium tends to jump forward, a phenomenon in which the recording medium advances faster than the drive of the motor, when the trailing edge of the recording medium passes through the discharge rollers and is released from the tension applied by these rollers. This forward jump reduces the conveying accuracy of the recording medium.

Inkjet printers proposed for reducing this forward jump include an encoder for detecting the conveying distance of the recording medium and employ a back feed mechanism configured to convey the recording medium back upstream when the conveying distance detected by the encoder is greater than a prescribed amount in order to compensate for this excess conveyance. However, the additional back feed mechanism increases production costs. Further, it is difficult to perform reverse conveyance with accuracy in printers that are produced based on forward conveyance. As a result, it has not been possible to achieve sufficient conveying accuracy.

Another technique proposed for reducing the amount of excess conveyance occurring in a forward jump involves reducing the speed as the trailing edge of the recording medium passes through a nip point between the conveying rollers. However, this technique requires that the printer manage the timing at which the trailing edge of the recording medium passes through the nip point and requires a control process for altering the conveying speed, increasing the complexity of the conveying control process. Moreover, reducing the conveying speed when the trailing edge passes through the nip point decreases the overall recording speed.

Further, the leading edge of the recording medium can impede forward rotation of the spur roller (rotation in the direction for conveying the recording medium) when introduced between the discharge rollers provided downstream of the print head if the leading edge is curled, sometimes preventing the recording medium from being conveyed the prescribed distance.

In view of the foregoing, it is an object of the present invention to provide an image-forming device and a method controlling the image-forming device that are capable of improving image quality by conveying a recording medium with high precision.

In view of the foregoing, it is an object of the invention to provide an image forming device. The image forming device include a recording head, a first pair of conveying rollers, and a second pair of conveying rollers. The recording head forms images on a recording medium having a width and a length. The recording head is disposed in a position along a recording medium conveying path. The first pair of conveying rollers is disposed in a first position along the recording medium conveying path and conveys the recording medium with frictional force created at a nip position, the recording medium being conveyed while being oriented in a direction in which lengthwise of the recording medium is in parallel with a recording medium conveying direction. The second pair of conveying rollers is disposed in a second position along the recording medium conveying path and conveys the recording medium with frictional force created at a nip position, the first position being upstream of the position in which the recording head is disposed and also of the second position with respect to the recording medium conveying direction. The distance between the first position and the second position is set shorter than the length of the recording medium. The conveyance controller controls the first and second pairs of conveying rollers. The conveyance controller controls the first and second pairs of conveying rollers to halt a conveying operation of the recording medium when a trailing edge of the recording medium has moved to or exceeded a position downstream from the nip position of the first pair of conveying rollers by a first prescribed distance during a first prescribed period of time running from a time instant when the trailing edge of the recording medium has passed through the nip position of the first pair of the conveying rollers.

In view of the foregoing, it is another object of the invention to provide the image forming device. The image forming device includes a recording head and a first pair of conveying rollers. The recording head forms images on a recording medium having a width and a length, the recording head being disposed in a position along a recording medium conveying path. The first pair of conveying rollers is disposed in a first position along the recording medium conveying path and conveys the recording medium with frictional force created at a nip position. The recording medium is conveyed while being oriented in a direction in which a lengthwise of the recording medium is in parallel with a recording medium conveying direction. The second pair of conveying rollers is disposed in a second position along the recording medium conveying path and conveys the recording medium with frictional force created at a nip position. The first position is upstream of the position in which the recording head is disposed and also of the second position with respect to the recording medium conveying direction. The distance between the first position and the second position is set shorter than the length of the recording medium. The conveyance controller controls the first and second pairs of conveying rollers. The conveyance controller controls the first and second pair of conveying rollers to halt a conveying operation of the recording medium when a leading edge of the recording medium has moved to or exceeded a position downstream from the nip position of the second pair of conveying rollers by a prescribed distance during a prescribed period of time running from a time instant when the trailing edge of the recording medium has passed through the nip position of the second pair of the conveying rollers.

In view of the foregoing, it is another object of the invention to provide a method. The method of controlling an image forming device including a recording head, a first pair of conveying rollers, and a second pair of conveying rollers. The recording head forms images on a recording medium having a width and a length. the recording head being disposed in a position along a recording medium conveying path. The first pair of conveying rollers is disposed in a first position along the recording medium conveying path and conveys the recording medium with frictional force created at a nip position. The recording medium is conveyed while being oriented in a direction in which lengthwise of the recording medium is in parallel with a recording medium conveying direction. The second pair of conveying rollers is disposed in a second position along the recording medium conveying path and conveys the recording medium with frictional force created at a nip position. The first position is upstream of the position in which the recording head is disposed and also of the second position with respect to the recording medium conveying direction. The distance between the first position and the second position is set shorter than the length of the recording medium. The method includes (a) controlling the first and second pairs of conveying rollers to halt a conveying operation of the recording medium when a trailing edge of the recording medium has moved to or exceeded a position downstream from the nip position of the first pair of conveying rollers by a first prescribed distance during a first prescribed period of time running from a time instant when the trailing edge of the recording medium has passed through the nip position of the first pair of the conveying rollers.

In view of the foregoing, it is another object of the invention to provide a method. The method of controlling an image forming device includes a recording head, a first pair of conveying rollers, and a second pair of conveying rollers.

The recording head forms images on a recording medium having a width and a length. The recording head is disposed in a position along a recording medium conveying path. The first pair of conveying rollers is disposed in a first position along the recording medium conveying path and conveys the recording medium with frictional force created at a nip position. The recording medium is conveyed while being oriented in a direction in which a lengthwise of the recording medium is in parallel with a recording medium conveying direction. The second pair of conveying rollers is disposed in a second position along the recording medium conveying path and conveys the recording medium with frictional force created at a nip position. The first position is upstream of the position in which the recording head is disposed and also of the second position with respect to the recording medium conveying direction. The distance between the first position and the second position is set shorter than the length of the recording medium. The method includes (a) controlling the first and second pair of conveying rollers to halt a conveying operation of the recording medium when a leading edge of the recording medium has moved to or exceeded a position downstream from the nip position of the second pair of conveying rollers by a prescribed distance during a prescribed period of time running from a time instant when the trailing edge of the recording medium has passed through the nip position of the second pair of the conveying rollers.

BRIEF DESCRIPTION OF THE DRAWINGS

Illustrative aspects in accordance with the invention will be described in detail with reference to the following figures wherein:

FIG. 5 is a flowchart illustrating steps in a page printing process;

FIG. 8 is a flowchart illustrating steps in a page printing process according to a second embodiment;

FIG. 17 is a flowchart illustrating steps in a page printing process according to a sixth embodiment;

FIGS. 20(*b*) and 20(*c*) are explanatory diagrams illustrating an operation for conveying the recording medium non-uniformly; and FIG. 20(*c*') is a partial enlarged view of FIG. 20(*c*).

DETAILED DESCRIPTION

Figure 1:
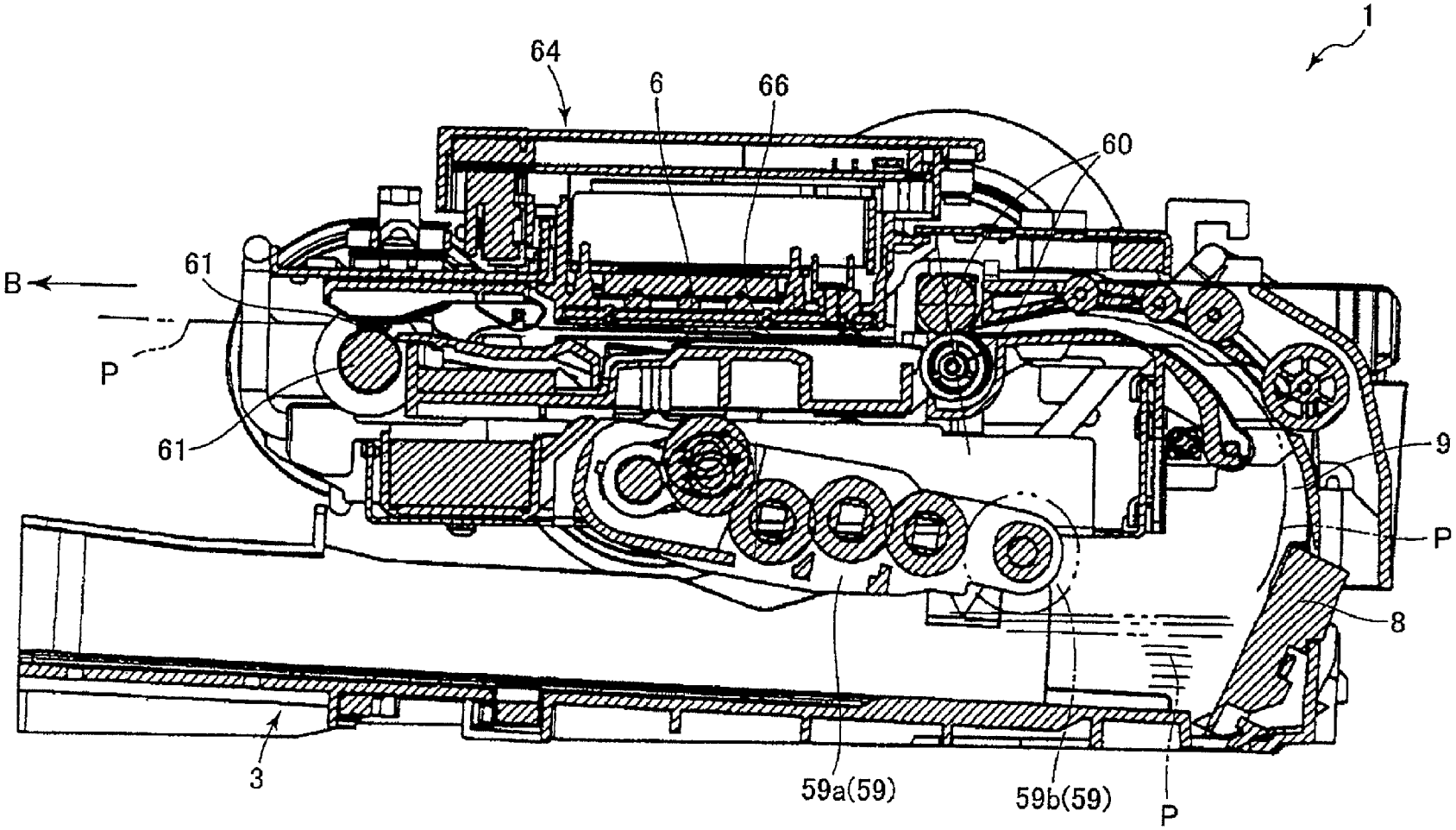
FIG. 1 is a cross-sectional view of a color inkjet printer according to a first embodiment of the present invention.

Next, preferred embodiments of the present invention will be described while referring to the accompanying drawings. FIG. 1 is a cross-sectional view of a color inkjet printer 1 serving as a first embodiment of the image-forming device according to the present invention. The printer 1 includes four ink cartridges filled with one of the ink colors cyan (C), magenta (M), yellow (Y), and black (Bk) and performs printing operations by ejecting ink supplied from these ink cartridges onto a recording medium (recording paper P). The printer 1 is configured to alternately execute a recording operation and a conveying operation for conveying the recording paper P.

The conveying operation for conveying the recording paper P is executed according to the non-uniform conveyance described above with reference to FIGS. 20(*b*) and 20(*c*), that is, with three small feeds and one large feed. In addition, the printer 1 is configured to avoid halting conveyance of the recording paper P at and directly after the trailing edge of the recording paper P passes a nip point in conveying rollers 60.

A personal computer 100 (see FIG. 4) is connected to the printer 1 as an external device. The printer 1 executes printing operations based on print data transmitted from the personal computer 100.

As shown in FIG. 1, a paper cassette 3 and a feeding unit 59 are provided on the bottom of the printer 1. The paper cassette 3 is capable of accommodating a plurality of stacked sheets of recording paper P cut to A4 size, letter size, postcard size, or the like such that the shorter edges of the recording paper P are aligned with a main scanning direction (orthogonal to a paper-conveying direction and the surface of the drawing in FIG. 1).

The feeding unit 59 functions to convey the recording paper P stacked in the paper cassette 3 toward an inkjet head 6. The feeding unit 59 includes an arm 59*a* disposed above the paper cassette 3, and a pickup roller 59*b* rotatably provided on a distal end of the arm 59*a*. The arm 59*a* is capable of rotating about an end opposite the distal end so that the distal end moves up and down. The pickup roller 59*b* is connected to a linefeed motor 40 (see FIG. 4) via a transmission mechanism including gears and the like (not shown). A drive force from the linefeed motor 40 drives the pickup roller 59*b* to rotate counterclockwise in FIG. 1 for conveying the recording paper P in the paper-conveying direction. When a request has been made for a printing operation, the arm 59*a* is pivoted downward until the pickup roller 59*b* contacts the recording paper P stacked in the paper cassette 3. When driven in the paper-conveying direction, the pickup roller 59*b* conveys the recording paper P from the paper cassette 3 downstream in the paper-conveying direction.

A sloped separating plate 8 for separating sheets of the recording paper P is disposed in the rear side of the paper cassette 3 (right side in FIG. 1). The separating plate 8 separates sheets of the recording paper P fed from the paper cassette 3 so that the sheets are conveyed one at a time. The separated sheets of recording paper P are conveyed along a U-shaped path 9 to the pair of conveying rollers 60 disposed above (at a higher position than) the paper cassette 3.

Downstream of the conveying roller 60, the printer 1 includes the inkjet head 6, a carriage 64 on which the inkjet head 6 is supported, and a platen 66 disposed in opposition to the inkjet head 6. Discharge rollers 61 are disposed farther downstream of the inkjet head 6 for pinching and conveying the recording paper P after the recording paper P passes over the surface of the platen 66 opposing the inkjet head 6. The conveying rollers 60 and discharge rollers 61 convey the recording paper P in a subscanning direction indicated by the arrow B in FIG. 1 so that after passing under the inkjet head 6 the recording paper P is discharged from the printer 1 through a discharge hole.

The printer 1 also accommodates a carriage shaft extending in the main scanning direction parallel to the platen 66 for achieving reciprocating movement of the carriage 64, a guide member disposed parallel to the carriage shaft, two pulleys provided on either end of the carriage shaft, and a timing belt looped around the pulleys. A carriage motor 16 (see FIG. 4) is provided for rotating one of the pulleys forward or in reverse, at which time the carriage 64 engaged with the timing belt reciprocates in the main scanning direction along with the forward rotation or reverse rotation of the pulley, moving over the carriage shaft and the guide member.

A linear encoder 43 (see FIG. 4) for detecting the position of the carriage 64 has an encoder strip that extends in the main scanning direction. The linear encoder 43 detects the current position of the carriage.

Although not shown in the drawings, the printer 1 also includes ink cartridges accommodating ink of four colors (black, cyan, magenta, and yellow) for recording full color images, a plurality of ink tubes for supplying ink from the ink cartridges to the inkjet head 6, a flushing unit for regularly flushing ink from the nozzles during a recording operation to prevent the nozzle holes from becoming obstructed, and a maintenance unit for cleaning the nozzle surface of the inkjet head 6, performing a recovery process to remove air bubbles from a buffer tank (not shown) above the inkjet head 6.

Figure 2:
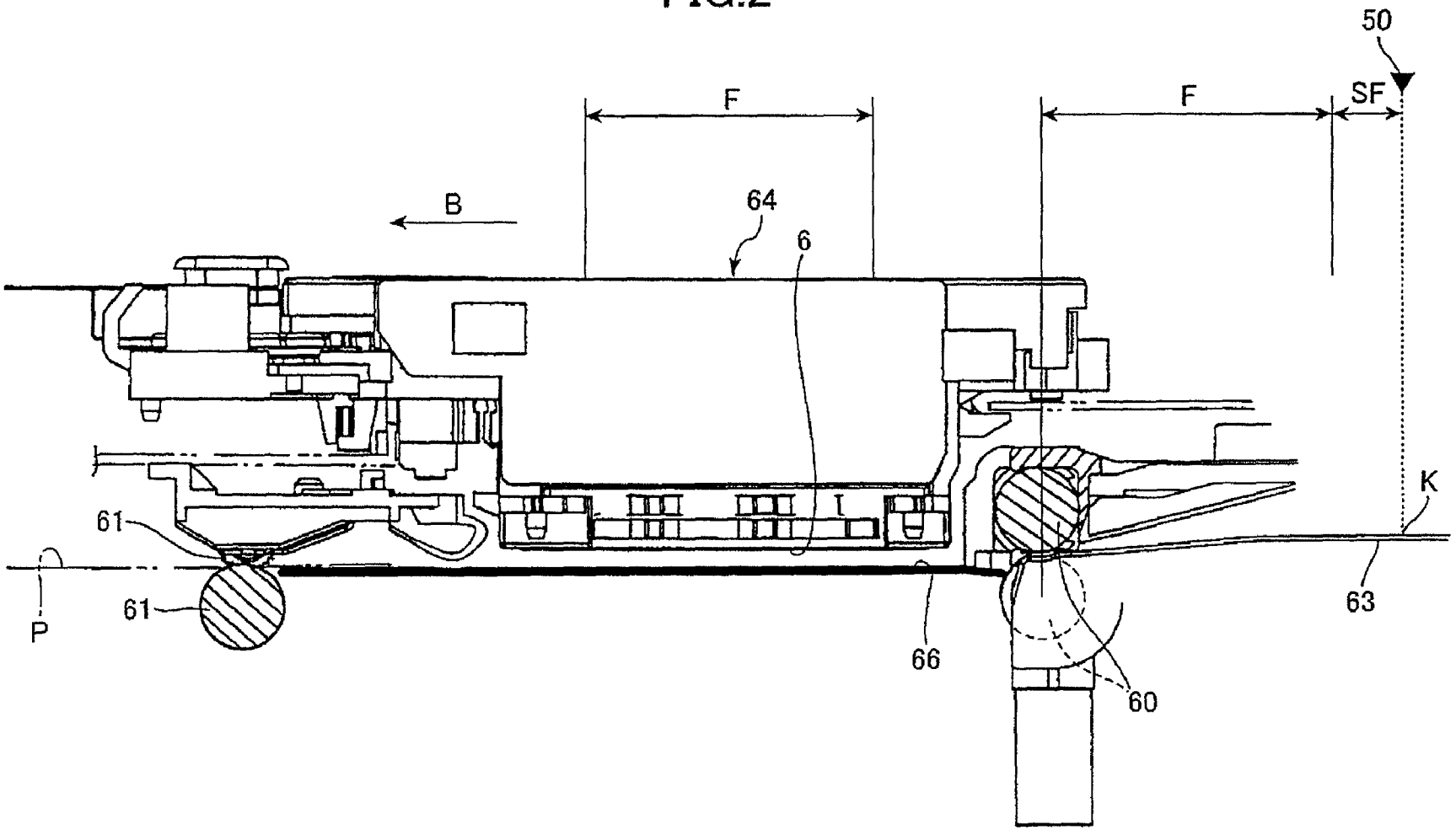
FIG. 2 is a side cross-sectional view showing the structure of the printer near an inkjet head.

FIG. 2 is a side cross-sectional view showing the region of the printer 1 near the inkjet head 6. The conveying rollers 60 disposed upstream of the inkjet head 6 are configured of a pair of upper and lower roller members that pinch and convey the recording paper P through a nip force. The conveying roller 60 is connected to the linefeed motor 40 through a transmission mechanism having gears (not shown). A drive force generated by the linefeed motor 40 rotates the conveying rollers 60 in the paper-conveying direction (clockwise for the upper roller and counterclockwise for the lower roller) for conveying the recording paper P downstream in the paper-conveying direction. In the preferred embodiment, the lower roller in the pair of conveying rollers 60 is a drive roller driven by the linefeed motor 40, while the upper roller is a follow roller that rotates along with the drive roller.

When rotated in the paper-conveying direction, the conveying rollers 60 convey the recording paper P along the bottom surface of the inkjet head 6 and above the platen 66 provided downstream of the conveying roller 60 in the paper-conveying direction indicated by the arrow B.

The conveying rollers 60 are capable of rotating in forward and reverse directions. The conveying rollers 60 are rotated in reverse (the direction opposite the paper-conveying direction) while the feeding unit 59 feeds a sheet of the recording paper P. Upon arriving at the conveying rollers 60, the sheet of recording paper P is halted just in front of the nip point between the conveying rollers 60 until the feeding unit 59 stops conveying the recording paper P. The reverse rotation of the conveying rollers 60 aligns the leading edge of the recording paper P along the main scanning direction.

The discharge rollers 61 are disposed downstream of the conveying rollers 60 so that the inkjet head 6 is interposed therebetween. The discharge rollers 61 include a pair of upper and lower roller members for pinching and conveying the sheet of recording paper P after the recording paper P has passed beneath the opposing surface of the inkjet head 6.

The upper roller in the discharge rollers 61 is a spur roller, which is a roller formed with bumps on the outer surface. This upper roller contacts the printed surface of the recording paper P. Since ink on the printed surface of the recording paper P is not dry immediately after printing, a roller with a large contact area could easily blur or deform the image or retransfer the ink, degrading the print quality. Using a spur roller as the roller contacting the printed surface of the recording paper P reduces the area of contact with the printed surface, preventing a decline in print quality.

The discharge roller 61 is also connected to the linefeed motor 40 via a transmission mechanism including gears (not shown). When driven by the linefeed motor 40, the discharge rollers 61 rotate in the paper-conveying direction (i.e., the spur roller rotates clockwise and the lower roller counterclockwise in FIG. 2) for conveying the recording paper P downstream. In the preferred embodiment, the lower roller among the discharge rollers 61 is the drive roller that receives a driving force from the linefeed motor 40, and the upper spur roller is a follow roller that rotates along with the rotation of the drive roller.

After being conveyed to the conveying rollers 60, the recording paper P is conveyed along the bottom surface of the inkjet head 6 by the conveying rollers 60 alone. After the leading edge of the recording paper P is subsequently conveyed to and interposed between the discharge rollers 61, the recording paper P is conveyed by both the conveying rollers 60 and the discharge rollers 61. Later, the trailing edge of the recording paper P passes through the nip point of the conveying rollers 60, at which time the recording paper P is conveyed by the discharge rollers 61 alone.

Here, the nip force at which the conveying rollers 60 pinch the recording paper P is set larger than the nip force at which the discharge rollers 61 pinch the recording paper P. Therefore, the recording paper P is conveyed at the circumferential velocity of the conveying rollers 60 as long as the recording paper P is interposed between the conveying rollers 60, that is, until the trailing edge of the recording paper P passes through the nip point between the conveying rollers 60. Hence, the conveying velocity of the recording paper P is equal to the circumferential velocity of the conveying rollers 60.

However, after the trailing edge of the recording paper P passes through the nip point of the conveying rollers 60, the recording paper P is conveyed according to the circumferential velocity of the discharge rollers 61. At this time, the conveying velocity of the recording paper P is equivalent to the circumferential velocity of the discharge rollers 61.

In the preferred embodiment, the circumferential velocity of the discharge rollers 61 is designed to be greater than that of the conveying rollers 60. Therefore, when the recording paper P is being conveyed by both the conveying rollers 60 and the discharge rollers 61, the discharge rollers 61 slide over the recording paper P and apply tension thereto.

When the trailing edge of the recording paper P passes through the nip point between the conveying rollers 60, the recording paper P is released from the nip force applied by the conveying rollers 60 and, as a result, is conveyed downstream in excess of the prescribed conveying amount (a forward jump). This forward jump, or conveyance of the recording paper P farther than the prescribed conveying amount, results from the recording paper P arriving at a downstream position faster than the normal timing.

However, the conveying distance of the recording paper P is controlled by the drive amount of the linefeed motor 40 (the amount that a drive gear on the linefeed motor 40 side rotates). The forward jump described above occurs when the recording paper P is conveyed an excessive amount equivalent to an amount of play in the teeth of a gear on the conveying roller 60 side engaged with the drive gear. Since the drive gear on the linefeed motor 40 side is rotated to the correct position at the correct timing regardless of any forward jump, the amount of forward jump generated is absorbed when the drive gear reaches the correct position. In other words, this forward jump merely results in a common conveying irregularity, but ultimately the recording paper P is conveyed the proper conveying distance when the drive gear has rotated to the proper position. Hence, the recording paper P is properly positioned at this time.

A sensor 50 for detecting the trailing edge of the recording paper P is disposed on the upstream side of the conveying roller 60. The sensor 50 is a common photo sensor having a light-emitting element configured of a light-emitting diode, and a light-receiving element configured of an optical sensor. The light-emitting element of the sensor 50 irradiates light toward a detecting position K on a guide plate 63 that forms part of the conveying path for the recording paper P, and the light-receiving element receives light reflected from this detecting position K.

The detecting position K is positioned upstream of the nip point between the conveying rollers 60 by a distance of at least the sum of the total small feed conveying distance SF (SF1+SF2+SF3) and a conveying distance F for one interlace cycle that includes the three small feeds (SF) and one large feed (LF). The sensor 50 is disposed in a position for detecting the presence of the recording paper P at the detecting position K. In the preferred embodiment, the detecting position K is positioned upstream of the nip point by the distance SF+F. In the first embodiment, the conveying distances SF1-SF3, SF, LF, and F are predetermined theoretical distances at which the recording paper P is conveyed in a normal recording operation.

A prescribed region of the guide plate 63 that includes the detecting position K is configured of a color having a different reflectance from the recording paper P, such as black. Since the light-receiving element receives light reflected off the guide plate 63 having a low reflectance when the recording paper P is not present, the detection value (AD value) outputted from the sensor 50 is low (a value indicating no paper). However, when the recording paper P is present at the detecting position K, the light-receiving element receives light reflected from the recording paper P having a high reflectance and, hence, the detection value outputted from the sensor 50 is high (a value indicating the presence of paper). Therefore, the printer 1 of the preferred embodiment can detect the presence of the recording paper P (and, hence, the trailing edge of the recording paper P) based on the difference in amount of reflected light that the sensor 50 receives)

The values of the large feed conveying distance LF and the total small feed conveying distance SF vary according to the requested recording density. Therefore, while not shown in the drawings, a sensor 50 is provided to support each of the recording densities that the printer 1 can produce, such as 300 dpi, 600 dpi, and 1200 dpi.

In the preferred embodiment, the printer 1 modifies the conveying distance of the recording paper P after the sensor 50 corresponding to the requested recording density detects the trailing edge of the recording paper P passing the detecting position K and before the trailing edge of the recording paper P reaches the nip point between the conveying rollers 60. The conveying distance is modified so that a large feed (conveying distance LF) is executed as the trailing edge of the recording paper P passes through the nip point of the conveying rollers 60 and adjusts the position of the recording paper P at the beginning of an operation to convey the recording paper P through the nip point so that the trailing edge of the recording paper P reaches at least a prescribed point on the downstream side of the nip point when conveying is halted. In other words, the recording paper P pass through the nip point between the conveying rollers 60 and is halt after a prescribed time is passed.

In this way, the printer 1 can halt conveying of the recording paper P when the trailing edge of the recording paper P is sufficiently separated from the nip point, rather than when the trailing edge of the recording paper P is positioned at or directly downstream of the nip point.

As described above, the recording paper P tends to jump forward when released from the pinching of the conveying roller 60, producing a common conveying irregularity. If the conveying of the recording paper P is halted immediately during this state, then the recording paper P will be halted during a conveying irregularity so that recording cannot be performed at the correct position on the recording paper P.

However, the printer 1 of the preferred embodiment avoids recording during the occurrence of this type of conveying irregularity (during a state of poor conveying precision) by executing a control process to halt conveying of the recording paper P when the trailing edge of the recording paper P is sufficiently separated from the nip point (that is, when the drive gear is driven to rotate a sufficient amount for canceling the forward jump so that the recording paper P has been conveyed the correct conveying distance). As a result, recording executed after the conveyance is halted is performed when the recording paper P is in the correct position. Consequently, image quality can be improved. This process for controlling conveyance will be described later with reference to the flowcharts in FIGS. 5 and 6.

Figure 3:
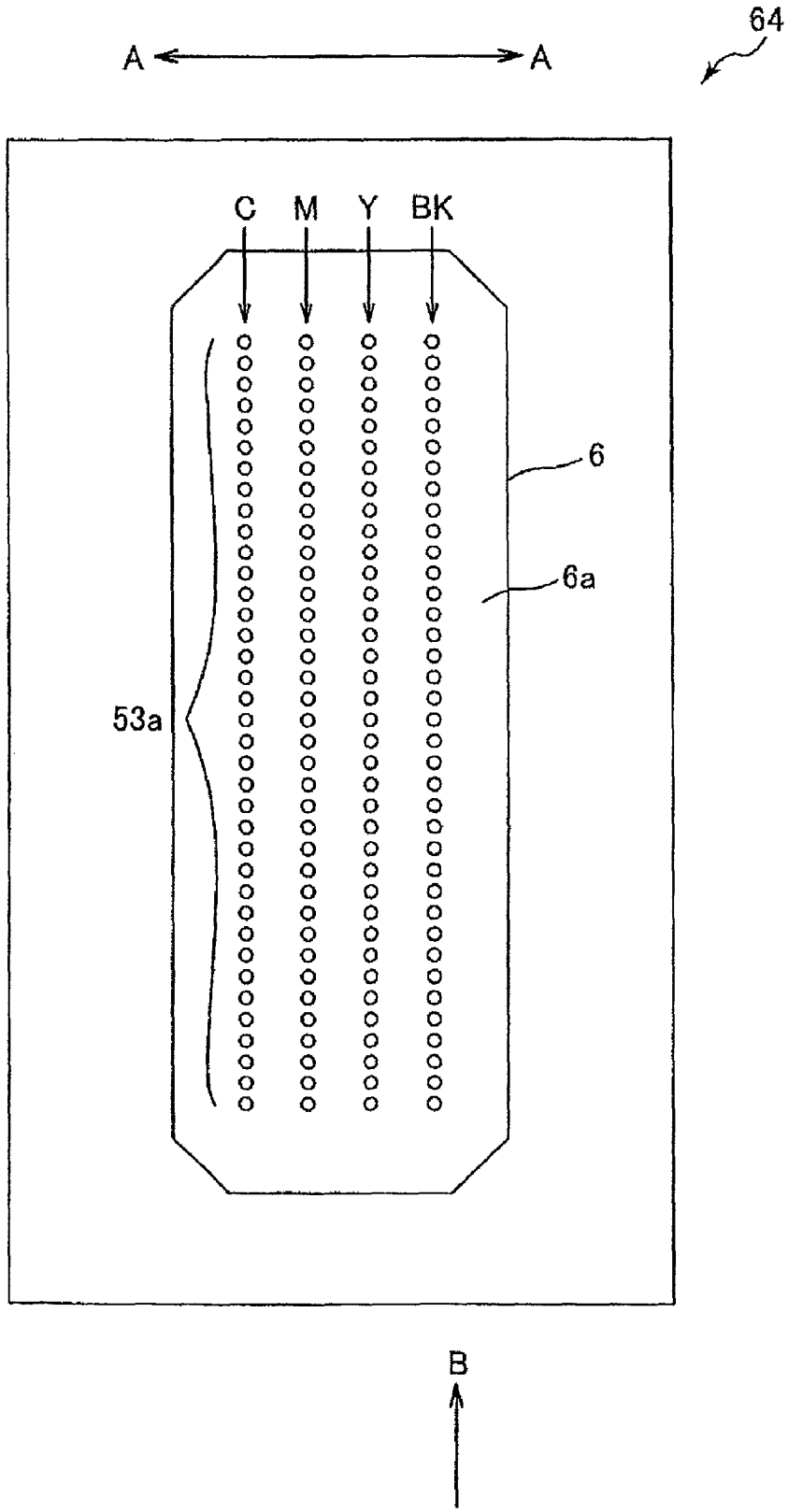
FIG. 3 is an explanatory diagram showing the bottom surface of a carriage.

FIG. 3 is conceptual diagram showing a bottom surface 6*a* of the inkjet head 6, which is the surface opposing the recording paper P. As shown in FIG. 3, rows of nozzles 53*a* are formed in the bottom surface 6*a* of the inkjet head 6, with one row for each of the ink colors cyan (C), magenta (M), yellow (Y) and black (Bk). The rows are aligned along the paper-conveying direction B, which is the subscanning direction. The number and pitch of nozzles 53*a* in each row is set appropriately according to the resolution of the recorded image and the like. The number of rows of nozzles 53*a* can also be increased to match an increase in the number of ink colors.

In the preferred embodiment, a total of 148 nozzles are formed in the inkjet head 6. The nozzles are assigned numbers from nozzle No. 00 to nozzle No. 147 in order along the subscanning direction. The nozzles are formed at a pitch of 1/150 inch since the gap (pitch) between dots varies according to the recording density, the nozzle pitch and dot pitch are not always equal.

Here, one interlace cycle cannot exceed the length of the inkjet head 6, which is equivalent to the distance from the first nozzle to the last nozzle in the conveying direction. In the preferred embodiment, the conveying distance equivalent to the distance from the first nozzle (nozzle No. 00) to the last nozzle (nozzle No. 147) is the conveying distance F for one interlace cycle in the normal recording operation described above. In other words, the conveying distance F is the maximum range in which the inkjet head 6 can record.

Figure 20A:
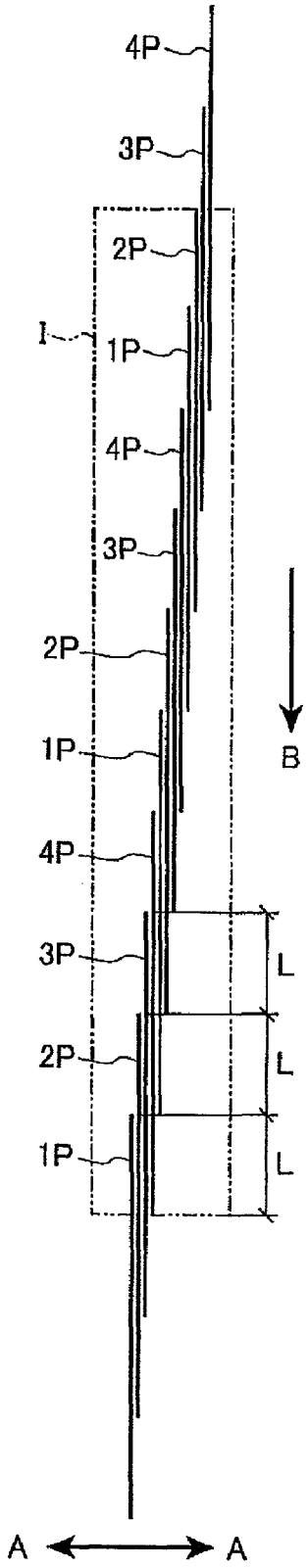
FIG. 20(*a*) is an explanatory diagram illustrating an operation for conveying a recording medium uniformly.
Figure 20B:
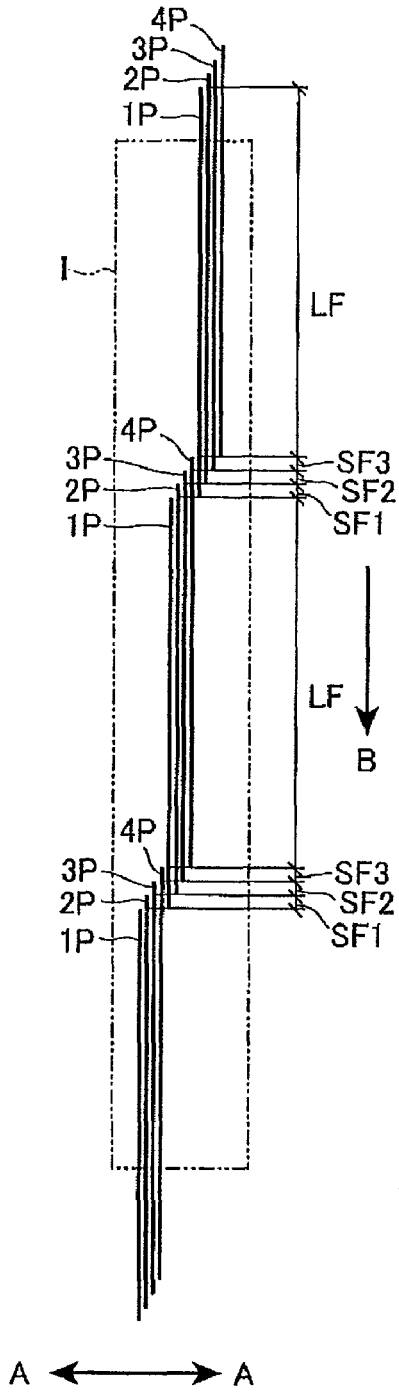
Figure 20C:
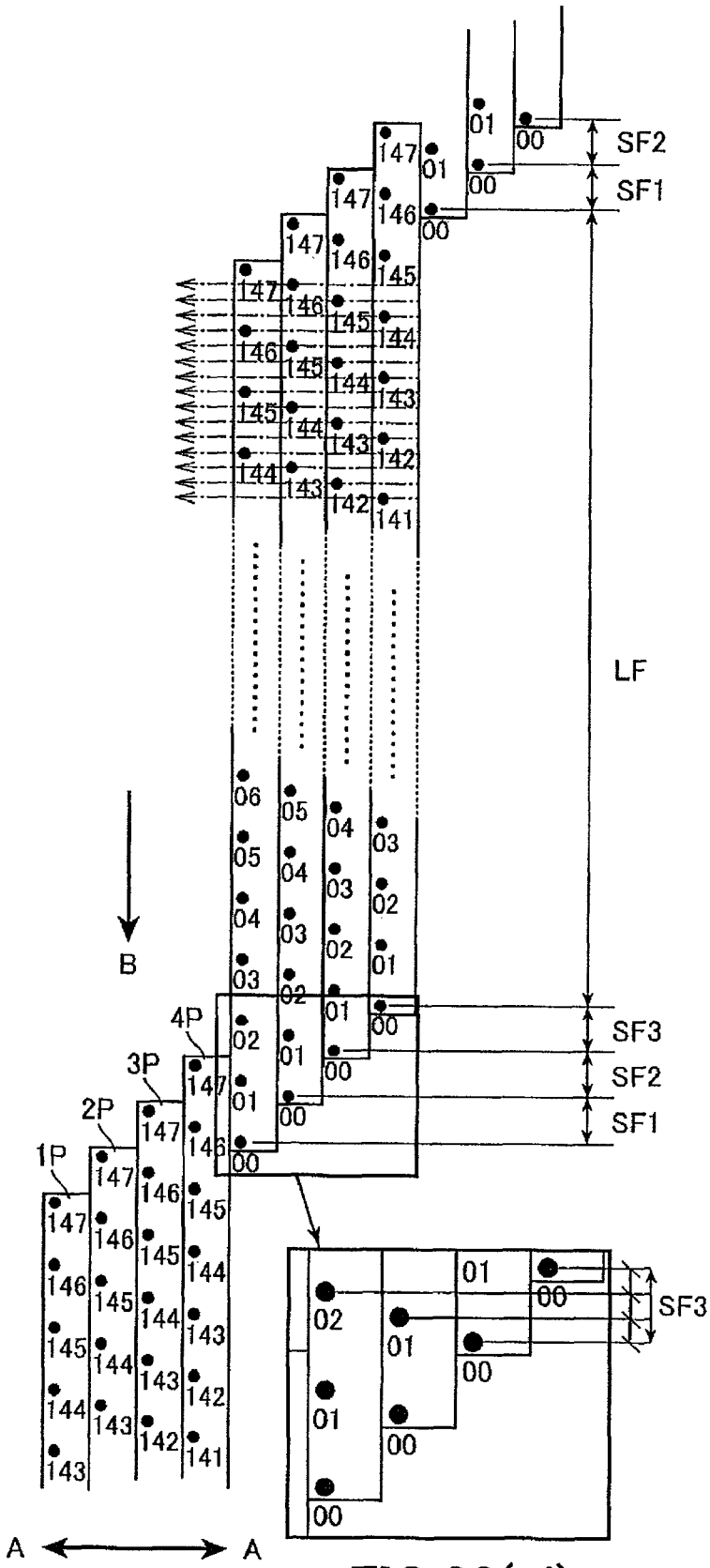

Since the inkjet head 6 is formed as described above, a normal recording operation with a 1/600 inch dot pitch is performed as described in FIGS. 20(*b*) and 20(*c*) to achieve 600 dpi resolution. Specifically, a four pass printing operation is performed with the conveying distances SF1, SF2, and SF3 for the three small feeds performed after printing the first pass are set equivalent to three pitches, while the conveying distance LF for the large feed performed after printing the fourth pass is set equivalent to 583 pitches.

Figure 4:
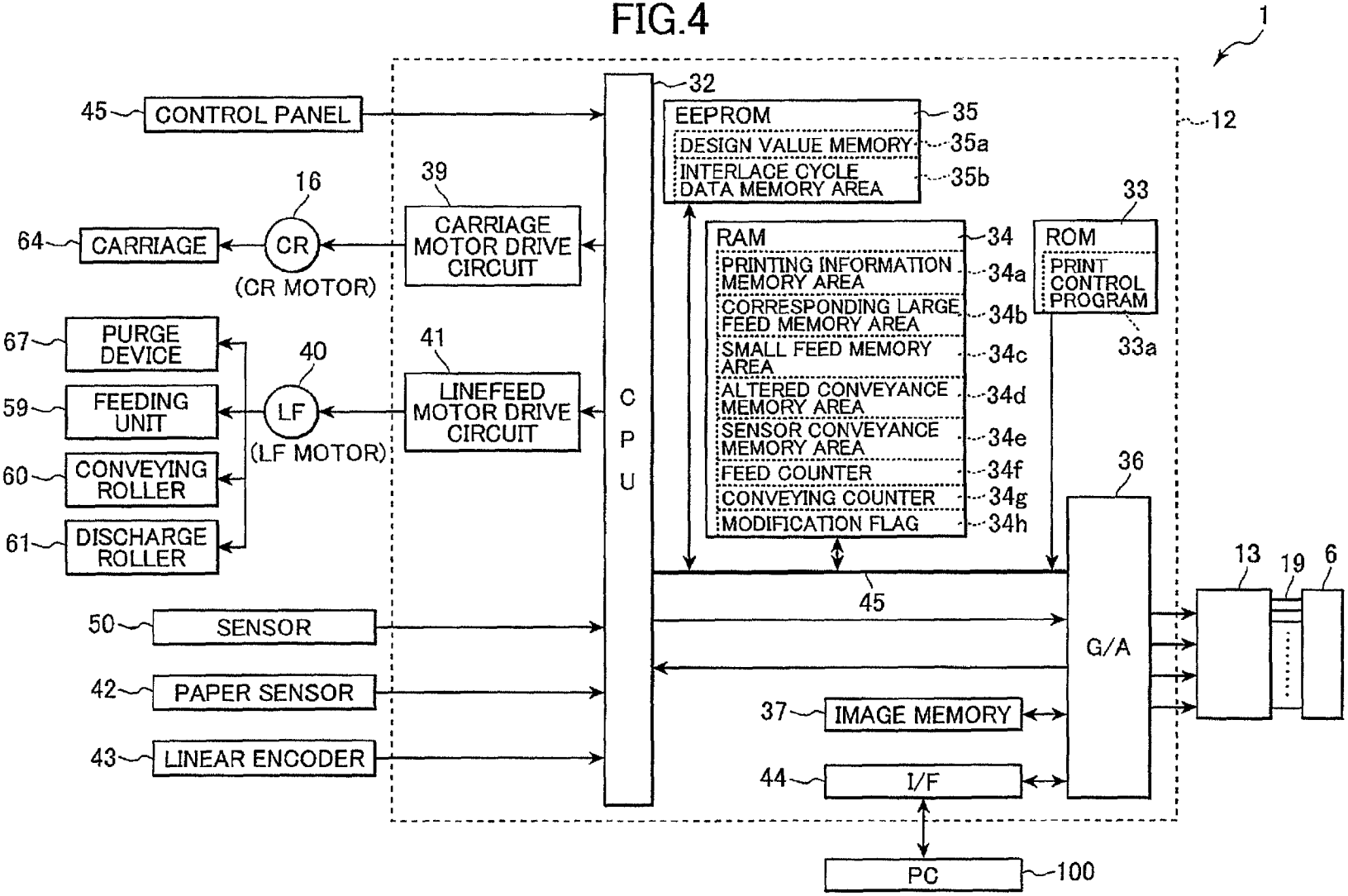
FIG. 4 is a block diagram showing the electrical circuit structure of the color inkjet printer.

FIG. 4 is a block diagram showing the general structure of an electric circuit in the printer 1. A controller for controlling the printer 1 is configured of a control circuit board 12 provided in the body of the printer 1, and a carriage circuit board 13. Mounted on the control circuit board 12 are a single-chip microcomputer (CPU) 32, a ROM 33 storing various control programs executed by the CPU 32 and fixed values, a RAM 34 for temporarily storing various data, and EEPROM 35, an image memory 37, and a gate array 36.

The CPU 32 generates a print timing signal and a reset signal according to the control program stored in the ROM 33 and transfers these signals to the gate array 36 described below. The CPU 32 is connected to a control panel 45 via which the user can input a print command and the like, a carriage motor drive circuit 39 for driving the carriage motor 16 used to operate the carriage 64, a linefeed motor drive circuit 41 used to activate the linefeed motor 40 for driving the conveying roller 60 and the like, a paper sensor 42, the linear encoder 43, and the sensor 50. The CPU 32 controls the operations of each device connected thereto.

The paper sensor 42 is disposed upstream of the conveying rollers 60 and functions to detect the leading edge of the recording paper P. As an example, the paper sensor 42 may be configured of a probe that rotates when contacted by the recording paper P, and a photointerrupter for detecting rotation of the probe. The conveying distance from the paper sensor 42 to the inkjet head 6 (specifically, a recording start point SP described later) is known because the paper sensor 42 is disposed in a fixed position and the position of the inkjet head 6 relative to the paper-conveying direction is fixed. Further, the distance in which the recording paper P has been conveyed can also be acquired by detecting a drive amount of the linefeed motor 40, which is driven to convey the recording paper P. Since the linefeed motor 40 is configured of a stepping motor, the drive amount of the linefeed motor 40 can be determined by counting pulse signals outputted to the linefeed motor drive circuit 41 from the CPU 32.

Therefore, the recording paper P can be fed to the recording start position SP by driving the linefeed motor 40 until the drive amount of the linefeed motor 40 after the paper sensor 42 detects the leading edge of the recording paper P reaches a pulse number equivalent to the distance from the detection position of the paper sensor 42 to the recording start position SP. The recording start position SP is the position at which the leading edge of the recording paper P is to be set for the start of a printing operation. A recording start length HS is a distance between the recording start position SP and the upstream edge of the inkjet head 6 (alternatively, from the position of the nozzle farthest upstream). In other words, the recording start length denotes the length of the recording paper's leading edge portion positioned on the downstream side, in subscanning direction, from the upstream edge of the inkjet head 6 when beginning a printing operation. Thus, the recording start position SP is decided as a point that is disposed downstream of the upstream edge of the inkjet head 6 by the recording start length HS.

The linear encoder 43 is configured of the encoder strip described above, which is interposed between a light-emitting element on one side and a light-receiving element on the other. The linear encoder 43 functions to detect the amount of movement of the carriage 64. The light-emitting element and light-receiving element are mounted on the carriage 64 at prescribed locations and move together with the carriage 64 as the carriage 64 reciprocates in the main scanning direction. The CPU 32 detects the position of the carriage 64 based on an encoder signal outputted from the light-receiving element of the linear encoder 43 and controls the reciprocating motion of the carriage 64 accordingly.

Figure 6:
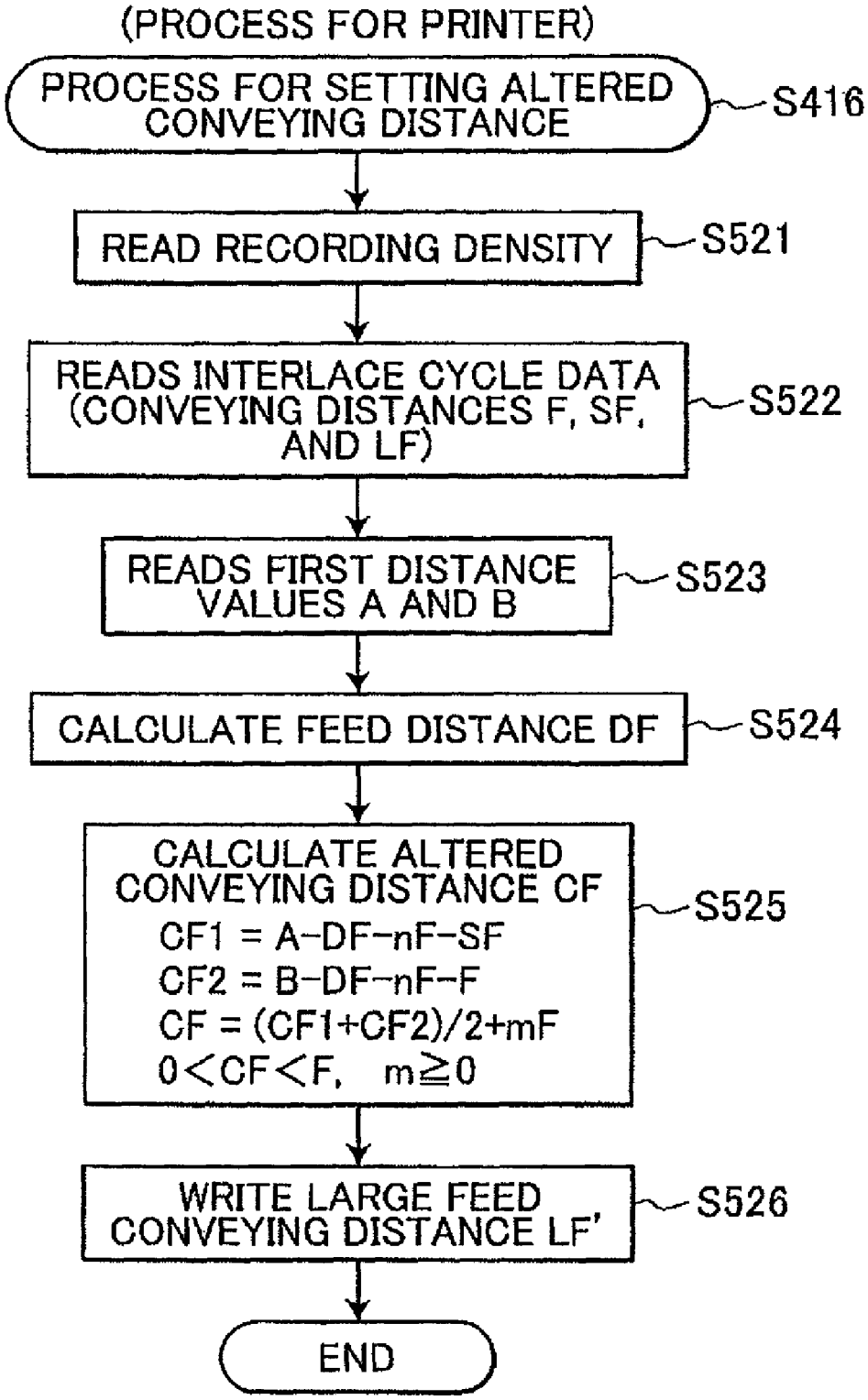
FIG. 6 is a flowchart illustrating steps in a process for setting altered conveying distances executed during the page printing process of FIG. 5.
Figure 7A:
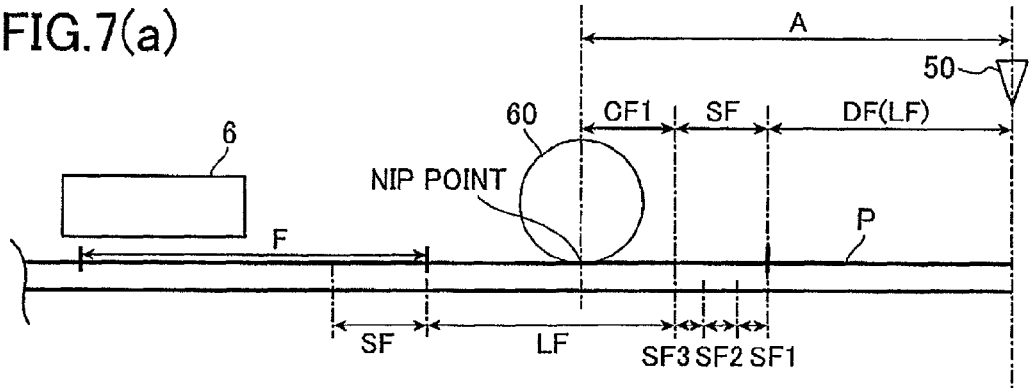
FIG. 7(*a*)-7(*d*) are explanatory diagrams conceptually illustrating the calculation of an altered conveying distance in the process for setting altered conveying distances of FIG. 6 and a conveying operation of recording paper in the page printing process of FIG. 5.
Figure 7B:
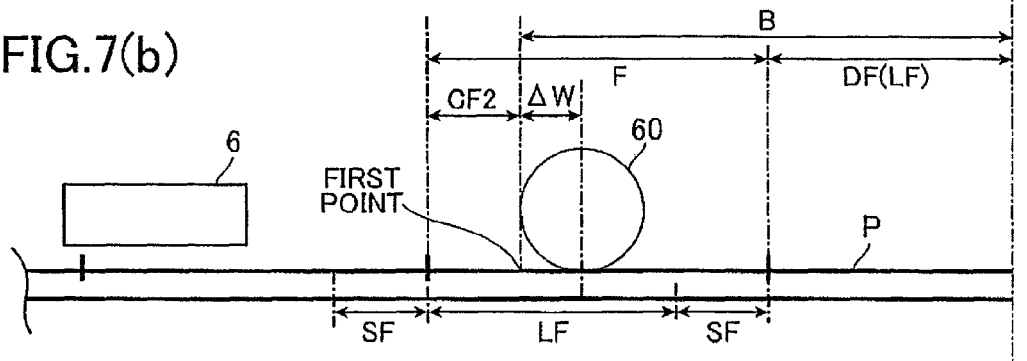
Figure 7C:
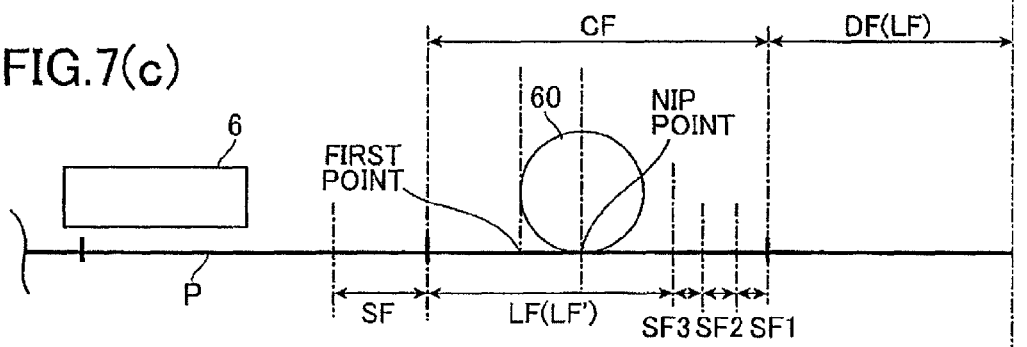
Figure 7D:
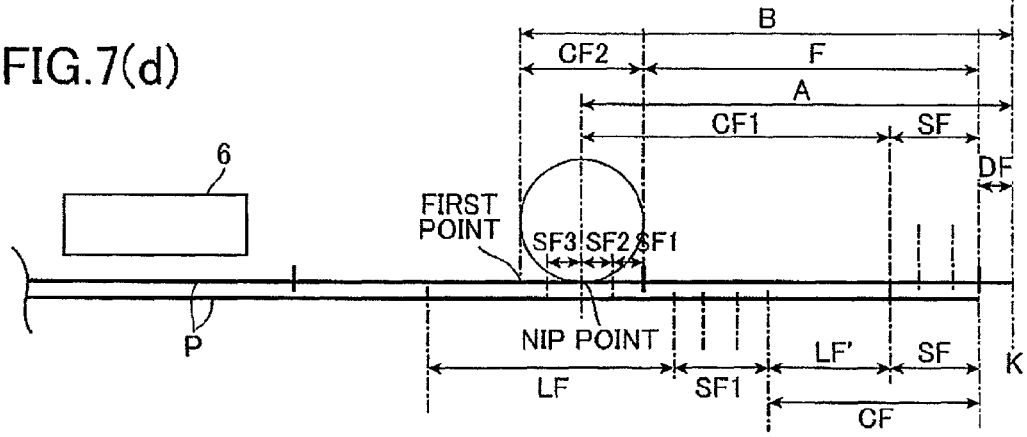

The ROM 33 stores a print control program 33*a* for controlling printing operations performed with the printer 1. A program for implementing the process described in the flowcharts of FIGS. 5 and 6 is stored in the ROM 33 as part of the print control program 33*a*.

The RAM 34 has a printing information memory area 34*a*, a large feed memory area 34*b*, a small feed memory area 34*c*, an altered conveyance memory area 34*d*, a sensor conveyance memory area 34*e*, a feed counter 34*f*, a conveying counter 34*g*, and a modification flag 34*h*.

The printing information memory area 34*a* stores printing information included in print data received from the personal computer 100. The print data transmitted from the personal computer 100 includes not only image data, but also printing information necessary for printing. The printing information includes information on the type and size of the recording paper P, the recording density, and the printing method, such as borderless printing or normal printing, and is generated by a printer driver installed on the personal computer 100, for example. Upon receiving print data from the personal computer 100, the printer 1 writes the printing information included in the print data to the printing information memory area 34*a*.

The large feed memory area 34*b* and small feed memory area 34*c* store theoretical conveying distances. The large feed memory area 34*b* stores the conveying distance LF, which is the theoretical conveying distance for a large feed in a normal recording operation. The small feed memory area 34*c* stores conveying distances SF1-SF3, which are the theoretical conveying distances for a small feed in a normal recording operation. Since the three small feeds performed in the preferred embodiment have the same conveying distance, the small feed memory area 34*c* may store a single conveying distance as a representative value.

The printer 1 according to the preferred embodiment is capable of printing at the recording densities 300 dpi, 600 dpi, and 1200 dpi. Since the theoretical conveying distances are determined primarily based on specifications of the inkjet head 6, such as the length of the inkjet head 6 and the nozzle number and pitch, and the recording density, the theoretical conveying distances vary according to different recording densities.

A design value memory 35*a* described later stores these theoretical conveying distances in association with recording densities. When executing a printing operation, the CPU 32 reads the large conveying distance LF and the small conveying distances SF1-SF3 corresponding to the requested recording density (the recording density stored in the printing information memory area 34*a*) from the design value memory 35*a* and stores these values in the respective large feed memory area 34*b* and small feed memory area 34*c*.

The altered conveyance memory area 34*d* functions to store an altered conveying distance CF. As described above, when the sensor 50 detects the trailing edge of the recording paper P passing the detecting position K, and before the trailing edge of the recording paper P reaches the nip point between the conveying rollers 60, an altered conveying operation is performed to convey the recording paper P a distance (the altered conveying distance CF) different from the theoretical conveying distance F for one interlace cycle in a normal recording operation.

The altered conveying distance CF is the conveying distance for one interlace cycle in the altered conveying operation and is calculated according to a process for setting the altered conveying distance described later in S416 of FIG. 6. By performing one interlace cycle using this altered conveying distance CF, it is possible to convey the recording paper P at a large feed of the conveying distance LF when the trailing edge of the recording paper P passes the nip point between the conveying rollers 60 and to halt the recording paper P when the trailing edge is positioned at least a prescribed distance from the nip point.

As with a normal conveying operation, the altered conveying operation in the preferred embodiment is executed with three small feeds and one large feed. This process is executed using the same conveying distances SF1-SF3 as the small feeds. Hence, only a large feed conveying distance LF' for the altered conveying operation is stored in the altered conveyance memory area 34*d*. The conveying distance LF' is found by subtracting the total small feed conveying distances SF from the altered conveying distance CF calculated in S416.

When the sensor 50 detects that the trailing edge of the recording paper P has passed the detecting position K, the CPU 32 executes a single large feed conveying operation at the conveying distance LF' stored in the altered conveyance memory area 34*d*. Hence, instead of being conveyed and halted in the expected position through a normal conveying operation, the recording paper P is conveyed by a large feed when the trailing edge passes the nip point between the conveying rollers 60 and is halted with the trailing edge separated at least a prescribed distance from the nip point.

The sensor conveyance memory area 34*e* stores the count value of the conveying counter 34*g* when the AD value of the sensor 50 changes from a value indicating the existence of paper to a value indicating no paper. The CPU 32 constantly monitors the AD value outputted from the sensor 50. When the AD value changes from a value indicating paper to a value indicating no paper, the CPU 32 reads the value stored in the conveying counter 34*g* and writes this value to the sensor conveyance memory area 34*e*.

Since the conveying counter 34*g* counts the drive amount of the linefeed motor 40 (conveying distance of the recording paper P), the sensor conveyance memory area 34*e* stores the conveying distance of the recording paper P when the trailing edge of the recording paper P reaches the sensor 50. In the preferred embodiment, the linefeed motor 40 is halted after completing a small feed or a large feed. Here, a delay occurs from the moment the sensor 50 detects the trailing edge of the recording paper P until conveying is halted, resulting in the recording paper P being conveyed farther downstream from the detecting position K of the sensor 50.

The CPU 32 references the value stored in the sensor conveyance memory area 34*e* at a timing at which conveying is halted immediately after the trailing edge of the recording paper P passes the sensor 50. The CPU 32 can determine a conveying distance DF after the trailing edge of the recording paper P passes the detecting position K by comparing the value in the conveying counter 34*g* to the value stored in the sensor conveyance memory area 34*e* at this timing.

The feed counter 34*f* is used to determine whether the recording paper P was conveyed at a small feed or a large feed. The count value of the feed counter 34*f* is incremented by 1 each time the recording paper P is conveyed by a small feed. The CPU 32 references the feed counter 34*f* during a printing operation and determines whether a small or large feed has been executed based on the counter value.

The conveying counter 34*g* functions to measure a conveying distance of the recording paper P. The conveying counter 34*g* is initially reset to 0 when the paper sensor 42 detects the leading edge of the recording paper P and thereafter is incremented by printer 1 each time the CPU 32 outputs a pulse signal to the linefeed motor drive circuit 41. Hence, the conveying distance of the recording paper P is determined by counting the number of pulses. The linefeed motor 40 rotates a prescribed amount (one step worth) in response to each pulse signal outputted from the CPU 32, causing the recording paper P to be conveyed a prescribed distance. Hence, the conveying distance of the recording paper P can be detected by counting the number of pulses.

The modification flag 34*h* indicates whether the recording paper P is to be conveyed based on the altered conveying distance CF. The modification flag 34*h* is set to ON when the altered conveying distance CF is calculated in the process of S416 described later. In other words, the modification flag 34*h* is set to ON to indicate the timing at which the recording paper P is to be conveyed at the altered conveying distance CF. In a page printing operation described later, the CPU 32 references the status of the modification flag 34*h* to determine the timing at which an altered conveying operation is to be executed. The CPU 32 executes the altered conveying operation when the modification flag 34*h* is ON. The modification flag 34*h* is reset to OFF after the CPU 32 executes an altered conveying operation at the altered conveying distance CF.

The altered conveyance memory area 34*d*, sensor conveyance memory area 34*e*, feed counter 34*f*, and modification flag 34*h* described above are all reset to 0 at the beginning of the page printing operation described later with reference to FIG. 5.

The EEPROM 35 is a rewritable, nonvolatile memory capable of saving stored data after the power to the printer 1 is turned off. The EEPROM 35 includes the design value memory 35*a* described above, and an interlace cycle data memory area 35*b*. The design value memory 35*a* stores design values for the structure of the printer 1 required for calculating the altered conveying distance CF, such as the recording start length HS and nozzle pitch described above, as well as a first distance values and the like.

The first distance values indicate the distance from the detecting position K of the sensor 50 to the conveying rollers 60. The first distance values are design values defined by the mechanical structure (specifications) of the printer 1, in other words, predetermined fixed values. In this example, the first distance values include a first distance value A and a first distance value B.

The first distance value A is the distance from the detecting position K to the nip point between the conveying rollers 60 (or the same distance plus a margin to account for mechanical tolerance) and is a data element used when calculating the altered conveying distance CF. In other words, it is essential to know the current position for the trailing edge of the recording paper P prior to the trailing edge reaching the nip point in order to ensure that the trailing edge of the recording paper P passes through the nip point with a large feed (conveying distance LF) without being halted at or directly downstream of the nip point because the trailing edge of the recording paper P must be positioned at a point upstream of the nip point between the conveying rollers 60, and from which point the CPU 32 can convey the recording paper P so that the trailing edge passes through the nip point during a large feed. As described above, the conveying distance DF after the trailing edge passes the detecting position K of the sensor 50 is found by comparing (finding the difference between) the value stored in the sensor conveyance memory area 34*e* with the count value of the conveying counter 34*g*. The current position for the trailing edge of the recording paper P that has passed the detecting position K can be found by subtracting this conveying distance DF from the first distance value A.

The first distance value B indicates the distance from the detecting position K to a first point downstream of the nip point between the conveying rollers 60 and, like the first distance value A, is an element used to calculate the altered conveying distance CF. The printer 1 according to the preferred embodiment avoids halting the recording paper P when the trailing edge of the recording paper P is not only at the nip point between the conveying rollers 60, but also directly downstream from this nip point. Therefore, the first distance value B is stored in the design value memory 35*a* for ensuring that the trailing edge of the recording paper P passing through the nip point is halted downstream of the first point. In the process for setting the altered conveying distance in S416, the CPU 32 reads the first distance values A and B from the design value memory 35*a* and uses these values as constants for calculating the altered conveying distance CF.

The interlace cycle data memory area 35*b* stores interlace cycle data in association with recording densities. The interlace cycle data includes data for each feed performed during one interlace cycle. Specifically, interlace cycle data includes the theoretical conveying distances for each small feed (the small feed conveying distances SF1-SF3), the total small feed conveying distance SF, the theoretical conveying distance of a large feed (large feed conveying distance LF), and the theoretical conveying distance for one interlace cycle (SF+LF). This interlace cycle data is stored in the interlace cycle data memory area 35*b* in advance as initial values.

The conveying distances SF1-SF3 and LF for each feed performed during an interlace cycle are values calculated primarily based on the specifications of the inkjet head 6 and the recording density. Hence, the theoretical conveying distances vary among different recording densities. Since one inkjet head 6 is normally provided in a single printer 1, the interlace cycle data includes data for each recording density.

The printer 1 according to the preferred embodiment is capable of printing at the recording densities 300 dpi, 600 dpi, and 1200 dpi. Accordingly, the interlace cycle data memory area 35*b* stores three sets of interlace cycle data corresponding to the three recording densities that are found based on the recording densities and the specifications of the inkjet head 6.

The CPU 32 described above is connected to the ROM 33, RAM 34, EEPROM 35, and gate array 36 described above via a bus line 46.

The gate array 36 outputs various signals based on a timing signal transferred from the CPU 32 and image data stored in the image memory 37, including recording data (drive signals) for recording the image data on the recording paper P, a transfer clock synchronized with the recording data, a latch signal, a parameter signal for generating a basic drive waveform signal, and an ejection timing signal outputted at a fixed period. These signals are transferred to the carriage circuit board 13 on which a head driver is mounted.

When an external device such as the personal computer 100 transfers image data to the gate array 36 via a USB or other interface 44, the gate array 36 stores the image data in the image memory 37. In response to data transferred from the personal computer 100 or the like via the interface 44, the gate array 36 generates a data reception interrupt signal and transfers this signal to the CPU 32. The signals are transferred between the gate array 36 and carriage circuit board 13 via a harness cable connecting the two.

The carriage circuit board 13 functions to drive the inkjet head 6 through the mounted head driver (drive circuit). The head driver is connected to the inkjet head 6 via a flexible circuit board 19 configured of a copper foil wiring pattern formed on a polyimide film having a thickness of 50-150 μm. The CPU 32 controls this head driver through the gate array 36 mounted on the control circuit board 12 to apply drive pulses of a waveform conforming to the recording mode to piezoelectric actuators in the inkjet head 6, thereby ejecting ink of a prescribed amount.

Next, a printing operation that includes a recording operation and a conveying operation and is executed by the printer 1 having the structure described above will be described with reference to FIGS. 5 through 7. FIG. 5 is a flowchart illustrating steps in a page printing process that the printer 1 executes based on the print control program 33*a*. The page printing process is executed to form an image on one sheet of recording paper P by repeatedly performing a recording operation for ejecting ink toward the recording paper P while the inkjet head 6 is reciprocated in the main scanning direction, and a conveying operation to convey the recording paper P in the subscanning direction.

The printer 1 executes the conveying operation in the page printing process using non-uniform conveyance similar to that described with reference to FIGS. 20(*b*) and 20(*c*). Specifically, the printer 1 conveys the recording paper P by repeating a series of conveying operations configured of three small feeds for conveying the recording paper P a first conveying distance in the subscanning direction, and a single large feed for conveying the recording paper P a second conveying distance greater than the first conveying distance after performing the small feeds.

The page printing process in FIG. 5 gives the steps performed after all print data has been received from the personal computer 100 connected to the printer 1 and after the printing information included with the received print data has been stored in the printing information memory area 34*a*.

The page printing process shown in FIG. 5 is initiated as soon as the reception of print data is complete. In S401 at the beginning of the process, the CPU 32 feeds a sheet of recording paper P until the leading edge of the recording paper P reaches the recording start position SP which is downstream of the upstream edge of the inkjet head by the recording start length HS stored in the design value memory 35*a*. More specifically, the CPU 32 drives the linefeed motor 40, which rotates the pickup roller 59*b*, and conveying roller 60 for conveying a sheet of the recording paper P accommodated in the paper cassette 3. Since the conveying distance from the position of the paper sensor 42 to the recording start length SP is known, as described above, the CPU 32 conveys the recording paper P until the value of the conveying counter 34*g* reaches a pulse number corresponding to this conveying distance.

In S402 the CPU 32 acquires the theoretical conveying distances by reading the large feed conveying distance LF and the small feed conveying distances SF1-SF3 corresponding to the recording density value stored in the printing information memory area 34*a* from the interlace cycle data memory area 35*b* and writes these distances in the corresponding large feed memory area 34*b* and small feed memory area 34*c*. In S403 the CPU 32 executes a main scan printing process for printing one pass, that is, for printing one linefeed width or one band.

After printing one pass worth in the main scan printing process of S403, the CPU 32 determines in S405 whether the value of the feed counter 34*f* is less than 3 in order to determine whether to select a small feed or a large feed for conveying the recording paper P. If the value of the feed counter 34*f* is less than 3 (S405: YES), indicating a timing for conveying the recording paper P with a small feed, in S406 the CPU 32 drives the linefeed motor 40 for conveying the recording paper P by the small feed conveying distance SF1-SF3 stored in the small feed memory area 34*c*. Hence, the CPU 32 drives the conveying roller 60 through the linefeed motor 40 in order to convey the recording paper P by a small conveying distance. The linefeed motor 40 is halted after completing the small feed.

In S407 the CPU 32 increments the feed counter 34*f* by 1. Accordingly, a counter value of 1 for the feed counter 34*f* indicates that the first small feed has been completed, a counter value of 2 indicates that the second small feed has been completed, and a counter value of paper cassette 3 indicates that the third small feed has been completed.

In S408 the CPU 32 determines whether printing is complete for one page. If printing of the current page has been completed (S408: YES), then in S409 the CPU 32 discharges the recording paper P and ends the process.

However, if the CPU 32 determines in S405 that the value of the feed counter 34*f* is not less than 3 (S405: NO), indicating that the third small feed has been completed and, a large feed should be performed next, in S410 the CPU 32 determines whether the modification flag 34*h* has been set to ON.

If the modification flag 34*h* is off (S410: NO), then the trailing edge of the recording paper P is on the upstream side of the sensor 50 and the altered conveying distance CF has not yet been calculated, or else the altered conveying operation has already been completed. In other words, it is not time to perform a large feed based on the altered conveying distance CF. Therefore, in S411 the CPU drives the linefeed motor 40 to convey the recording paper P by the large feed conveying distance stored in the large feed memory area 34*b*. The linefeed motor 40 is halted after the recording paper P has been conveyed the large conveying distance. Subsequently, in S412 the CPU 32 resets the feed counter 34*f* to 0 and advances to S408. By resetting the feed counter 34*f* to 0 at this time, the recording paper P can be again conveyed at small feeds when continuing the page printing operation.

By repeating the process from S403 to S412, the printer 1 of the preferred embodiment alternately executes the main scan printing process of S403 and the conveying process for conveying the recording paper P, the conveying process being configured of the three small feeds and one large feed. As described in the example shown in FIG. 20(*b*), the printer 1 conveys the recording paper P by the small feed conveying distances SF1-SF3 after forming each of the images 1P-3P and conveys the recording paper P by the large feed conveying distance LF after forming the image 4P.

Further, if the CPU 32 determines in S410 that the modification flag 34*h* is on (S410: YES), then the trailing edge of the recording paper P has already passed the detecting position K of the sensor 50 and, hence, it is time to execute a conveying operation based on the altered conveying distance CF. Accordingly, in S413 the CPU 32 drives the linefeed motor 40 to convey the recording paper the conveying distance stored in the altered conveyance memory area 34*d*, which is the large feed conveying distance LF' for an altered conveying operation. The linefeed motor 40 is halted after the recording paper P has been conveyed the distance stored in the altered conveyance memory area 34*d*. In S414 the CPU 32 sets the modification flag 34*h* to OFF and advances to S412.

When the modification flag 34*h* is in the ON state immediately after completing an altered conveying operation, the CPU 32 performs recording in the main scan printing process of S403 with usable nozzles in a range corresponding to the large feed conveying distance LF' of the altered conveying operation.

Further, if the CPU 32 determines in S408 that printing has not been completed for the current page (S408: NO), then in S415 the CPU 32 determines whether the detection value from the sensor 50 has changed from a value indicating the presence of paper to a value indicating no paper. In other words, the CPU 32 determines whether the AD detection value, which indicated the presence of paper prior to the feeding operation, indicates no paper after the feeding operation. If the detection value outputted from the sensor 50 has changed from a value indicating the presence of paper to a value indicating no paper (S415: YES), then in S416 the CPU 32 executes the process for setting the altered conveying distance CF, in S417 sets the modification flag 34*h* to ON in order to indicate that it is time to execute an altered conveying operation, and returns to the main scan printing process of S403. However, if the detection value from the sensor 50 has not changed from a value indicating the presence of paper to a value indicating no paper (S415: NO), indicating that the leading edge of the recording paper P has not yet passed through the detecting position K or that the altered conveying operation has already been completed, the CPU 32 skips the processes in S416 and S417 and returns to the main scan printing process of S403.

By detecting the trailing edge of the recording paper P at the detecting position K in the preferred embodiment, the printer 1 can determine a position of the recording paper P when the trailing edge of the recording paper P starts to be fed from the upstream to the downstream of the nip point between the conveying rollers 60. Therefore, the position of the trailing edge can be adjusted by adjusting the conveying distance so that the trailing edge of the recording paper P passes through the nip point in a large feed conveying distance LF and is conveyed at least a prescribed distance downstream from the nip point.

Further, since the printer 1 can learn the current position for the trailing edge of the recording paper P when the trailing edge passes the detecting position K, the printer 1 can always convey the recording paper P as described above so that the trailing edge passes through the nip point of the conveying rollers 60 with a large feed, even if the size of the paper loaded in the device is unknown or if the user settings are incorrect.

FIG. 6 is a flowchart illustrating steps in the process for setting the altered conveying distance of S416 executed during the page printing process of FIG. 5. In the process for setting the altered conveying distance of S416, the printer 1 calculates the altered conveying distance CF for conveying the recording paper P positioned within a prescribed range at the start of an interlace cycle that will feed the recording paper P so that the trailing edge of the recording paper P passes through the nip point between the conveying rollers 60.

In the preferred embodiment, the printer 1 conveys the recording paper P with a large feed so that the trailing edge of the recording paper P passes through the nip point of the conveying roller 60 and so that the trailing edge of the recording paper P is halted downstream of the first point after passing through the nip point. In order to achieve this, the trailing edge of the recording paper P must be positioned within a prescribed range upstream of the nip point between the conveying rollers 60 at the start of the interlace cycle in which the trailing edge passes through the nip point for the following three reasons.

First, since the conveying method according to the preferred embodiment repeatedly performs three small feeds followed by one large feed, if the trailing edge of the recording paper P is positioned upstream of the nip point between the conveying rollers 60 at a distance no greater than the total small feed conveying distance SF, then it is not possible to convey the recording paper P so that the trailing edge passes through the nip point in a large feed. Second, when executing a recording operation, the conveying distance F in one interlace cycle is a limiting value set to the maximum length of the inkjet head 6. Third, if the trailing edge of the recording paper P is positioned upstream from the first point by a distance greater than or equal to the conveying distance F, then the trailing edge of the recording paper P cannot reach the first point through the conveyance in an interlace cycle.

Accordingly, in S521 of the process for setting the altered conveying distance of S416, the CPU 32 reads the recording density stored in the printing information memory area 34*a* and in S522 reads the interlace cycle data (conveying distances F, SF, and LF) stored in the interlace cycle data memory area 35*b* in association with the recording density read in S521. Further, in S523 the CPU 32 reads the first distance values A and B from the design value memory 35*a*.

In S524 the CPU 32 calculates the feed distance DF that the trailing edge of the recording paper P has advanced from the detecting position K based on the difference between the value stored in the sensor conveyance memory area 34*e* and the value of the conveying counter 34*g*. The value of the conveying counter 34*g* is updated in a process executed independently of the page printing process. Further, the CPU 32 reads the value of the conveying counter 34*g* and writes the value to the sensor conveyance memory area 34*e* each time the detection value of the sensor 50 changes from a value indicating the presence of paper to a value indicating no paper.

In S525 the CPU 32 calculates the altered conveying distance CF according to the equations CF1=A−DF−NF−SF, CF2=B−DF−nF−F, and CF=(CF1+CF2)/2+mF, where 0<CF<F and m≧0. In S526 the CPU 32 writes the large feed conveying distance LF' found from the altered conveying distance CF calculated above (LF'=CF−SF) to the altered conveyance memory area 34*d* and ends the process of S416.

Here, the large feed conveying distance LF is set greater than B−A, which is the distance from the nip point to the first point.

FIG. 7 is an explanatory diagram conceptually illustrating the calculation of the altered conveying distance CF in the process of FIG. 6 and the conveying operation of the recording paper P in the page printing process of FIG. 5.

The sensor 50 is shown in the upper right corner of FIG. 7, while the detecting position K is positioned along the imaginary vertical line extending downward from the sensor 50. The conveying roller 60 is displayed to the left of the detecting position K in each of the FIGS. 7(*a*)-7(*d*), and the inkjet head 6 is displayed farther to the left of the conveying roller 60. A solid line is used to indicate the recording paper P conveyed below the conveying roller 60 and the inkjet head 6. Intervals marked by short vertical lines intersecting the recording paper P indicate the conveying distance F for each interlace cycle.

FIGS. 7(*a*) and 7(*b*) display the recording paper P in two positions along the conveying path. The upper recording paper P is in a position at which the sensor 50 detects the trailing edge, while the lower recording paper P indicates the position of the recording paper P when conveyed an feed distance DF after the trailing edge was detected at the detecting position K and before coming to a halt. In this example, the feed distance DF is the maximum distance, which is approximately a distance equivalent to or slightly less than the conveying distance LF. In order to calculate the altered conveying distance CF in this example, it is necessary to calculate an altered conveying distance CF1 based on the first distance value A, as shown in FIG. 7(*a*).

As shown in FIG. 7(*a*), the first distance value A is the distance from the detecting position K to the nip point between the conveying rollers 60, or a value obtained by adding a margin to this distance to account for mechanical tolerance. In other words, the first distance value A is the length from the nip point of the conveying rollers 60 to the trailing edge of the recording paper P when the trailing edge has reached the detecting position K.

Here, the altered conveying distance CF1 is found by the equation CF1=A−DF−nF−SF. However, since the distance from the nip point to the detecting position K in the preferred embodiment is not greater than 2F, it is possible to set n to 0, thereby reducing the equation to CF1=A−DF−SF.

The altered conveying distance CF1 is therefore set to the result obtained by subtracting n times the conveying distance F for one interlace cycle and the total small feed conveying distance SF from a value obtained by subtracting the feed distance DF from the first distance value A (the length of the recording paper P upstream from the nip point).

As described above, the trailing edge of the recording paper P must be positioned upstream of the nip point between the conveying rollers 60 by a distance of at least the total small feed conveying distance SF when beginning an interlace cycle during which the trailing edge of the recording paper P will pass through the nip point with a large feed. In other words, the total small feed conveying distance SF is the limit on the length of the recording paper P that is positioned upstream of the nip point. The altered conveying distance CF1 is calculated by subtracting the total small feed conveying distance SF from the length of the recording paper P positioned upstream of the nip point and serves as the conveying distance for positioning the trailing edge of the recording paper P upstream of the nip point by the total small feed conveying distance SF.

As can be seen in FIG. 7(*a*), the altered conveying distance CF1 found above is an upper limit. In other words, it is possible to increase the length of the recording paper P positioned upstream of the nip point to a value greater than the total small feed conveying distance SF by setting the altered conveying distance CF1 to a smaller value.

However, a distance exceeding the total small feed conveying distance SF must be allocated for the altered conveying distance CF because conveying operations are performed in groups of three small feeds and one large feed, and the small feeds are not modified for altered conveying operations in the preferred embodiment. Since the detecting position K is positioned upstream of the nip point by the conveying distance F for one interlace cycle plus the total small feed conveying distance SF in the preferred embodiment, a distance of at least two times SF is allocated between the nip point and the trailing edge of the recording paper P, even when the recording paper P is conveyed the feed distance DF (approximately the conveying distance LF) from the detecting position K. Therefore, the altered conveying distance CF can be set to a conveying distance greater than or equal to the total small feed conveying distance SF.

Next, the altered conveying distance CF2 is calculated based on the first distance value B, as shown in FIG. 7(*b*). The first distance value B is the distance from the detecting position K to the first point downstream of the nip point. In other words, the first distance value B is a value obtained by adding a distance ΔW to the first distance value A, where ΔW is a distance for avoiding the trailing edge of the recording paper P being positioned near the nip point when the conveying halts. Specifically, the altered conveying distance CF2 is a value for conveying the trailing edge of the recording paper P from the nip point to the first point downstream of the nip point by a prescribed distance when the trailing edge passes through the nip point in a large feed.

The altered conveying distance CF2 is found by the equation CF2=B−DF−nF−F. Since the distance from the nip point between the conveying rollers 60 to the detecting position K is no greater than 2F in the preferred embodiment, n can be set to 0, reducing the equation to CF2=B−DF−F.

The altered conveying distance CF2 is a value obtained by subtracting n conveying distances F for one interlace period and an additional conveying distance F for one interlace period from a value obtained by subtracting the feed distance DF from the first distance value B (the length of recording paper upstream of the first point).

As described above, in order to halt the recording paper P when the trailing edge of the recording paper P is past the first point downstream of the nip point after the trailing edge has been conveyed through the nip point with a large feed, it is necessary to ensure that the trailing edge of the recording paper P prior to the beginning of this interlace cycle is positioned upstream of the first point by a distance less than the conveying distance F.

In other words, the conveying distance F for one interlace cycle is the limit on the length of the recording paper P positioned on the upstream side of the first point. The altered conveying distance CF2 is calculated by subtracting this conveying distance F from the length of the recording paper P distributed upstream of the first point and serves as the conveying distance for positioning the trailing edge of the recording paper P upstream of the first point by a distance equivalent to the conveying distance F for one interlace cycle.

Normally the altered conveying distance CF2 calculated above is a lower limit. Hence, the length of the recording paper P distributed upstream of the first point can be shortened from the conveying distance F for one interlace cycle by increasing the altered conveying distance CF2.

Next, an altered conveying distance CF that satisfies both the altered conveying distances CF1 and CF2 is calculated using the equation CF=(CF1+CF2)/2+mF. If the sum of CF1+CF2 is 0 or less, as in the case shown in FIGS. 7(*a*) and 7(*b*), then m is set to a positive integer for calibrating CF.

FIG. 7(*c*) shows how the recording paper P is conveyed according to the calculated altered conveying distance CF. In this example, the altered conveying distance CF is identical to the theoretical conveying distance F for one interlace cycle. Hence, the recording paper P is conveyed the theoretical conveying distance.

FIG. 7(*d*) illustrates an operation to convey the recording paper P when the feed distance DF is smaller than the examples shown in FIGS. 7(*a*)-7(*c*) described above. As in the example of FIGS. 7(*a*)-7(*c*), n is 0. Therefore, the altered conveying distance CF1 is found from CF1=A−DF−SF, the altered conveying distance CF2 is found from CF2=A−DF−F, and the altered conveying distance CF is found from CF=(CF1+CF2)/2+mF. Here, m=0 if CF1+CF2 is greater than 0.

As described above, the small feeds in an altered conveying operation are set the same as the conveying distances SF1-SF3 in the preferred embodiment. Therefore, as shown in FIG. 7(*d*), the conveying distance is adjusted using the conveying distance LF' found by subtracting the total small feed conveying distance SF from the altered conveying distance CF.

In FIG. 7(*d*), the upper recording paper P illustrates the recording paper P being conveyed normally without an altered conveying operation. As shown, the trailing edge of the recording paper P is positioned at the nip point after completing the second small feed. The lower recording paper P in FIG. 7(*d*) shows an example of conveying the recording paper P by executing three small feeds at conveying distances SF1-SF3 after confirming that the trailing edge of the recording paper P has passed the detecting position K of the sensor 50, and subsequently executing a large feed at the conveying distance LF' found from the altered conveying distance CF.

Through this operation, the position of the trailing edge of the recording paper P is adjusted before the trailing edge is introduced into the nip point between the conveying rollers 60. Consequently, as shown in FIG. 7(*d*), the trailing edge of the recording paper P passes through the nip point during a large feed (conveying distance LF) and is halted at a position beyond the first point downstream of the nip point.

The printer 1 according to the preferred embodiment may also be configured to alter the conveying distances SF1-SF3 for the small feeds based on the altered conveying distance CF (producing conveying distances SF1'-SF3'), rather than altering just the large feed.

As described above, the printer 1 according to the preferred embodiment avoids stopping conveyance (in other words, performing image recording) when the trailing edge of the recording paper P is positioned at or directly downstream of the nip point between the conveying rollers 60. Put another way, the printer 1 continues conveying the recording paper P a prescribed distance (continues driving the conveying rollers a prescribed time) after the trailing edge of the recording paper P has passed the nip point, rather than halting conveyance immediately thereafter. In this way, the printer 1 can avoid recording an image when an irregularity in conveyance has occurred, but can perform recording when the recording paper P has been conveyed the correct distance. Therefore, the recording paper P can be conveyed with precision, producing a printed product of high quality.

Further, by ensuring that the trailing edge of the recording paper P passes through the nip point during a large feed rather than a small feed, the printer 1 of the preferred embodiment can reliably avoid performing a conveying operation in which the trailing edge of the recording paper P is halted at or directly downstream of the nip point, even when the actual timing for halting conveyance (halting position) deviates slightly from the design value due to mechanical error in the device.

Although some conventional image-forming devices have been provided with a reverse feed mechanism for conveying the recording paper P back upstream in order to cancel a conveying deviation caused by a forward jump, these devices cannot sufficiently cancel deviations produced by forward jumps since the reverse feeding operations in these image-forming devices are less accurate than the forward feeds (feeding in the conveying direction). However, the printer 1 can cancel deviations produced by forward jumps without performing reverse feeds, thereby achieving more accurate conveying operations than devices that employ reverse feeds, and can reduce manufacturing costs by eliminating the need of the reverse feed mechanism.

The printer 1 can execute conveying operations at different conveying distances (LF, SF), enabling the device to convey the recording paper P at the large feed conveying distance LF during an interval in which the trailing edge of the recording paper P passes through the nip position between the conveying rollers 60. Therefore, the printer 1 can ensure a sufficient gap between the timing at which the trailing edge of the recording paper P passes through the nip position between the conveying rollers 60 and the timing at which the recording paper P is halted, thereby reliably performing the conveying operation required for resolving deviation produced by a forward jump after the trailing edge of the recording paper P is released from the conveying rollers 60.

Next, a second embodiment of the present invention will be described with reference to FIG. 8. In the first embodiment described above, the detecting position K of the sensor 50 was set upstream from the nip point between the conveying rollers 60 by a distance equivalent to the sum of the conveying distance F for one interlace cycle and the total small feed conveying distance SF. Further, the printer 1 according to the first embodiment determined when the trailing edge of the recording paper P passed the detecting position K at timings coinciding with the end of feeding operations and, upon determining that the trailing edge passed the detecting position K, executed a feeding operation based on the altered conveying distance CF for the large feed in the next interlace cycle.

However, in the second embodiment, the detecting position K of the sensor 50 is set upstream of the nip point between the conveying rollers 60 by a distance equivalent to adding twice the total small feed conveying distance SF to the distance required to halt conveyance of the recording paper P. Further, when the printer 1 determines that the trailing edge of the recording paper P has passed the detecting position K while conveying the recording paper P in a large feed, then the printer 1 immediately converts the conveying distance to a distance based on the altered conveying distance CF and executes a conveying operation. In the following description, like parts and components have been designated with the same reference numerals to avoid duplicating description.

In addition to the structure of the printer 1 according to the first embodiment, the printer 1 according to the second embodiment includes a sensor flag in the RAM 34 for storing the state of the sensor 50.

The sensor flag functions to indicate whether the detection value of the sensor 50 during the previous large feed conveying operation was a value indicating the presence of paper. The sensor flag is set to ON after an operation is executed to feed a sheet of the recording paper P if the detection value of the sensor 50 indicates the presence of paper. The sensor flag is set to OFF if the printer 1 determines that the detection value from the sensor 50 indicates that no paper is present while the recording paper P is being conveyed during a large feed.

The CPU 32 determines whether the detection value of the sensor 50 has changed from a value indicating the presence of paper to a value indicating no paper based on the state of the sensor flag and the state of the sensor 50 during the current large feed. Upon determining that such a change has occurred, the printer 1 executes a conveying operation based on the altered conveying distance CF.

If the detection value of the sensor 50 changes from a value indicating the presence of paper to a value indicating no paper during a small feed conveying operation, then the detection value of the sensor 50 is already set to a value indicating no paper during the subsequent large feed. In other words, the detection value of the sensor 50 does not change from a value indicating the presence of paper to a value indicating no paper during the subsequent large feed conveying operation.

Hence, by using the sensor flag to indicate the state of the sensor 50 during the previous large feed, it is possible to determine whether the state of the sensor 50 has changed by comparing the state indicated by the sensor flag to the state of the sensor 50 in the current large feed. In other words, the printer 1 can determine whether the detection value of the sensor 50 has changed from a value indicating the presence of paper to a value indicating no paper based on the state of the sensor flag and the state of the sensor 50 during the current large feed and can properly execute an altered conveying operation when such a change is detected.

FIG. 8 is a flowchart illustrating steps in a page printing process according to the second embodiment. As in the first embodiment, the page printing process according to the second embodiment begins when reception of print data is complete. In S401 of the process shown in FIG. 8, the CPU 32 performs a feeding operation to feed a sheet of the recording paper P until the leading edge of the recording paper P is positioned at the prescribed recording start position SP. In S402 the CPU 32 acquires the theoretical conveying distances (large conveying distance and small conveying distance) by writing the theoretical conveying distances corresponding to the recording density value stored in the printing information memory area 34*a* to the corresponding large feed memory area 34*b* and small feed memory area 34*c*.

In S450 the CPU 32 sets the sensor flag on based on the detection value of the sensor 50. Since the recording paper P is normally positioned at the detecting position K of the sensor 50 immediately after a feeding operation, the detection value of the sensor 50 will indicate the presence of paper. Therefore, the sensor flag is set to ON at this time.

In S403 the CPU 32 executes a main scan printing process for printing one band worth of data.

In S404 the CPU 32 determines whether the modification flag 34*h* is on. If the modification flag 34*h* is not on (S404: NO), indicating that it is not time to execute an altered conveying operation, then in S405 the CPU 32 determines whether the value of the feed counter 34*f* is less than 3. If the value of the feed counter 34*f* is less than 3 (S405: YES), then in S406 the CPU 32 drives the linefeed motor 40 for conveying the recording paper P by the small feed conveying distance SF1-SF3 stored in the small feed memory area 34*c*, as described in the first embodiment, and in S407 increments the feed counter 34*f* by 1.

However, if the CPU 32 determines in S404 that the modification flag 34*h* is on (S404: YES), indicating that it is time to execute a conveying operation based on the altered conveying distance CF, then in S462 the CPU 32 drives the linefeed motor 40 for conveying the recording paper P by the conveying distance stored in the altered conveyance memory area 34*d* in association with the value of the feed counter 34*f*.

In S463 the CPU 32 determines whether the value of the feed counter 34*f* is less than 3. If the value of the feed counter 34*f* is less than 3 (S463: YES), then in S465 the CPU 32 increments the feed counter 34*f* by 1. However, if the feed counter 34*f* is 3 or greater (S463: NO), then the CPU 32 sets the modification flag 34*h* to OFF in S464 and advances to the process in S459.

If the CPU 32 determines in S405 that the value of the feed counter 34*f* is not less than 3 (S405: NO), then in S452 the CPU 32 determines whether the sensor flag is on. If the sensor flag is on (S452: YES), then the trailing edge of the recording paper P did not reach the detecting position K of the sensor 50 in the previous large feed (or the paper feeding operation). Accordingly, in S453 the CPU 32 drives the linefeed motor 40 one step and determines in S454 whether the detection value of the sensor 50 indicates no paper. If the detection value indicates no paper (S454: YES), indicating that the trailing edge of the recording paper P passed the detecting position K sometime after completing the previous large feed. Therefore, in S455 the CPU 32 immediately halts the linefeed motor 40 and in S456 executes a process for setting an altered conveying distance similar to the process of S416 in the first embodiment.

The process for setting an altered conveying distance in S456 differs from the process of S416 described in the first embodiment only in S526. In the second embodiment, the printer 1 can modify the conveying distance for not only the large feed but also the small feeds based on the altered conveying distance CF. Therefore, in S526 the altered conveying distance CF is divided among the large feed conveying distance LF' and small feed conveying distances SF1'-SF3' according to a prescribed method of division, such as setting each of the conveying distances SF1'-SF3' to one pitch and the conveying distance LF' to the remainder. The CPU 32 writes each of the conveying distances found above to the altered conveyance memory area 34*d* in association with the type of feed (the value of the feed counter 34*f*). Here, the conveying distances SF1'-SF3' may be the same as or different from the conveying distances SF1-SF3.

In S457 the CPU 32 sets the modification flag 34*h* to ON, indicating the timing at which the conveying operation was executed based on the altered conveying distance CF, and in S458 sets the sensor flag to OFF, indicating that the trailing edge of the recording paper P has passed the detecting position K. In S459 the CPU 32 resets the feed counter 34*f* to 0.

If the CPU 32 determines in S452 that the sensor flag is off (S452: NO), indicating the timing of a large feed after conveyance has been completed based on the altered conveying distance CF, then in S460 the CPU 32 drives the linefeed motor 40 for conveying the recording paper P by the large conveying distance LF stored in the large feed memory area 34*b*. In S460, the recording paper P is conveyed continuously over the conveying distance LF rather than in intermittent steps. Therefore, printing can be performed at a high speed after completing the altered conveying operation. After completing the process of S460, the CPU 32 advances to S459.

If the CPU 32 determines in S454 that the detection value of the sensor 50 does not indicate no paper (S454: NO), then in S461 the CPU 32 determines whether the recording paper P has been conveyed the conveying distance LF stored in the large feed memory area 34*b*. If the operation to convey the recording paper P by the conveying distance LF stored in the large feed memory area 34*b* has not been completed (S461: NO), then the process is repeated from S453, thereby conveying the recording paper P repeatedly by one step until either the recording paper P has been conveyed the entire conveying distance LF or the detection value of the sensor 50 has changed to a value indicating no paper.

Further, if the recording paper P has been conveyed the entire large conveying distance stored in the large feed memory area 34*b* (S461: YES), the CPU 32 advances to S459.

After completing any of the processes in S407, S459, and S465, the CPU 32 determines in S408 whether printing has been completed for the entire page. The CPU 32 loops back to S403 until the page printing process is complete. Hence, the printing process is executed by alternately performing the recording operation and the conveying operation until the entire page has been printed.

When the CPU 32 halts the linefeed motor 40 in S455, the range of usable nozzles for the next recording operation changes from the normal range according to the distance the recording paper P was conveyed until halting the linefeed motor 40. Therefore, the printer 1 must perform recording using a different range of nozzles in the subsequent main scan printing process of S403.

Further, when performing an altered conveying operation, the range of usable nozzles is changed from the normal range according to the conveying distance (LF' or SF1'-SF3'). Accordingly, the next recording operation is performed using a different range of nozzles.

In the second embodiment described above, the printer 1 can control conveyance so that the trailing edge of the recording paper P passes through the nip point between the conveying rollers 60 during a large feed by first halting the linefeed motor 40 after the sensor 50 detects the trailing edge of the recording paper P and subsequently executing a conveying operation at the altered conveying distance CF. Therefore, the detecting position K can be positioned nearer to the conveying roller 60 than in the first embodiment. The printer 1 according to the second embodiment can perform more accurate conveying operations than in the first embodiment, even when printing on a recording paper P that is shorter in length in the conveying direction.

Since either the small feed conveying distance SF or the large feed conveying distance LF is modified based on the detection of the trailing edge of the recording paper P, the printer 1 can execute a conveying operation at the large feed conveying distance LF in the region that the trailing edge of the recording paper P passes through the nip position between the conveying rollers 60, even when the size of the recording paper P introduced into the image-forming device is non-standard and cannot be set and even when the size set for the recording paper P is different from the actual size of the recording paper P introduced into the device.

Next, a third embodiment of the present invention will be described with reference to FIGS. 9 through 11. In the first embodiment described above, the printer 1 is configured to calculate the altered conveying distance CF by detecting the trailing edge of the recording paper P with the sensor 50 and to perform a large feed at the conveying distance LF' based on the calculated altered conveying distance CF before the trailing edge of the recording paper P reaches the nip point.

However, in the third embodiment, the printer 1 is configured to calculate the altered conveying distance CF based on the paper size, which is known in advance, and to execute the altered conveying operation without detecting the trailing edge of the recording paper P with the sensor 50. In the following description, like parts and components have been designated with the same reference numerals to avoid duplicating description.

More specifically, the printer 1 according to the third embodiment is not provided with the sensor 50 used in the first embodiment. Further, the design value memory 35*a* stores second distance values C and D in place of the first distance values A and B for calculating the altered conveying distance CF based on the paper size. While the printer 1 according to the first embodiment was configured to calculate the altered conveying distance CF based on the sensor 50 detecting the trailing edge of the recording paper P, the printer 1 according to the third embodiment is configured to calculate the altered conveying distance CF based on the paper size.

Figure 9:
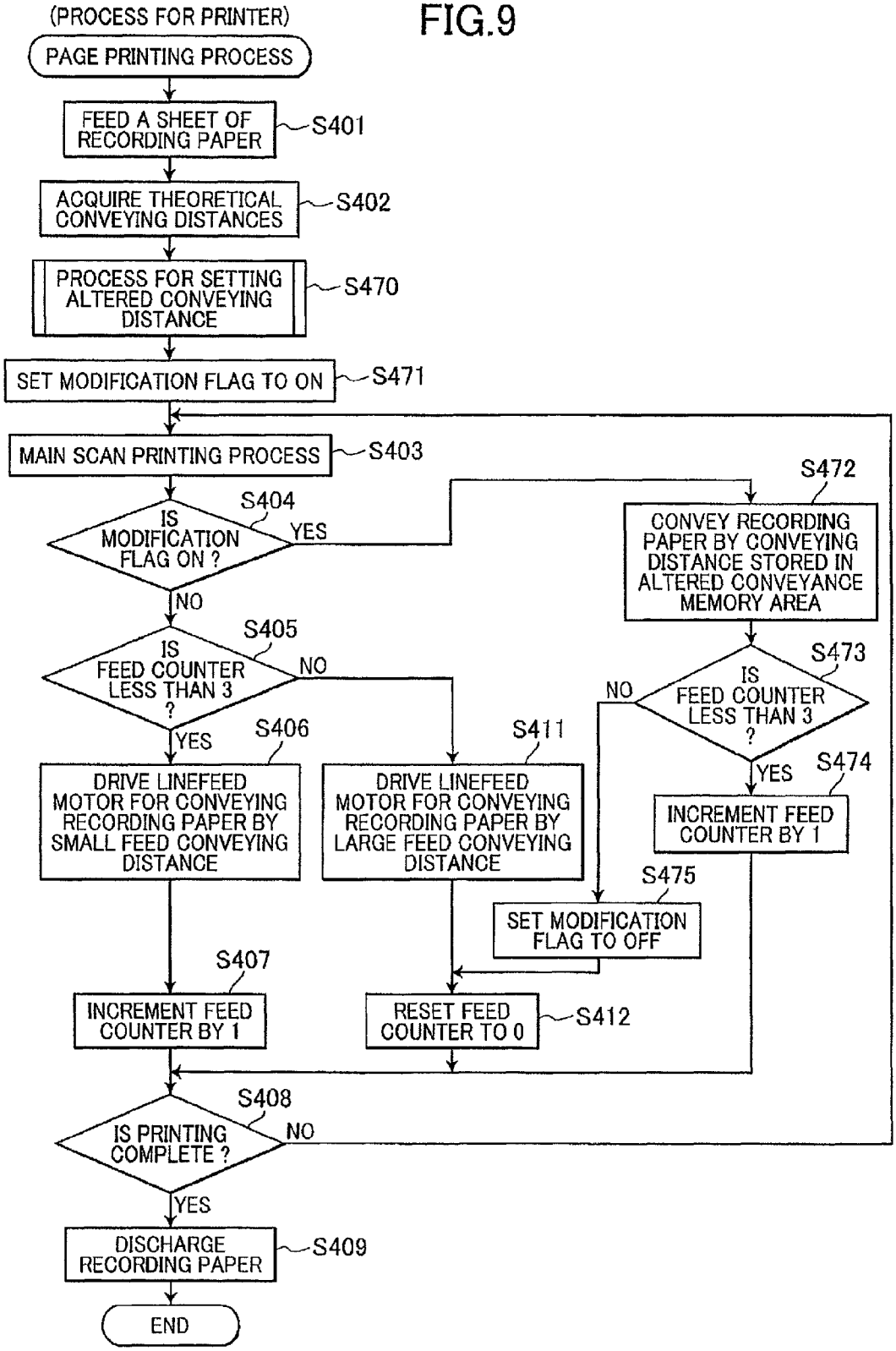
FIG. 9 is a flowchart illustrating steps in a page printing process according to a third embodiment.

FIG. 9 is a flowchart illustrating steps in a page printing process according to the third embodiment. As in the first embodiment, the page printing process according to the third embodiment is initiated as soon as the reception of print data is complete. At the beginning of the process in S401 and S402 the CPU 32 feeds a sheet of the recording paper P until the leading edge of the recording paper P reaches the recording start position SP (downstream by the recording start length HS from the upstream edge of the inkjet 6) and subsequently acquires the theoretical conveying distances. In S470 the CPU 32 executes a process for setting an altered conveying distance.

After the altered conveying distance CF has been set in the process of S470, in S471 the CPU 32 sets the modification flag 34*h* to ON in order to indicate that it is time to execute a conveying operation according to the altered conveying distance CF. In S403 the CPU 32 executes the main scan printing process for printing one band.

In S404 the CPU 32 confirms whether the modification flag 34*h* is on. In the third embodiment, the altered conveying distance CF is designed so that once a conveying operation based on the altered conveying distance CF is executed, conveying is continued until the trailing edge of the recording paper P passes through the nip point of the conveying rollers 60 in a large feed (conveying distance LF) and passes the first point downstream of the nip point (see FIGS. 10 and 11). Further, the page printing process is configured to execute a conveying operation based on the altered conveying distance CF immediately after beginning the printing operation. Hence, if the CPU 32 determines in S404 that the modification flag 34*h* is off (S404: NO), then a conveying operation according to the altered conveying distance CF has already been completed and the process has reached the second interlace cycle or later. Therefore, the CPU 32 performs the process beginning from S405 to execute conveying operations according to the theoretical conveying distances.

Alternatively, it is possible to design an altered conveying distance CF for preventing the trailing edge of the recording paper P from being halted near the nip point by modifying the theoretical conveying distances a plurality of times. It is also possible to convey the recording paper P based on the altered conveying distance CF at any timing before the trailing edge passes through the nip point.

As in the first embodiment, the process beginning from S405 in the third embodiment conveys the recording paper P at a small feed or a large feed depending on the value of the feed counter 34*f* and repeatedly executes this conveying operation and the main scan printing process of S403 until printing on the page is complete. After the page is completely printed, the CPU 32 discharges the recording paper P and ends the page printing process.

However, if the CPU 32 determines in S404 that the modification flag 34*h* is on (S404: YES), then it is time to execute a conveying operation based on the altered conveying distance CF. In the third embodiment, the conveying distance for a large feed as well as the conveying distances for small feeds can be modified according to the altered conveying distance CF and are stored in the altered conveyance memory area 34*d* in association with the feed type (value of the feed counter 34*f*).

In S472 the CPU 32 conveys the recording paper P by the conveying distance stored in the altered conveyance memory area 34*d* based on the value of the feed counter 34*f*. Specifically, if the value of the feed counter 34*f* is 0, 1, or 2, the CPU 32 conveys the recording paper P at the small feed conveying distance SF1'-SF3' stored in the altered conveyance memory area 34*d*. If the value of the feed counter 34*f* is 3, then the CPU 32 executes a conveying operation at the large feed conveying distance LF' stored in the altered conveyance memory area 34*d*.

In S473 the CPU 32 determines whether the value of the feed counter 34*f* is less than 3. If the value of the feed counter 34*f* is less than 3, that is, 0, 1, or 2 (S473: YES), indicating that the conveying operation of the interlace cycle has not completed, in S474 the CPU 32 increments the feed counter 34*f* by 1 and advances to S408. However, if the CPU 32 determines in S473 that the value of the feed counter 34*f* is 3 (S473: NO), indicating that the conveying operation for an interlace cycle based on the altered conveying distance CF has been completed, then in S475 the CPU 32 sets the modification flag 34*h* to OFF and in S412 resets the feed counter 34*f* to 0.

Figure 10:
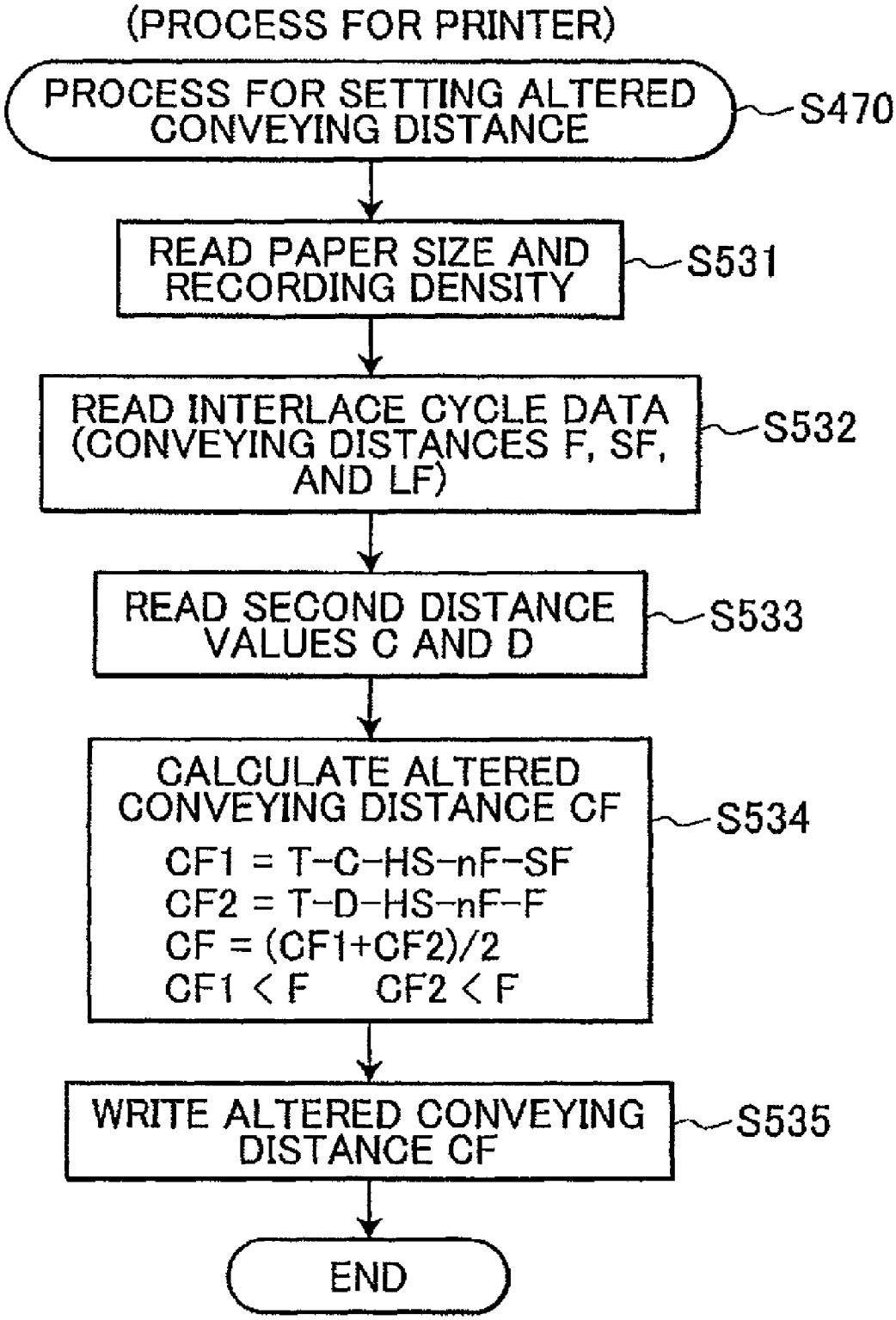
FIG. 10 is a flowchart illustrating steps in a process for setting altered conveying distances according to the third embodiment executed during the page printing process of FIG. 9.
Figure 11A:
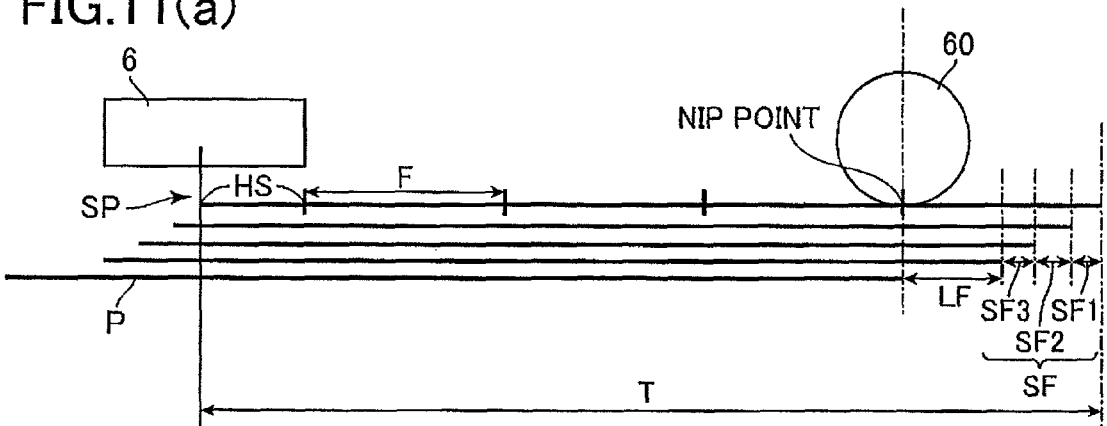
FIG. 11(*a*)-11(*d*) are explanatory diagrams conceptually illustrating the calculation of the altered conveying distance in the process for setting altered conveying distances and a conveying operation of recording paper in the printing process according to the third embodiment.
Figure 11B:
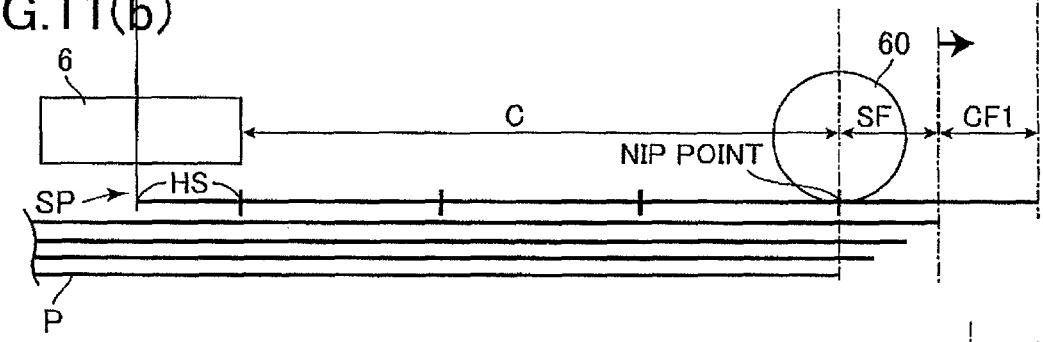
Figure 11C:
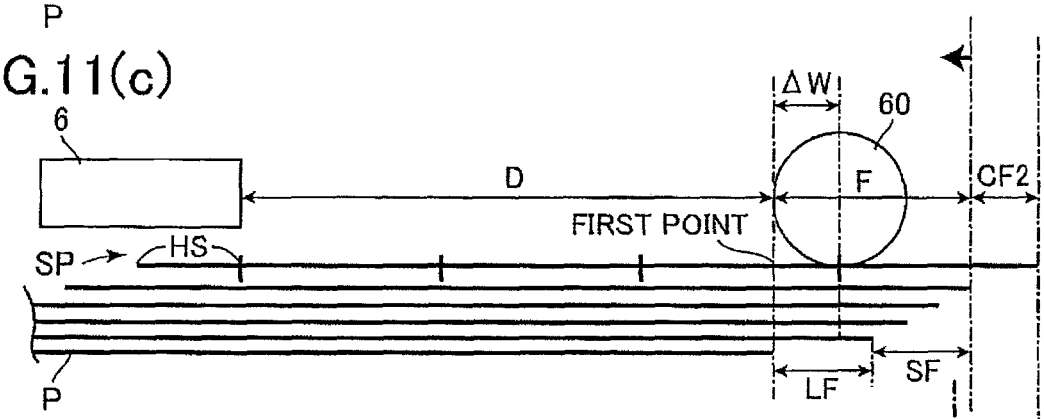
Figure 11D:
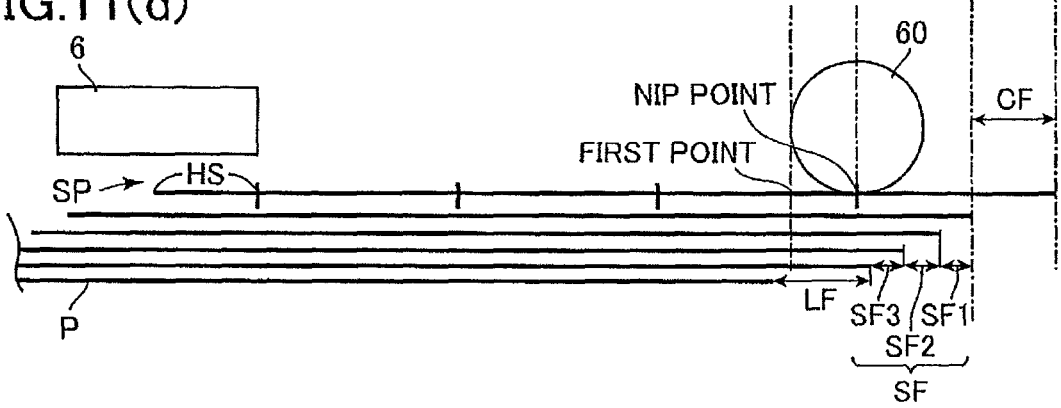

FIG. 10 is a flowchart illustrating steps in the process for setting the altered conveying distance executed in S470 of the page printing process shown in FIG. 9. In the process of S470 the CPU 32 calculates the altered conveying distance CF for positioning the trailing edge of the recording paper P within a prescribed range when beginning a feeding operation that will cause the trailing edge of the recording paper P to pass through the nip point of the conveying rollers 60.

In S531 in the process of S470 the CPU 32 reads a paper size and recording density stored in the printing information memory area 34*a*. In S532 the CPU 32 reads interlace cycle data (conveying distances F, SF, and LF) stored in the interlace cycle data memory area 35*b* in association with the recording density read in S531. Further, in S533 the CPU 32 reads the second distance values C and D and the recording start length HS from the design value memory 35*a*. In S534 the CPU 32 calculates an altered conveying distance CF that satisfies the inequalities CF1<F and CF2<F using the equations CF1=T−C−HS−nF−SF, CF2=T−D−HS−nF−F, and CF=(CF1+CF2)/2. In S535 the CPU 32 writes the altered conveying distance CF calculated in S534 to the altered conveyance memory area 34*d* and ends the process for setting the altered conveying distance of S470.

In the process of S532, the CPU 32 divides the altered conveying distance CF into a large feed conveying distance LF' and small feed conveying distances SF1'-SF3' according to a prescribed method of division, such as setting each of the small feed conveying distances SF1'-SF3' to 1 pitch and the large feed conveying distance LF' to the remainder, derives conveying distances for each of the small feeds and the large feed, and writes these conveying distances to the altered conveyance memory area 34*d* in association with the feed type (value of the feed counter 34*f*). Here, the conveying distances SF1'-SF3' may be the same as or different from the conveying distances SF1-SF3.

In the above equations, T is the paper size (length in the subscanning direction, or paper length T) read in S531. Further, when writing the calculated altered conveying distance CF to the altered conveyance memory area 34*d*, the altered conveying distance CF is divided according to a prescribed method into a large feed conveying distance and small feed conveying distances, and these conveying distances are written to the altered conveyance memory area 34*d*.

FIG. 11 is an explanatory diagram conceptually illustrating the calculation of the altered conveying distance CF in the process of FIG. 10 and the conveying operation of the recording paper P in the page printing process of FIG. 9. In each of FIGS. 11(*a*)-11(*d*), the conveying roller 60 is displayed upon the right side, and the inkjet head 6 is displayed to the left of the conveying roller 60. A solid line is used to indicate the recording paper P conveyed below the conveying roller 60 and the inkjet head 6. Intervals marked by short vertical lines intersecting the recording paper P indicate the conveying distance F for each interlace cycle. In FIG. 11, the recording paper P is conveyed from right to left so that the right side of the drawings is the upstream side and the left side the downstream side.

In FIGS. 11(*a*)-11(*d*), the sequential progress of the recording paper P in the conveying direction is illustrated by displaying a sheet of the recording paper P in its position after each feeding operation.

FIG. 11(*a*) illustrates a conveying operation performed without executing an altered conveying operation. In this example, the recording paper P is disposed with the leading edge in the predetermined recording start position SP that is decided by the recording start length HS and is conveyed downstream by the conveying distance F. After completing the large feed in the interlace cycle, the recording paper P is halted with the trailing edge directly below the nip point between the conveying rollers 60 (immediately after passing the nip point). In order to avoid this situation, the altered conveying distance CF is calculated by first finding the altered conveying distance CF1 according to the method shown in FIG. 11(*b*).

The second distance values are design values defined by the mechanical structure (specifications) of the printer 1, in other words, predetermined fixed values. As shown in FIG. 11(*b*), the second distance value C is the distance from the upstream edge of the inkjet head 6 to the nip point between the conveying rollers 60 (or the same distance plus a margin to account for mechanical tolerance).

The altered conveying distance CF1 is calculated based on the second distance value C. More specifically, the altered conveying distance CF1 is calculated by subtracting the second distance value C, the recording start length HS, n times the conveying distance F for one interlace cycle, and the total small feed conveying distance SF from the paper size. In the preferred embodiment, the paper size is the recording paper length T. For simplification, the paper length T shown in FIG. 11 is found for the case when n=0.

Hence, when the leading edge of the recording paper P is positioned at the recording start position SP which is downstream side of the upstream edge of the inkjet head 6 by the recording start length HS, the length of the recording paper P distributed upstream of the nip point is T−C−HS. Since the recording paper P is sequentially conveyed toward the read side of the nip point by the conveying distance F, the length of the recording paper P distributed upstream of the nip point decreases sequentially by F. Once the recording paper P is conveyed n times by the conveying distance F, the portion of the recording paper P remaining upstream of the nip point is an extra portion less than the conveying distance F. If this extra portion exceeds the total small feed conveying distance SF, then a large feed is performed to convey the trailing edge of the recording paper P through the nip point.

Therefore, an altered conveying distance for the total small feed conveying distance SF is set as the extra portion remaining after conveying the recording paper P n times at the conveying distance F, and the altered conveying distance CF1 is found from the equation CF1=T−C−HS−nF−SF. As can be seen from FIG. 11(*b*) the altered conveying distance CF1 is an upper limit. Hence, the trailing edge of the recording paper P can be placed in an appropriate position by setting the altered conveying distance CF less than this altered conveying distance CF1.

As shown in FIG. 11(*c*), the altered conveying distance CF2 is calculated based on the second distance value D. The second distance value D is the distance from the first point downstream of the nip point to the upstream edge of the inkjet head 6. In other words, the second distance value D is a value obtained by adding a distance ΔW to the second distance value C, where ΔW is a distance for avoiding the trailing edge of the recording paper P being positioned near the nip point when the conveying halts. Specifically, the altered conveying distance CF2 is a value for conveying the trailing edge of the recording paper P from the nip point to the first point downstream of the nip point by a prescribed distance when the trailing edge passes through the nip point in a large feed.

In order to halt conveying of the recording paper P when the trailing edge is past the first point downstream of the nip point after the trailing edge has been conveyed through the nip point, it is necessary to ensure that the trailing edge of the recording paper P prior to the beginning of this interlace cycle is positioned upstream of the first point by a distance less than the conveying distance F. Therefore, the altered conveying distance CF2 is found by the equation CF2=T−HS−D−nF−F. As can be seen from FIG. 11(*c*), the altered conveying distance CF2 is a lower limit. Therefore, the trailing edge of the recording paper P can be placed in an appropriate position by setting the altered conveying distance CF to a value greater than the altered conveying distance CF2.

Since the case of n=0 is used for the paper length T shown in FIG. 11, the altered conveying distance CF2 is calculated by T−HS−D−F in the third embodiment. Hence, an altered conveying distance CF that satisfies both the altered conveying distance CF1 and the altered conveying distance CF2 is calculated from the equation CF=(CF1+CF2)/2.

FIG. 11(*d*) illustrates an example in which the recording paper P is conveyed according to the altered conveying distance CF calculated above. Since the altered conveying operation is executed in the first interlace cycle in the third embodiment, the recording paper P is moved downstream (leftward in FIG. 11) by the altered conveying distance CF after recording the initial band in the head of the recording paper. The altered conveying operation includes three small feeds at conveying distances SF1', SF2', and SF3', and one large feed at the conveying distance LF'. While not indicated in FIG. 11(*d*), the recording paper P displayed in the topmost position is placed in the state of the recording paper P displayed second from the top after sequentially conveying the recording paper P by the conveying distances SF1'-SF3' and LF'.

Thereafter, a normal conveying operation comprising three small feeds of conveying distances SF1-SF3 and one large feed of conveying distance LF is repeated. However, since the position of the recording paper P has already been adjusted by the altered conveying operation, the trailing edge of the recording paper P passes through the nip point between the conveying rollers 60 during a large feed, and conveying is halted after the trailing edge of the recording paper P has been conveyed to a position beyond the first point downstream of the nip point.

In the third embodiment described above, the sensor 50 can be eliminated by deriving the altered conveying distance CF from the paper size, thereby suppressing manufacturing costs.

Since the altered conveying distance CF is always the same for the same paper size, the printer 1 may be provided with a memory area for storing the altered conveying distance CF in association with paper sizes and may be configured to read an altered conveying distance CF corresponding to a paper size transmitted from the personal computer 100, for example, from the memory and to execute an altered conveying operation based on the altered conveying distance CF read from memory.

Next, a fourth embodiment of the present invention will be described with reference to FIGS. 12 through 14. The printer 1 according to the first embodiment described above ensures that the trailing edge of the recording paper P passes through the nip point between the conveying rollers 60 in a large feed by altering the conveying distance from the theoretical conveying distance F to the altered conveying distance CF. This conveying operation moves the trailing edge of the recording paper P to a position beyond a first point downstream of the nip point.

However, the printer 1 according to the fourth embodiment ensures that the trailing edge of the recording paper P passes through the nip point in a large feed by modifying the recording start length HS. The recording start position SP is decided as a point downstream of the leading edge of the inkjet head 6 by the modified recording start length HF. By setting the recording start position SP based on the modified recording start length HF, the trailing edge of the recording paper P is fed to the first point downstream of the nip point. In the following description, like parts and components have been designated with the same reference numerals to avoid duplicating description.

Hence, the printer 1 according to the fourth embodiment need not be provided with the sensor 50 and the altered conveyance memory area 34*d* used in the first embodiment. Further, the design value memory 35*a* stores second distance values C and D for calculating the recording start length HS in place of the first distance values A and B. Further, the RAM 34 includes a printing start data memory area for storing a calculated recording start length HS. At the beginning of a printing operation, the leading edge of the recording paper P is set at the recording start position SP which is positioned downstream of the upstream edge of the inkjet head 6 by the starting length HS stored in this printing start data memory area rather than at the recording start length HS stored in the design value memory 35*a* as a default.

Figure 12:
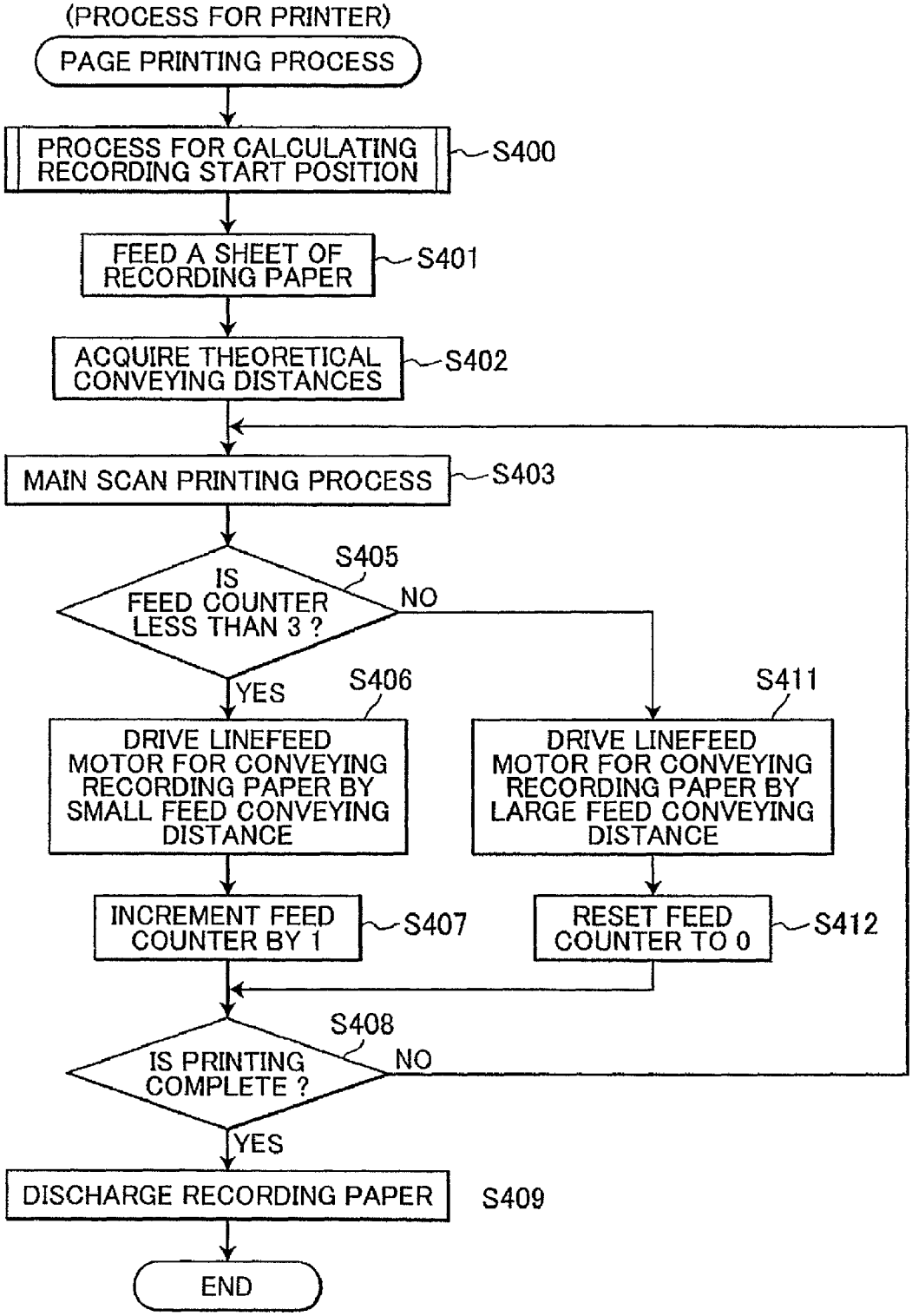
FIG. 12 is a flowchart illustrating steps in a page printing process according to a fourth embodiment.

FIG. 12 is a flowchart illustrating steps in a page printing process according to the fourth embodiment. As in the first embodiment, the page printing process according to the fourth embodiment is initiated as soon as the reception of print data is complete. At the beginning of the process in S400 the CPU 32 executes a process for calculating the recording start length HS so that the leading edge of the recording paper P can be set at the recording start position SP, that is downstream of the upstream edge of the inkjet head 6 by the calculated recording start length HS, corresponding to the paper size. In S401 the CPU 32 drives the linefeed motor 40 to feed a sheet of the recording paper P until the leading edge of the recording paper P is positioned at the recording start position SP. In S401 of the fourth embodiment, the recording paper P is fed to the recording start position SP based on the recording start length HS that the CPU 32 calculated and stored in the printing start data memory area in S400.

In S402 the CPU 32 acquires the theoretical conveying distances from the interlace cycle data memory area 35*b* corresponding to the recording density stored in the printing information memory area 34*a* and in S403 executes the main scan printing process for printing one band.

In S405-S407, S411, and S412, the CPU 32 conveys the recording paper by a small feed or a large feed based on the value of the feed counter 34*f* and updates the value of the feed counter 34*f* based on the executed feed.

At this time, if printing has been completed for one page (S408: YES), then in S409 the CPU 32 discharges the recording paper P and ends the page printing process. If not (S408: NO), then the CPU 32 returns to S403 to continue the page printing process.

Figure 13:
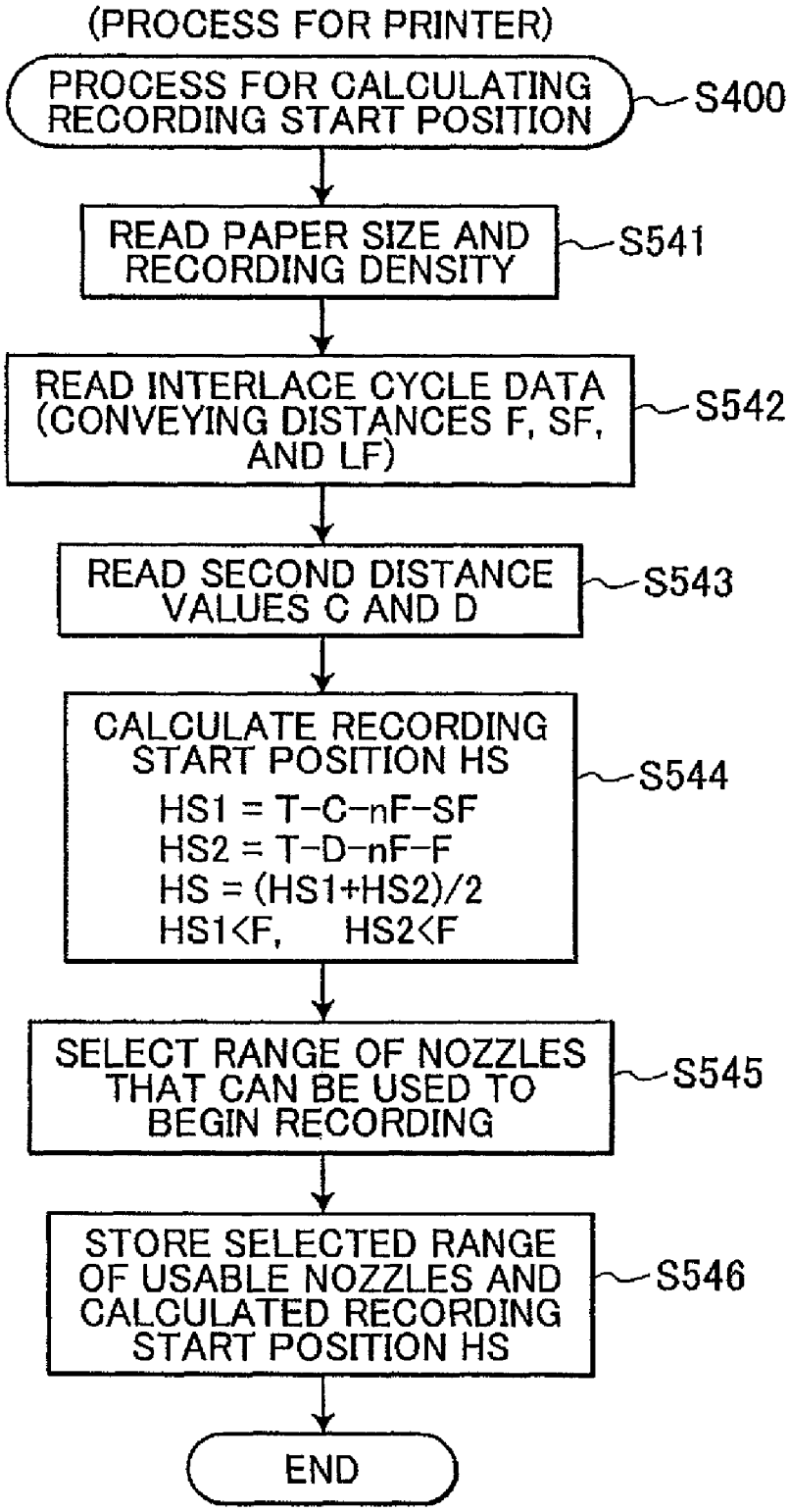
FIG. 13 is a flowchart illustrating steps in a process for calculating a recording start position according to the fourth embodiment executed during the page printing process of FIG. 12.

FIG. 13 is a flowchart illustrating steps in the process for calculating the recording start position according to the fourth embodiment executed in S400 of the page printing process in FIG. 12. In S541 of the beginning of this process, the CPU 32 reads the paper size (paper length T) and recording density stored in the printing information memory area 34*a*. In S542 the CPU 32 reads the interlace cycle data (conveying distances F, SF, and LF) stored in the interlace cycle data memory area 35*b* in association with the recording density read in S541. Further, in S543 the CPU 32 reads the second distance values C and D from the design value memory 35*a*. In S544 the CPU 32 calculates a recording start length HS that satisfies the conditions HS1<F and HS2<F according to the equations HS1=T−C−nF−SF, HS2=T−D−nF−F, and HS=(HS1+HS2)/2. In S545 the CPU 32 selects a range of nozzles that can be used to begin recording based on the recording start length HS calculated in S544 and the nozzle pitch stored in the design value memory 35*a*. In S546 the CPU 32 stores the selected range of usable nozzles and the calculated recording start length HS in the printing start data memory area and ends the process for calculating the recording start position.

Hence, in the page printing process of the fourth embodiment shown in FIG. 12, the leading edge of the recording paper P is fed to the recording start position SP which is positioned downstream of the upstream edge of the inkjet head 6 by the recording start length HS calculated in the process of S400 described above. Further, the range of nozzles selected in the process of S400 are used in place of the normal nozzle range to record the initial band in the main scan printing process of S403.

Figure 14A:
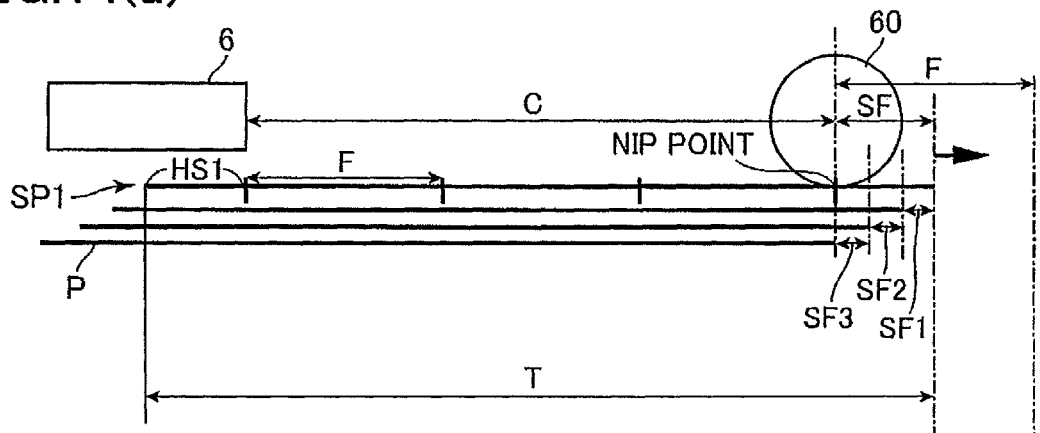
FIG. 14(*a*)-14(*c*) are explanatory diagrams conceptually illustrating the calculation of the recording start position in the process for calculating a recording start position according to the fourth embodiment and a conveying operation of recording paper.
Figure 14B:
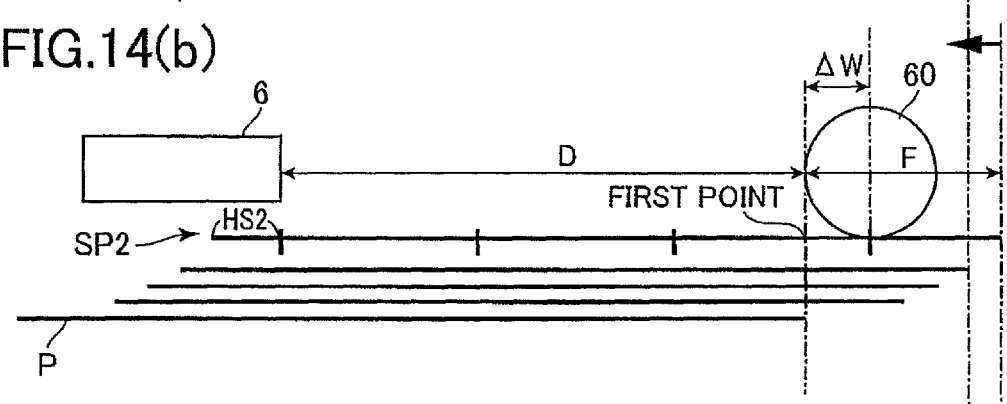
Figure 14C:
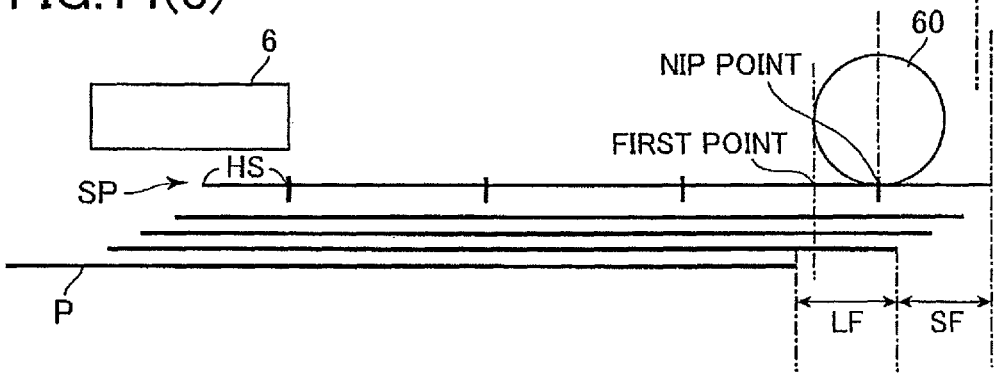

FIG. 14(*a*)-14(*c*) are explanatory diagrams conceptually illustrating the calculation of the recording start length HS according to the process of S400 shown in FIG. 13 and the conveying operation of the recording paper P.

In FIGS. 14(*a*)-14(*c*), the conveying roller 60 is displayed on the right side, and the inkjet head 6 is displayed to the left of the conveying roller 60. A solid line is used to indicate the recording paper P conveyed below the conveying roller 60 and the inkjet head 6. Intervals marked by short vertical lines intersecting the recording paper P indicate the conveying distance F for each interlace cycle. Further, in FIGS. 14(*a*)-14(*c*), the conveyed state of the recording paper P shifted sequentially in the conveying direction is illustrated by displaying a sheet of recording paper P at the position following each feed.

FIG. 14(*a*) illustrates an example of executing a printing operation after feeding the recording paper P to a predetermined recording start position SP1 which is positioned downstream of the upstream edge of the inkjet head 6 by a recording start length HS1. After being fed so that the leading edge of the recording paper P is positioned at the recording start position SP1 the recording paper P is conveyed sequentially downstream by conveying distances F. As shown in FIG. 14(*a*), the trailing edge of the recording paper P is halted directly below the nip point between the conveying rollers 60 (immediately after passing the nip point) after completing the small feeds.

As illustrated in FIG. 14(*a*), if the trailing edge of the recording paper P is positioned upstream of the nip point by a distance of no greater than the total small feed conveying distance SF when beginning an interlace cycle that will pass the trailing edge through the nip point, the trailing edge of the recording paper P cannot be conveyed through the nip point during a large feed. Further, since conveying distance F is the conveying distance for one interlace cycle, the trailing edge of the recording paper P must be positioned between the base of the bold arrow shown in FIG. 14(*a*) and the dotted line to the right of the arrow when beginning an interlace cycle in which the trailing edge of the recording paper P is conveyed through the nip point.

As in the third embodiment described above, the second distance value C is a design value defined by the mechanical structure (specifications) of the printer 1. As shown in FIG. 14(*a*), the second distance value C is the distance from the upstream edge of the inkjet head 6 to the nip point between the conveying rollers 60 (or the same distance plus a margin to account for mechanical tolerance).

In order to ensure that the trailing edge of the recording paper P passes through the nip point during a large feed, it is important to know the length of the portion of the recording paper P positioned upstream of the nip point at the beginning of the printing operation. To determine this length, the second distance value C is subtracted from the paper length T. The result of this subtraction is the sum of the recording start length HS and length of the portion of the recording paper P distributed upstream of the nip point at the beginning of the printing operation.

The trailing edge of the recording paper P must be positioned upstream of the nip point by a distance greater than the total small feed conveying distance SF when beginning an interlace cycle in which the trailing edge of the recording paper P will pass through the nip point. Therefore, the total small feed conveying distance SF, which is a limit for ensuring this length, is subtracted from the sum found above.

During a printing operation, the recording paper P is conveyed from the initially set position at the beginning of the printing operation by the conveying distance F for each interlace cycle so that the trailing edge of the recording paper P approaches the nip point. Hence, if the value obtained by further removing the recording start length HS from the result of subtracting the second distance value C from the paper length T is n times the conveying distance F, then a length of recording paper P equivalent to the total small feed conveying distance SF would be distributed upstream of the nip point at the beginning of an interlace cycle in which the trailing edge of the recording paper P passes through the nip point.

As shown in FIG. 14(*a*) and in S544 of the process to calculate the recording start position in FIG. 13, the recording start length HS1 for positioning the trailing edge of the recording paper P upstream of the nip point between the conveying rollers 60 by the total small feed conveying distance SF is calculated by subtracting the second distance value C, n times the conveying distance F for one interlace cycle, and the total small feed conveying distance SF from the paper length T (HS1=T−C−nF−SF). For simplification, the paper length T shown in FIG. 14 is such that n=0.

As can be seen from FIG. 14(*a*), the recording start length HS1 is an upper limit. By setting the recording start length HS less than this recording start length HS1, that is the recording start position SP is upstream of the recording start position SP1, it is possible to position the trailing edge of the recording paper P beyond the total small feed conveying distance SF from the nip point when beginning an interlace cycle in which the trailing edge will be conveyed through the nip point.

FIG. 14(*b*) shows a method of calculating a recording start length HS2 based on the second distance value D. A recording start position SP2 is defined as a downstream point from the upstream edge of the inkjet head 6 by the recording start length HS2. As in the third embodiment described above, the second distance value D is a design value defined by the mechanical structure (specifications) of the printer 1 and indicates the distance from the first point downstream of the nip point between the conveying rollers 60 and the upstream edge of the inkjet head 6.

In order to halt the recording paper P when the trailing edge of the recording paper P is past the first point downstream of the nip point (downstream of the first point) after the trailing edge has been conveyed through the nip point, it is necessary to ensure that the trailing edge of the recording paper P prior to the beginning of this interlace cycle is positioned upstream of the first point by a distance less than the conveying distance F. In the fourth embodiment, this is achieved by adjusting the position of the trailing edge of the recording paper P at the recording start position SP2 based on the recording start position HS2 when the printing process starts.

To do this, first the second distance value D is subtracted from the paper length T. The result of subtracting the second distance value D from the paper length T is the sum of the recording start length HS2 and the length of the paper length T distributed upstream of the first point at the start of printing. Since the trailing edge of the recording paper P must be positioned upstream of the first point by a distance less than the conveying distance F when beginning an interlace cycle in which the trailing edge will pass through the nip point, the conveying distance F, which is the limit for ensuring this distance, is subtracted from the above sum.

During a printing operation, the recording paper P is conveyed downstream from the set position at the start of the printing operation by the conveying distance F for each interlace cycle. Therefore, if the result of subtracting the recording start length HS from the value obtained by subtracting the second distance value D from the paper length T is n times the conveying distance F, then a length of the recording paper P equivalent to the conveying distance F will be distributed upstream of the first point at the beginning of the interlace cycle in which the trailing edge of the recording paper P passes through the nip point.

As shown in FIG. 14(*b*) and in S544 of the process for calculating the recording start length in FIG. 13, the recording start length HS2 for positioning the trailing edge of the recording paper P upstream of the first point by the conveying distance F is calculated by subtracting the second distance value D, n times the conveying distance F for one interlace cycle, and the conveying distance F again from the paper length T (HS2=T−D−nF−F).

As can be seen from FIG. 14(*b*), the recording start length HS2 is a lower limit. Hence, by setting the recording start length HS larger than the recording start length HS2, that is the recording start position SP is downstream of the recording start position SP2, it is possible to position the trailing edge of the recording paper P upstream of the first point by a distance less than the conveying distance F when beginning the interlace cycle in which the trailing edge passes through the nip point.

Therefore, when the recording start length HS is set less than the recording start length HS1, and the recording start length HS is set larger than the recording start position HS2, that is, the recording start position SP is set between the recording start position SP1 and the recording start position SP2, as shown in FIG. 14(*c*), the recording paper P is conveyed in three small feeds at the conveying distances SF1-SF3, followed by one large feed at the conveying distance LF, so that the trailing edge of the recording paper P passes through the nip point between the conveying rollers 60 during the large feed and is conveyed past the first point downstream of the nip point.

In this way, the printer 1 according to the fourth embodiment can avoid halting the recording paper P when the trailing edge of the recording paper P is at or near the nip point between the conveying rollers 60 by adjusting the recording start position SP according to the paper size. Specifically, the printer 1 according to the fourth embodiment can complete a process to prevent the trailing edge of the recording paper P from being halted near the nip point before the printing operation. Therefore, a control process for adjusting the conveying distance need not be performed during the printing operation. As a result, the fourth embodiment can eliminate both the sensor 50 for detecting the current position of the trailing edge of the recording paper P, and the operation for monitoring the trailing edge of the recording paper P based on detection values from the sensor 50. Hence, in addition to achieving a structure to prevent the trailing edge of the recording paper P being halted near the nip point, the fourth embodiment simplifies the program structure for implementing the conveying operation, thereby simplifying development of the program. The fourth embodiment can also reduce the control load on the CPU 32 during the printing operation.

Accordingly, by positioning the recording paper P at a recording start position SP appropriate for the length of the recording paper P in the conveying direction, the trailing edge of the recording paper P can be conveyed through the nip position between the conveying rollers 60 at the large feed conveying distance LF, even when various types (sizes) of recording media are used. Moreover, the printer 1 can convey the trailing edge of the recording paper P through the nip position at the large feed conveying distance LF simply by setting the leading edge of the recording paper P at the calculated recording start position SP, thereby reliably improving conveying accuracy through a simple method. Further, it is not necessary to add a special device for this purpose, thereby improving conveying precision while reducing costs.

Since the printer 1 conveys the trailing edge of the recording paper P through the nip position between the discharge rollers 60 at the large feed conveying distance LF by positioning the recording paper P at the recording start position SP, the printer 1 can complete the positioning operation before starting recording, thereby reducing the load on the control device during a recording operation.

Next, a fifth embodiment of the present invention will be described with reference to FIGS. 15 and 16. The printer according to the first embodiment described above was configured to ensure that the trailing edge of the recording paper P passes through the nip point between the conveying rollers 60 in a large feed and is conveyed past the first point downstream of the nip point before the recording paper P is halted in order to avoid performing a recording operation when the trailing edge of the recording paper P is at or immediately downstream of the nip point. In other words, the first embodiment prevents drops in recording quality (conveying precision) caused by conveying irregularities that occur as the trailing edge of the recording paper P passes through the nip point between the conveying rollers 60.

The fifth embodiment, on the other hand, prevents drops in recording quality (conveying precision) caused by conveying irregularities that occur when the leading edge of the recording paper P is introduced between the discharge rollers 61 downstream of the inkjet head 6. To achieve this, the fifth embodiment regulates the recording start position SP which is downstream of the upstream edge of the inkjet head 6 by the recording start length HS so that the leading edge of the recording paper P passes through the nip point between the discharge rollers 61 in a large feed and passes a prescribed second point downstream of this nip point before the conveying is halted. In the following description, like parts and components are designated with the same reference numerals to avoid duplicating description.

More specifically, the fifth embodiment eliminates the need of the sensor 50 and the altered conveyance memory area 34*d* used in the first embodiment. Further, the design value memory 35*a* stores third distance values G and H in place of the first distance values A and B for calculating the recording start length HS. The RAM 34 is also provided with a printing start data memory area for storing the calculated recording start length HS. At the start of a printing operation, the leading edge of the recording paper P is set at the recording start position SP which is positioned downstream of the upstream edge of the inkjet head 6 by the recording start length HS stored in the printing start data memory area rather than at a default recording start length HS stored in the design value memory 35*a*.

If the leading edge of the recording paper P is curled when being introduced between the discharge rollers 61, the recording paper P may not enter smoothly into the gap between the upper and lower discharge rollers 61, but may apply a back tension to the spur roller on the upper discharge roller 61 in a direction opposite the rotating direction of the discharge roller 61. This back tension may produce a delay in conveying the recording paper P the prescribed conveying distance (a conveying deficiency). A dramatic drop in recording quality occurs when recording in this state.

However, the conveying distance of the recording paper P is controlled by the drive amount of the linefeed motor 40 or, more specifically, the amount of rotation in the drive gear on the linefeed motor 40 side. The delay in conveying the recording paper P described above is equivalent to play in gear teeth on the discharge roller 61 side engaged with the drive gear. Since the drive gear on the linefeed motor 40 side rotates to the proper position at the correct timing, any delay in conveyance produced by contact between the spur roller and the recording paper P is resolved when the drive gear reaches the correct position. In other words, the conveying delay described above is a temporary irregularity, and the recording paper P has been conveyed the correct conveying distance when the drive gear is rotated to the correct position. Accordingly, the recording paper P is in the correct position at this time.

The printer 1 according to the fifth embodiment is configured to halt conveyance after the leading edge of the recording paper P has passed through the nip point between the discharge rollers 61 in a large feed and has been conveyed past the second point downstream from this nip point. In other words, the recording paper P pass through the nip point between the discharge rollers 61 and is halt after a prescribed time is passed. In this way, the printer 1 can avoid executing a recording operation during conveying irregularities caused by the spur roller and can perform recording at a time when the leading edge of the recording paper P has sufficiently separated from the nip point between the discharge rollers 61 (in other words, when the drive gear has rotated a sufficient drive amount for the recording paper P to recover from the conveying delay and be conveyed the correct conveying distance).

Figure 15:
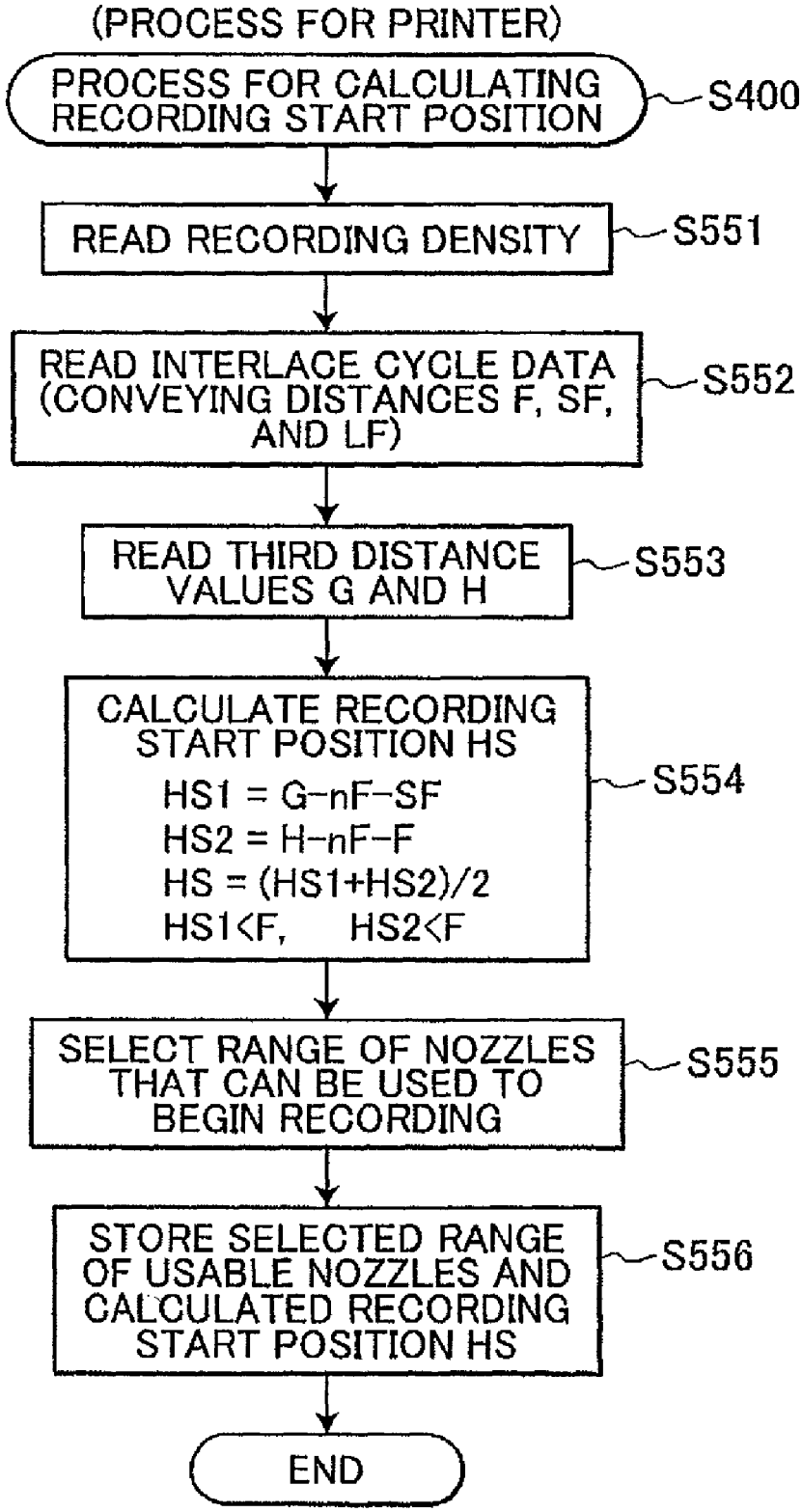
FIG. 15 is a flowchart illustrating steps in a process for calculating the recording start position according to a fifth embodiment.

FIG. 15 is a flowchart illustrating steps in a process for calculating the recording start position of S400 according to the fifth embodiment. The page printing process according to the fifth embodiment is similar to that according to the fourth embodiment shown in FIG. 12, with the process for calculating the recording start position according to the fifth embodiment executed as S400 in this page printing process. Therefore, only the process of S400 according to the fifth embodiment will be described below.

In S551 of the process for calculating a recording start position according to the fifth embodiment, the CPU 32 first reads the recording density stored in the printing information memory area 34*a* and in S552 reads the interlace cycle data (conveying distances F, SF, and LF) stored in the interlace cycle data memory area 35*b* in association with the recording density read in S551. Further, in S553 the CPU 32 reads the third distance values G and H from the design value memory 35*a*.

In S554 the CPU 32 calculates an recording start length HS that satisfies the conditions HS1<F and HS2<F according to the equation HS1=G−nF−FF, HS2=H−nF−F, and HS=(HS1+HS2)/2. In S555 the CPU 32 selects a range of usable nozzles for the start of the recording operation based on the recording start length HS calculated in S554 and the nozzle pitch stored in the design value memory 35*a*. In S556 the CPU 32 stores the selected nozzle range and the calculated recording start length HS in the printing start data memory area and ends the process of S400.

By executing the page printing process shown in FIG. 12 in this way, the printer 1 according to the fifth embodiment feeds the recording paper P until the leading edge of the recording paper P is at the recording start position SP that is positioned downstream of the upstream edge of the inkjet head 6 by the recording start length HS which was stored in the printing start data memory area in S556.

Figure 16A:
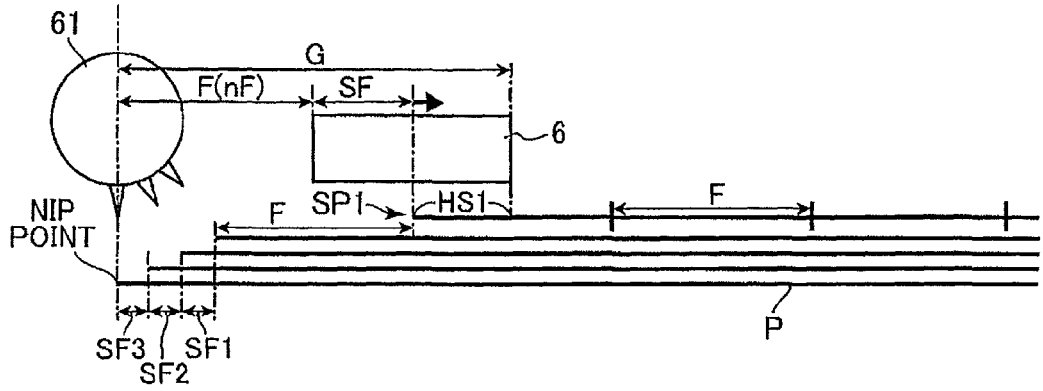
FIG. 16(*a*)-16(*c*) are explanatory diagrams conceptually illustrating the calculation of the recording start position according to the process for calculating a recording start position in the fifth embodiment and the conveying operation of the recording paper.
Figure 16B:
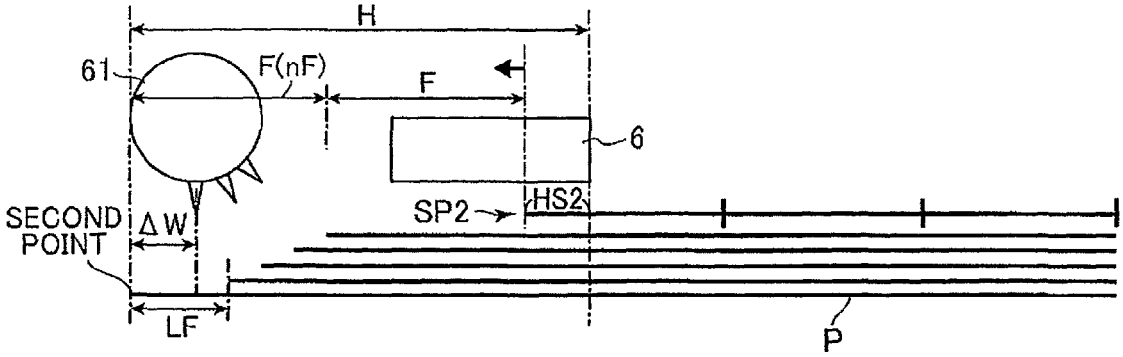
Figure 16C:
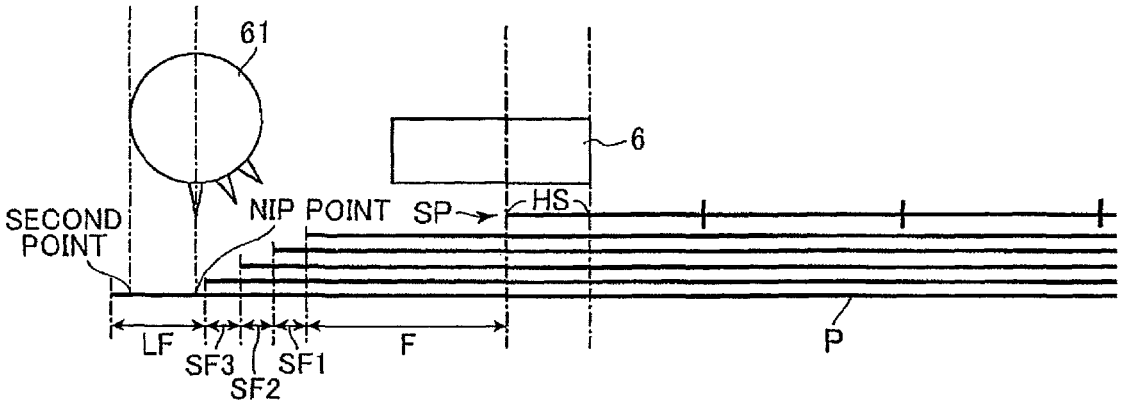

FIG. 16 is an explanatory diagram conceptually illustrating the calculation of the recording start length HS in the process of S400 shown in FIG. 15 and the conveying operation of the recording paper P.

In each of FIG. 16(*a*)-16(*c*), a spur roller, which is the upper roller in the discharge rollers 61, is displayed on the left side, and the inkjet head 6 is displayed to the right of the spur roller. A solid line is used to indicate the recording paper P conveyed below the inkjet head 6 and the spur roller. Intervals marked by short vertical lines intersecting the recording paper P indicate the conveying distance F for each interlace cycle. Further, in FIGS. 16(*a*)-16(*c*), the conveying state of the recording paper P sequentially shifted in the conveying direction is illustrated by displaying a sheet of the recording paper P at the position following each feed.

FIG. 16(*a*) illustrates the example of a printing operation executed after feeding the recording paper P to a recording start length SP1 which is positioned downstream of the upstream edge of the inkjet head 6 by a predetermined recording start length HS1. In this example, the recording paper P is conveyed, from the recording start position SP1, downstream by the conveying distance F for each interlace cycle, wherein one interlace cycle comprises three small feeds and one large feed. Consequently, the leading edge of the recording paper P becomes positioned directly below the nip point between the discharge rollers 61 (immediately after passing through the nip point) at the end of one of the small feeds.

As illustrated in FIG. 16(*a*), the leading edge of the recording paper P cannot be conveyed through the nip point between the discharge rollers 61 in a large feed if the leading edge is positioned upstream of the nip point by a distance no greater than the total small feed conveying distance SF when beginning the interlace cycle in which the leading edge passes through the nip point. In other words, in order to ensure that the leading edge of the recording paper P passes through the nip point of the discharge rollers 61 in a large feed, it is necessary to position the leading edge upstream of the nip point by a distance greater than the total small feed conveying distance SF (but less than the conveying distance F) at the start of the interlace cycle in which the leading edge passes through the nip point.

As described above, the recording paper P is conveyed sequentially downstream from the recording start position SP by intervals of the conveying distance F. Therefore, if the leading edge of the recording paper P is positioned at the recording start position SP1 upstream of the nip point between the discharge rollers 61 by a distance nF+SF at the beginning of a printing operation, then the leading edge of the recording paper P can be set in a position upstream of the nip point by the total small feed conveying distance SF at the start of the interlace cycle in which the leading edge passes through the nip point.

Hence, the recording start position SP1 indicates the position for setting the leading edge of the recording paper P upstream of the hip point between the discharge rollers 61 by the total small feed conveying distance SF at the start of the interlace cycle in which the leading edge passes through the nip point.

As in the third and fourth embodiments described above, the third distance value G is a design value defined by the mechanical structure (specifications) of the printer 1. As shown in FIG. 16(*a*), the third distance value G is the distance from the upstream edge of the inkjet head 6 to the nip point between the discharge rollers 61 (or the same distance plus a margin to account for mechanical tolerance).

Therefore, the recording start length HS1 can be found by subtracting (nF+SF) from the third distance value G, as shown in FIG. 16(*a*) (see S554 of FIG. 15).

As can be seen in FIG. 16(*a*), the recording start length HS1 is an upper limit. Hence, the leading edge of the recording paper P can be positioned upstream of the nip point between the discharge rollers 61 by at least the conveying distance SF when beginning the interlace cycle in which the leading edge passes through the nip point by setting the recording start length HS less than the recording start length HS1 (in other words, by setting the distance in which the leading edge of the recording paper P extends downstream from the upstream edge of the inkjet head 6 less than the recording start length HS1). In this way, it is possible to convey the leading edge of the recording paper P through the nip point between the discharge rollers 61 in a large feed (conveying distance LF).

However, as illustrated in FIG. 16(*b*), it is not possible to shift the recording paper P so that the leading edge is positioned past (downstream of) the second point described above after the leading edge passes through the nip point in a large feed (conveying distance LF) if the leading edge of the recording paper P is positioned upstream of the second point by a distance greater than or equal to the conveying distance F at the beginning of the interlace cycle in which the leading edge passes through the nip point.

However, by placing the leading edge of the recording paper P at a recording start position SP2, which is positioned downstream of the upstream edge of inkjet head 6 by a recording start length HS2, at the start of a printing operation, where the recording start position SP2 is a position upstream of the second point by the distance nF+F, the leading edge of the recording paper P will be positioned at the second point upon completion of the interlace cycle in which the leading edge passes through the nip point.

In other words, the recording start position SP2 marks the position from which the leading edge of the recording paper P can be transferred to the second point downstream of the nip point between the discharge rollers 61 by conveying the recording paper P in an interlace cycle that passes the leading edge through the nip point.

As in the third and fourth embodiments described above, the third distance value H is a design value defined by the mechanical structure (specifications) of the printer 1 and represents the distance from the second point downstream of the nip point between the discharge rollers 61 and the upstream edge of the inkjet head 6. In other words, the third distance value H is a value obtained by adding a distance ΔW to the third distance value G, where ΔW is a distance for avoiding the leading edge of the recording paper P being positioned near the nip point when conveying is halted.

Therefore, as shown in FIG. 16(*b*), the recording start length HS2 can be found by subtracting (nF+F) from the third distance value H (see S554 of FIG. 15).

As can be seen in FIG. 16(*b*), the recording start length HS2 is a lower limit. Hence, the leading edge of the recording paper P can be positioned upstream of the second point by a distance less than the conveying distance F at the beginning of the interlace cycle in which the leading edge passes through the nip point by setting the recording start length HS larger than the recording start length HS2 (in other words, by setting the distance in which the recording paper P extends downstream from the upstream edge of the inkjet head 6 greater than the recording start length HS2). In other words, the recording paper P can be conveyed in a large feed (conveying distance LF) so that the leading edge stops downstream of the second point after passing through the nip point.

Therefore, by setting the recording start length HS less than the recording start length HS1 and the recording start length HS larger than the recording start length HS2, that is, by setting the recording start position SP between the recording start position SP1 and the recording start position SP2, as shown in FIG. 16(*c*), the recording paper P can be conveyed in a large feed so that the leading edge passes through the nip point between the discharge rollers 61 and is halted at a position beyond the second point downstream of the nip point.

The printer 1 according to the fifth embodiment can prevent the leading edge of the recording paper P from being halted at or near the nip point between the discharge rollers 61. Even if conveying irregularities occur as the leading edge of the recording paper P is introduced between the discharge rollers 61, the printer 1 according to the fifth embodiment can ensure that recording is performed after such irregularities have been resolved, thereby producing printed materials with a high recording quality.

Therefore, the printer 1 can avoid performing recording operations with the recording means after halting conveyance of the recording paper P at a timing when the leading edge of the recording paper P contacts the discharge rollers 61 or directly thereafter. Although the conveying distance of the recording paper P depends primarily on the operational amount of the discharge rollers 61, the leading edge of the recording paper P can apply a load to the discharge rollers 61 in a direction opposite the operational direction of the discharge rollers 61 when the leading edge of the recording paper P contacts the same, causing a variation in the conveying distance. Specifically, the load applied to the discharge rollers 61 when the leading edge of the recording paper P contacts the same can delay the recording paper P from reaching its prescribed conveying distance, thereby reducing conveying precision. However, the printer 1 allows the recording paper P to recover from this temporary delay by not halting the conveying operation in such a state of poor conveying precision. As a result, the printer 1 can halt conveyance of the recording paper P when the operations of the discharge rollers 61 have conveyed the recording paper P the correct conveying distance. Therefore, the recording paper P can be set in the correct recording position when a recording operation. That is, the recording paper P can be conveyed with high accuracy, thereby producing a printed product of a high recording quality.

The recording paper P can be placed at the original (designed) recording position when executing the large feed. In other words, the printer 1 can convey the recording paper P with high accuracy to the designed recording position, thereby improving the recording quality.

Further, since a sufficient gap is ensured between the timing at which the leading edge of the recording paper P passes through the nip position between the discharge rollers 61 and the timing for halting conveyance (contact position and halting position), there is no occurrence of conveyance being halted at a timing in which the leading edge of the recording paper P passes the nip position between the discharge rollers 61 or a timing directly thereafter, even if the actual timing for halting conveyance deviates slightly from the design value due to mechanical error. Therefore, the present invention eliminates the need for advanced control to strictly match the actual timing for halting conveyance with the design timing, thereby eliminating the need for rigorous precision when manufacturing parts used in the conveying operation and high precision sensors and the like for determining the position of the trailing edge of the recording paper P. Accordingly, the present invention can simplify the manufacturing process and the device structure, thereby keeping manufacturing costs low.

Since the data such as the recording start length HS, once generated, can be used repeatedly, thereby reducing the number of times the conveyance control data must be generated. As a result, the present invention can increase the data processing speed for controlling conveyance and can reduce the time required for the overall recording operation.

The recording paper P can be placed in the proper recording start position SP so that the leading edge of the recording paper P passes through the nip position between the discharge rollers 61 during the large feed. Further, the printer 1 can convey the leading edge of the recording paper P through the nip position between the discharge rollers 61 during the large feed simply by setting the leading edge of the recording paper P in the recording start position SP at the start of the recording operation, thereby reliably improving conveying precision through a simple technique. Further, there is no need to add a special device, thereby improving conveying precision at a low cost.

Figure 18:
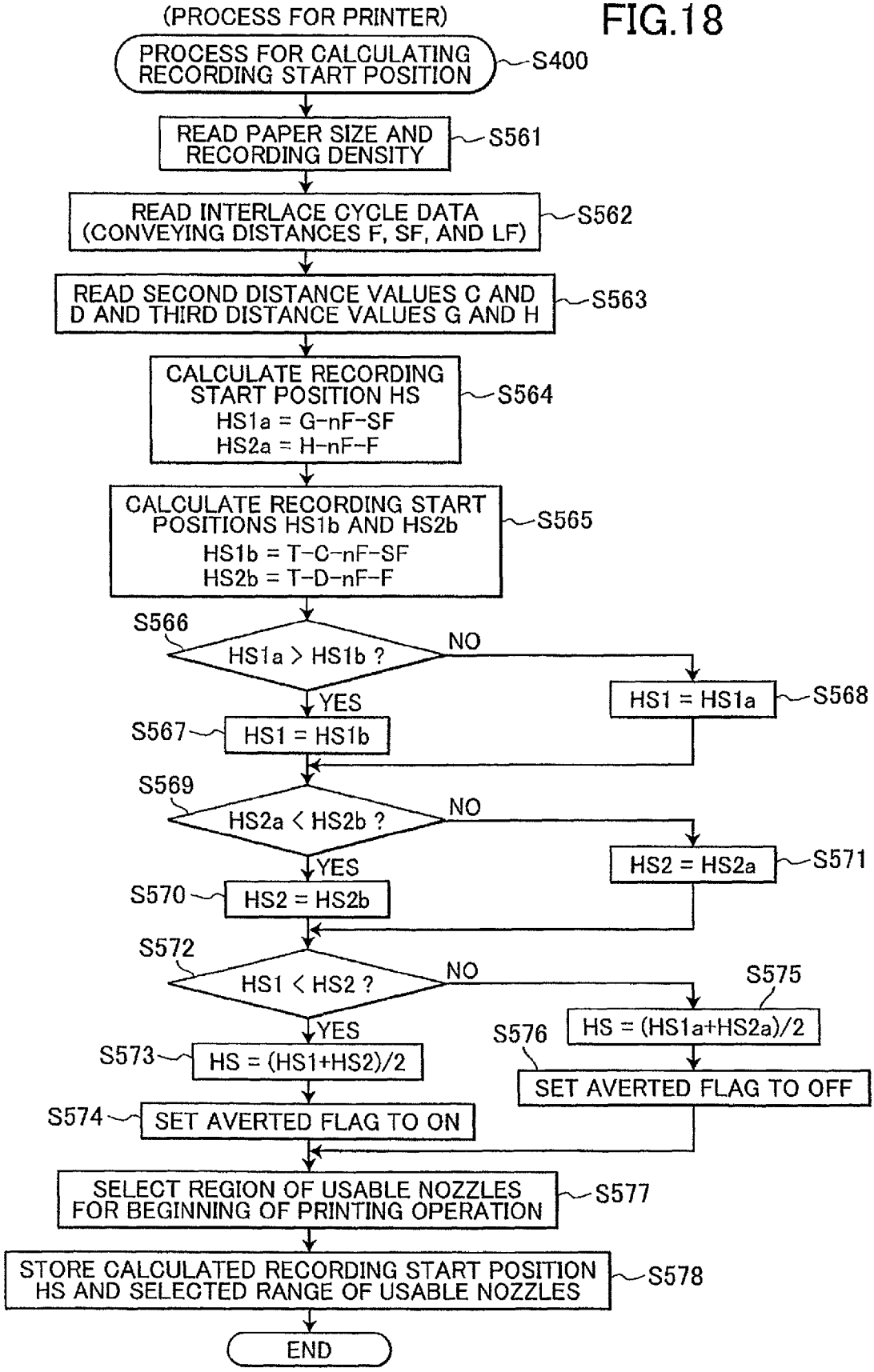
FIG. 18 is a flowchart illustrating steps in a process for calculating the recording start position according to the sixth embodiment executed during the page printing process of FIG. 17.

Next, a sixth embodiment of the present invention will be described with reference to FIGS. 17 through 19. In the first embodiment described above, the printer 1 was configured to convey the recording paper P so that the trailing edge of the recording paper P passes through the nip point between the conveying rollers 60 in a large feed and is halted beyond the first point downstream of the nip point, thereby avoiding recording operations performed when the trailing edge of the recording paper P is at or immediately downstream of the nip point. In addition to this configuration, the printer 1 according to the sixth embodiment is configured to prevent a drop in recording quality (conveying precision) caused by conveying irregularities that occur when the leading edge of the recording paper P is introduced between the discharge rollers 61 downstream of the inkjet head 6. In the following description, like parts and components have been designated with the same reference numerals to avoid duplicating description.

More specifically, the sixth embodiment eliminates the need of the sensor 50 provided in the printer 1 according to the first embodiment. The design value memory 35*a* stores the second distance values C and D and the third distance values G and H in order to calculate a recording start length HS, which is a distance between a recording start position SP and the upstream edge of the inkjet head 6, by which recording can be executed without the conveying irregularities produced by the conveying roller 60 (trailing edge of the recording paper P) and the discharge rollers 61 (leading edge of the recording paper P). The second distance values C and D are the same constants used in the third embodiment, while the third distance values G and H are the same constants used in the fifth embodiment.

Further, the RAM 34 is provided with a printing start data memory area for storing the calculated recording start length HS. At the beginning of a printing operation, the printer 1 according to the sixth embodiment sets the leading edge of the recording paper P at the recording start length SP which is positioned downstream of the upstream edge of the inkjet head 6 by the recording start length HS stored in this printing start data memory area instead of using the recording start length HS as a default recording start length HS stored in the design value memory 35*a*.

Further, since the timing of an altered conveying operation is performed based on when the leading edge of the recording paper P passes through the spur roller in the sixth embodiment, the modification flag 34*h* is set to ON when the leading edge of the recording paper P passes the spur roller rather than when the altered conveying distance CF is calculated. The modification flag 34*h* is reset to OFF after completing the large feed conveying operation according to the altered conveying distance CF.

The RAM 34 also includes an averted flag. The averted flag indicates whether both conveying irregularities caused by the leading edge of the recording paper P and conveying irregularities caused by the trailing edge of the recording paper P were avoided.

The averted flag is cleared (set to OFF, or 0) at the beginning of a page printing process. In the process for calculating the recording start position in S400 of the page printing process, the averted flag is set to ON when the printer 1 was able to calculate an recording start length HS that decide a recording start position SP1 that satisfies the following two conditions. The first condition is that the leading edge of the recording paper P introduced between the discharge rollers 61 passes the nip point of the discharge rollers 61 in a large feed and is halted at a position past the second point downstream of the nip point. The second condition is that the trailing edge of the recording paper P introduced between the conveying rollers 60 passes through the nip point between the conveying rollers 60 in a large feed and is halted at a position past the first point downstream of the nip point.

Hence, the averted flag is set to ON when the printer 1 has calculated an recording start length HS that satisfies both of these conditions, but is left off when such a recording start length HS could not be calculated.

In the page printing process according to the sixth embodiment, the CPU 32 references the state of the averted flag and executes an altered conveying operation at a prescribed timing if the flag indicates that a recording start length HS satisfying the two conditions could not be calculated. After executing the altered conveying operation, the printer 1 is capable of avoiding conveying irregularities caused by both the leading edge and the trailing edge of the recording paper P. Therefore, the printer 1 sets the averted flag to ON at this time.

FIG. 17 is a flowchart illustrating steps in a page printing process according to the sixth embodiment. As in the first embodiment, the page printing process according to the sixth embodiment is initiated upon completing reception of print data. At the beginning of the page printing process in S400, the CPU 32 executes a process to calculate the recording start length HS that decides the recording start position SP for positioning the leading edge of the recording paper P.

In S401 the CPU 32 drives the linefeed motor 40 for feeding the recording paper P until the leading edge of the recording paper P is positioned at the recording start position SP that is positioned downstream of the upstream edge of the inkjet head 6 by the recording start length HS which was calculated and stored in the printing start data memory area in the process of S400. In S402 the CPU 32 acquires the theoretical conveying distances from the interlace cycle data memory area 35*b* corresponding to the recording density stored in the printing information memory area 34*a*, and in S403 executes the main scan printing process for printing one band.

In S404 the CPU 32 determines whether the modification flag 34*h* is on. If off (S404: NO), indicating that it is not time to execute the altered conveying operation, then in S405-S407, S411, and S412 the CPU 32 executes a feeding operation corresponding to the value of the feed counter 34*f* and subsequently updates the value of the feed counter 34*f* based on the executed feed. In S408 the CPU 32 determines whether the page printing process has been completed. If the entire page has been printed (S408: YES), then in S409 the CPU 32 discharges the recording paper P and ends the page printing process.

However, if the CPU 32 determines in S404 that the modification flag 34*h* is on (S404: YES), indicating that it is time to execute a conveying operation based on the altered conveying distance CF, then in S480 the CPU 32 drives the linefeed motor 40 for conveying the recording paper P by the conveying distance stored in the altered conveyance memory area 34*d* corresponding to the value of the feed counter 34*f*.

In S481 the CPU 32 determines whether the value of the feed counter 34*f* is less than 3. If the conveying distance F is less than 3 (S481: YES), then in S482 the CPU 32 increments the feed counter 34*f* by 1 and advances to S408. However, if the value of the feed counter 34*f* is 3 or greater (S481: NO), then in S483 the CPU 32 sets the modification flag 34*h* to OFF and advances to S412.

Further, if the CPU 32 determines in S408 that the page printing process is not complete (S408: NO), then in S484 the CPU 32 determines whether the averted flag is on. If the averted flag is on (S484: YES), then the leading edge of the recording paper P sets at the recording start position SP which is positioned downstream of the upstream edge of the inkjet head 6 by the recording start length HS calculated in S400. Accordingly, the leading edge of the recording paper P introduced between the discharge rollers 61 will pass through the nip point of the discharge roller 61 in a large feed and stop at a position past the second point downstream from this nip point, while the trailing edge of the recording paper P introduced between the conveying rollers 60 will pass through the nip point between the conveying rollers 60 in a large feed and stop at a position past the first point downstream from this nip point.

In other words, an averted flag set to ON indicates that the printer 1 can avoid recording operations performed when conveying precision is poor simply by executing conveying operations at the theoretical conveying values LF and SF after setting the leading edge of the recording paper P at the recording start position SP based on the calculated recording start length HS for the beginning of the printing process. Therefore, when the averted flag is on, the CPU 32 skips the processes in S485-S488 and returns to S403.

However, if the CPU 32 determines in S484 that the averted flag is off (S484: NO), then it was not possible to calculate an recording start length HS that avoids both conveying irregularities that occur when the recording paper P is introduced between the discharge rollers 61 and conveying irregularities that occur when the trailing edge of the recording paper P is introduced between the conveying rollers 60. In the process of S400 for calculating the recording start position according to the sixth embodiment, which will be described later with reference to FIG. 18, the printer 1 sets the recording start length HS to avoide the conveying irregularities that occur when the leading edge of the recording paper P is introduced between the discharge rollers 61 when it is not possible to calculate a recording start length HS capable of avoiding both conveying irregularities.

Therefore, if the averted flag is off, then in S485 the CPU 32 determines whether the leading edge of the recording paper P has passed the spur roller. In other words, the CPU 32 determines whether the interlace cycle in which the leading edge of the recording paper P is conveyed past the spur roller has been completed. If the leading edge of the recording paper P has not yet passed the spur roller (S485: NO), then the CPU 32 maintains the current conveying state by returning to S403.

However, if the CPU 32 determines in S485 that the leading edge of the recording paper P has passed the spur roller (S485: YES), then in S486 the CPU 32 sets the modification flag 34*h* on in order to execute the altered conveying operation for ensuring that the trailing edge of the recording paper P passes through the nip point between the conveying rollers 60 during a large feed and is halted at a position past the first point downstream of the nip point.

Further, when the modification flag 34*h* is set to ON, the next large feed conveying operation will be executed based on the altered conveying distance CF. When the subsequent conveying operation is executed according to the theoretical conveying distances LF and SF, the trailing edge of the recording paper P introduced between the conveying rollers 60 will pass through the nip point between the conveying rollers 60 in a large feed and be halted at a position past the first point, thereby avoiding a recording operation when the conveying accuracy is poor. Hence, in S487 the CPU 32 indicates this by setting the averted flag to ON. In S488 the CPU 32 executes the process for setting the altered conveying distance.

The process in S488 for setting the altered conveying distance according to the sixth embodiment is identical to the process in S470 according to the third embodiment. The altered conveying distance CF is calculated in this process when beginning a conveying operation in which the trailing edge of the recording paper P will pass through the nip point between the conveying rollers 60. By executing the altered conveying operation once based on this altered conveying distance CF, the trailing edge of the recording paper P is positioned within a prescribed range upstream of the conveying rollers 60 (a position from which the trailing edge of the recording paper P will pass through the nip point between the conveying rollers 60 in a large feed and be halted at a position past the first point). After completing the process for setting the altered conveying distance in S488, the CPU 32 returns to S403 to perform the main scan printing process. Since the RAM 34 is set to ON at this time, the CPU 32 advances to S480 and executes a conveying operation based on the altered conveying distance CF that was stored in the altered conveyance memory area 34*d* during the process of S488.

Since the averted flag is on and the modification flag 34*h* is off after completing the altered conveying operation (S484: YES), the CPU 32 skips the process beginning from S485 and, hence, does not set the modification flag 34*h* to ON. Thereafter, the CPU 32 repeatedly executes a conveying operation for conveying the recording paper P according to the theoretical conveying distances LF and SF until the page printing process is complete.

Next, a process for selecting the recording start length HS according to the sixth embodiment will be described with reference to FIGS. 18 and 19. FIG. 18 is a flowchart illustrating steps in the process for calculating the recording start position according to the sixth embodiment executed in S400 of the page printing process shown in FIG. 17. FIG. 19 is an explanatory diagram conceptually illustrating an example of the recording start length HS calculated in the process of S400.

In the process of S400 according to the sixth embodiment, the CPU 32 calculates a common recording start length HS with which the printer 1 can perform recording operations while avoiding the conveying irregularities that might occur when the leading edge or trailing edge of the recording paper P passes through the conveying rollers 60 or discharge rollers 61. In S561 of the process in FIG. 18, the CPU 32 reads the paper size and recording density stored in the printing information memory area 34*a*.

In S562 the CPU 32 reads the interlace cycle data (conveying distances F, SF, and LF) from the interlace cycle data memory area 35*b* corresponding to the recording density read in S561. In S563 the CPU 32 reads the second distance values C and D and the third distance values G and H from the design value memory 35*a*.

In S564 the CPU 32 calculates recording start lengths HS1*a* and HS2*a* based on the leading edge of the recording paper P using the equations HS1*a*=G−nF−SF, and HS2*a*=H−nF−F. The recording start lengths HS1*a* and HS2*a* are identical to the recording start lengths HS1 and HS2 calculated in S554 of the process for calculating recording start positions according to the fifth embodiment. The recording start lengths HS1*a* and HS2*a* indicate the upper limit and lower limit of a distance between the upstream edge of the inkjet head 6 and the recording start position for the leading edge of the recording paper P from which position the leading edge can be conveyed through the nip point between the discharge rollers 61 during a large feed and halted at a position past the second point downstream from the nip point.

In S565 the CPU 32 calculates recording start lengths HS1*b* and HS2*b* based on the trailing edge of the recording paper P according to the equations HS1*b*=T−C−nF−SF and HS2*b*=T−D−nF−F. The recording start lengths HS1*b* and HS2*b* are identical to the recording start lengths HS1 and HS2 calculated in S544 of the process for calculating recording start positions according to the fourth embodiment. The recording start positions HS1*b* and HS2*b* indicate the upper limit and lower limit of a distance between the upstream edge of the inkjet head 6 and the recording start position for the trailing edge of the recording paper P from which position the trailing edge can pass through the nip point of the conveying roller 60 in a large feed and be halted at a position past the first point downstream of the nip point.

Through the processes in S564 and S565 described above, the CPU 32 provisionally calculates the four recording start lengths HS1*a*, HS2*a*, HS1*b*, and HS2*b*. FIGS. 19(*a*)-19(*d*) show examples of these recording start lengths HS1*a*, HS2*a*, HS1*b*, and HS2*b*. In FIG. 19(*a*)-19(*d*), the leading edge (downstream side) of the recording paper in the conveying direction is positioned on the left, while the trailing edge (downstream side) is positioned on the right. The solid lines aligned with the conveying direction on the recording paper P indicate the conveying paths for the first pass (1P) through the fourth pass (4P).

Figures 19A, 19B, 19C, 19D, 19E:
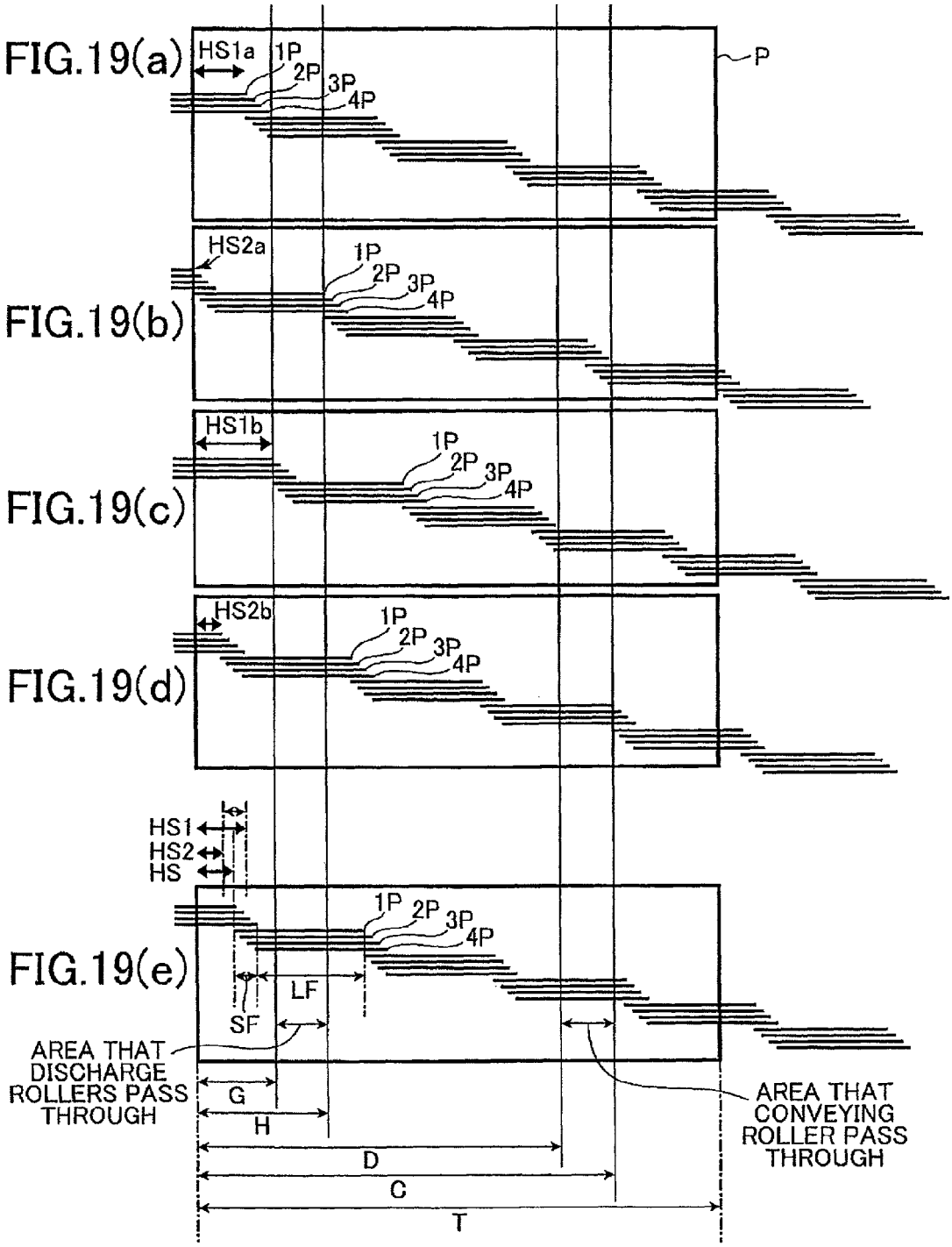
FIG. 19(*a*)-19(*e*) are explanatory diagrams conceptually illustrating an example of a recording start position calculated in the process for calculating a recording start position according to the sixth embodiment.

As shown in FIG. 19(*a*), the recording start length HS1*a* is assigned the distance indicated by the double arrow. Since the recording start position is the distance from the upstream edge of the inkjet head 6 to the leading edge of the recording paper P, the position indicated at the right end of the double arrow for the recording start length HS1*a* corresponds to the upstream edge of the inkjet head 6. As shown in FIG. 19(*b*), the recording start length HS2*a* is 0. Hence, if the recording start position is decided by the recording start length HS2, then the leading edge of the recording paper P is positioned to correspond to the upstream edge of the inkjet head 6.

As described in detail in the fifth embodiment, the recording start length HS must be set in a range greater than the recording start length HS2*a* and less than the recording start length HS1*a* in order to position the recording paper P so that the leading edge of the recording paper P passes through the nip point between the discharge rollers 61 during a large feed and is halted at a position past the second point downstream of the nip point. Therefore, the range from the leading edge of the recording paper P to the right end of the double arrow for the recording start length HS1*a* in FIG. 19(*a*) indicates suitable positions for the recording start position based on the leading edge of the recording paper P.

Similarly, as shown in FIG. 19(*c*), the recording start length HS1*b* is assigned to the distance indicated by the double arrow. The recording start length HS2*b* is assigned the distance indicated by the double arrow in FIG. 19(*d*). As described in detail in the fourth embodiment, the recording start length HS must be set within a range greater than the recording start length HS2*b* and less than the recording start length HS1*b* in order to position the recording paper P so that the trailing edge of the recording paper P passes through the nip point between the conveying rollers 60 during a large feed and is halted at a position past the first point downstream of the nip point. Therefore, the range from the right edge of the double arrow for the recording start length HS2*b* to the right edge of the double arrow for the recording start length HS1*b* in FIGS. 19(*c*) and 19(*d*) indicates appropriate positions for the recording start position based on the trailing edge of the recording paper P.

In order to calculate a common region between the recording start positions calculated based on the leading edge of the recording paper P and the trailing edge of the recording paper P that satisfies the conditions described above, in S566 the CPU 32 determines whether the recording start length HS1*a* is greater than the recording start length HS1*b* (HS1*a*>HS1*b*). If HS1*a*>HS1*b* (S566: YES), then in S567 the CPU 32 sets the recording start length HS1 to the smaller recording start length HS1*b*. Conversely, if HS1*a* HS1*b* (S566: NO), then in S568 the CPU 32 sets the recording start length HS1 to the smaller recording start length HS1*a*.

With this calculation method, the recording start length HS1*a* is a value greater than the recording length position HS2*a*, and the recording start length HS1*b* is similarly a greater value than the recording start length HS2*b*. Hence, by selecting the smaller of the recording start length HS1*a* and recording start length HS1*b*, it is possible to extract the common region between the two. In the example of FIG. 19, the recording start length HS1*a* is selected as the recording start length HS1 (see FIG. 19(*e*)).

After setting the recording start length HS1 in S567 or S568, the CPU 32 determines in S569 whether the recording start length HS2*a* is smaller than the recording start length HS2*b* (HS2*a*<HS2*b*). If HS2*a*<HS2*b* (S569: YES), then in S570 the CPU 32 sets the recording start length HS2 to the larger recording start length HS2*b*. Conversely, if HS2*a*>HS2*b* (S569: NO), then in S571 the CPU 32 sets the recording start length HS2 to the larger recording start length HS2*a*.

After setting the recording start length HS2 in S570 or S571, the CPU 32 determines in S572 whether the calculated recording start length HS1 is greater than the recording start length HS2 (HS1>HS2). If HS1>HS2 (S572: YES), then the recording start length HS1 and recording start length HS2 serve as upper and lower limits, respectively. That is, the range between the recording start length HS1 and recording start length HS2 is a common region for the recording start position SP. Therefore, in S573 the CPU 32 computes the recording start length HS based on the average of the recording start length HS1 and recording start length HS2 (HS=(HS1+HS2)/2).

In S574 the CPU 32 sets the averted flag to indicate that a single common recording start position SP has been set based on both the leading and trailing edges of the recording paper P, that is, that recording operations at low conveying precision can be avoided. In S577 the CPU 32 selects a region of usable nozzles for the beginning of the printing operation based on the computed recording start length HS (the recording start length HS calculated in either S573 or S575) and the nozzle pitch stored in the design value memory 35*a*. In S578 the CPU 32 stores the calculated recording start length HS and the selected range of usable nozzles in the printing start data memory area and subsequently ends the process of S400. FIG. 19(*e*) illustrates an example of the recording paper P positioned at the common recording start position SP by the recording start length HS calculated in the above process. By positioning the recording paper P in this way, a conveying operation according to a large feed can be executed either in the region in which the leading edge of the recording paper P passes through the discharge rollers 61 or in the region in which the trailing edge of the recording paper P passes through the conveying rollers 60, and the corresponding edge of the recording paper P can be halted at a position sufficiently separated from the corresponding nip point.

However, if the CPU 32 determines in S572 that HS1 HS2 (S572: NO), then this indicates that there is no common region between the recording start length calculated based on the leading edge of the recording paper P and the recording start length calculated based on the trailing edge of the recording paper P. In other words, this indicates that it is not possible to calculate an recording start length HS capable of avoiding both conveying irregularities occurring when the leading edge of the recording paper P is introduced between the discharge rollers 61 and conveying irregularities occurring when the trailing edge of the recording paper P is introduced between the conveying rollers 60. This is because the recording start length HS must fall within the range greater than the recording start length HS2 and less than the recording start length HS1.

In this case, in S575 the CPU 32 sets a recording start length HS appropriate for introducing the leading edge of the recording paper P between the discharge rollers 61 in order to avoid conveying irregularities that occur when the leading edge of the recording paper P is introduced between the discharge rollers 61 (HS=(HS1*a*+HS2*a*)/2). In S576 the CPU 32 sets the averted flag to OFF, indicating that the recording start position SP has been set to a position based on the leading edge of the recording paper P, that is, that a single recording start length HS cannot be set based on both the leading edge and trailing edge of the recording paper P. Subsequently, the CPU 32 advances to S577.

When executing a page printing process after setting the recording paper P to the recording start position SP decided by the recording start length HS calculated based on the leading edge of the recording paper P, it is necessary to adjust the conveying position of the recording paper P prior to an interlace cycle in which the trailing edge of the recording paper P passes through the nip point between the conveying rollers 60. Therefore, after the leading edge of the recording paper P passes the spur roller in the page printing process of the sixth embodiment, the CPU 32 executes the altered conveying process of S488 (see FIG. 17), similar to the process of S470 in the third embodiment (see FIG. 10).

In this way, it is possible to set the recording paper P so that the trailing edge passes through the conveying rollers 60 during a large feed (conveying distance LF). Further, after the leading edge of the recording paper P passes through the nip point between the discharge rollers 61, the recording paper P is halted with the leading edge positioned downstream of the nip point by a distance greater than that indicated by the third distance value H. Similarly, after the trailing edge of the recording paper P passes through the nip point between the conveying rollers 60, the recording paper P is halted with the trailing edge positioned downstream of the nip point by a distance greater than that indicated by the second distance value D.

In this way, the printer 1 according to the sixth embodiment can perform recording that avoids conveying irregularities occurring when either the leading or trailing edge of the recording paper P is introduced between the discharge rollers 61 or the conveying rollers 60, thereby producing a printed product of high recording quality.

While the invention has been described in detail with reference to specific embodiments thereof, it would be apparent to those skilled in the art that many modifications and variations may be made therein without departing from the spirit of the invention, the scope of which is defined by the attached claims.

For example, when performing two or more small feeds in a conveying operation, it is possible to set one or more of the small feeds to a different conveying distance rather than setting all small feeds to the same distance.

Further, while the preferred embodiments described above define one interlace cycle as a combination of three small feeds and one large feed, the combination of feeds is not limited to this combination. However, if the number and order of feeds is altered, then the positions of the trailing edge and leading edge of the recording paper P should be appropriately modified based on the first through third distance values and each feeding distance for conveying operations in which the trailing edge of the recording paper P passes through the nip point between the conveying rollers 60 and in which the leading edge of the recording paper P passes through the nip point between the discharge rollers 61.

In the page printing process according to the fourth through sixth embodiments, the printer 1 is configured to convey the recording paper P to the recording start position SP based on the calculated recording start position HS in a single conveying operation through a step provided for feeding the recording paper P. However, the recording paper P may be conveyed to the recording start position in a plurality of conveying operations rather than a single conveying operation. It is also possible to perform at least part of the plurality of conveying operations in a separate step for conveying the recording paper P (such as at least part of the plurality of conveying operations performed in an interlace cycle).

While the image-forming device of the present invention is a color inkjet printer in the preferred embodiments described above, the image-forming device of the present invention may also be a dot impact printer, a thermal printer, or the like.

In the preferred embodiments described above, the print control program 33*a* is installed on the printer 1 so that the printer 1 can compute the altered conveying distance CF and recording start length HS. However, it is also possible to provided the personal computer 100 with algorithms for calculating the altered conveying distance CF and recording start length HS based on the paper size. After the personal computer 100 outputs the calculated altered conveying distance CF and recording start length HS to the printer 1, the printer 1 can be configured to convey the recording paper P as described in the preferred embodiments.

Although the recording start length HS is calculated at the beginning of each printing operation in the fourth, fifth, and sixth embodiments described above, a memory area may be provided for storing pre-calculated values for the recording start length HS in association with various paper lengths T and recording densities. In this case, the printer 1 would be configured to read the recording start length HS correspond to the paper length T and recording density acquired from the memory area and to set the leading edge of the recording paper P based on this recording start length HS. With this configuration, the printer 1 need not calculate the recording start length HS each time a page printing process is executed, thereby shortening the time required for performing the overall printing process.

Further, in cases where the conveying distance of a small feed is sufficient for conveying an edge of the recording paper P through the nip point between the conveying rollers 60 or discharge rollers 61, even when accounting for mechanical error and control error, and when the printer 1 is provided with a high-precision conveying control mechanism, the conveying operation can be configured to convey an edge of the recording paper P through a nip point during a small feed rather than a large feed.

When recording at a low recording density, the conveying distance for a single conveying operation is larger, even in uniform conveyance. Therefore, if the conveying distance is large enough for the edge of the recording paper P to pass through the nip point between the conveying rollers 60 or discharge rollers 61, then the printer 1 can be configured to execute the page printing process using uniform conveyance.

What is claimed is:

1. A method of controlling an image forming device including: a recording head that forms images on a recording medium having a width and a length, the recording head being disposed in a position along a recording medium conveying path; a first pair of conveying rollers that is disposed in a first position along the recording medium conveying path and conveys the recording medium with frictional force created at a nip position, the recording medium being conveyed while being oriented in a direction in which a lengthwise of the recording medium is in parallel with a recording medium conveying direction; and a second pair of conveying rollers that is disposed in a second position along the recording medium conveying path and conveys the recording medium with frictional force created at a nip position, the first position being upstream of the position in which the recording head is disposed and also of the second position with respect to the recording medium conveying direction, a distance between the first position and the second position being set shorter than the length of the recording medium, the method comprising:

(a) controlling the first and second pairs of conveying rollers to halt a conveying operation of the recording medium when a leading edge of the recording medium has moved to or exceeded a position downstream from the nip position of the second pair of conveying rollers by a prescribed distance during a prescribed period of time running from a time instant when the leading edge of the recording medium has passed through the nip position of the second pair of the conveying rollers, wherein the step (a) comprises:

(b) conveying the recording medium on a step-by-step basis to selectively execute a first step conveyance and a second step conveyance, wherein the conveying step (b) changes a conveying distance such that the first step conveyance is executed by the first pair of conveying rollers to convey the recording medium in a first conveying distance and the second step conveyance is executed by the first pair of conveying rollers to convey the recording medium in a second conveying distance, the second conveying distance being greater than the first conveying distance;

(c) conveying the recording medium in the second conveying distance when the leading edge of the recording medium passes through the nip position of the second pair of conveying rollers.

2. The method as claimed in claim 1, wherein the step (b) comprises:

(d) conveying the recording medium a plurality of first step conveyances successively and then a single second step conveyance.

3. The method as claimed in claim 2, wherein the step (b) comprises:

(e) moving the leading edge of the recording medium to a start position determined based on the first and second conveying distances, a first distance between a head position in which the recording head is disposed and the nip position of the second pair of conveying rollers, a second distance that is defined by the first distance and the first prescribed distance.

4. The method as claimed in claim 1, further comprising:

(f) forming images by reciprocating the recording head in a direction orthogonal to the recording medium conveying direction.

5. The method as claimed in claim 1, further comprising:

(g) calculating a start position where the leading edge of the recording medium is positioned relative to a head position in which the recording head is disposed, based on the first and second conveying distances, a first distance between the head position and the nip position of the second pair of conveying rollers, a second distance that is defined by the first distance and the first prescribed distance; and (h) controlling the recording head to form images when the leading edge of the recording medium has reached the start position.

6. The method as claimed in claim 1, further comprising:

(i) conveying the recording medium in the second conveying distance when the trailing edge of the recording medium passes through the nip position of the first pair of conveying rollers.

* * * * *